US005652399A

United States Patent [19]

Fujiwara et al.

[11] Patent Number: 5,652,399

[45] Date of Patent: Jul. 29, 1997

[54] AUTOMATIC PLAYER PIANO AND ESTIMATOR FOR ACCELERATION OF DEPRESSED KEY INCORPORATED IN THE AUTOMATIC PLAYER PIANO

[75] Inventors: Yuji Fujiwara; Taro Kawabata; Yasuhiko Oba; Shigeru Muramatsu; Yoshimasa Isozaki; Jun Ishii, all of Shizuoka-ken, Japan

[73] Assignee: Yamaha Corporation, Japan

[21] Appl. No.: 673,016

[22] Filed: Jun. 28, 1996

Related U.S. Application Data

[63] Continuation of Ser. No. 356,871, Dec. 15, 1994, abandoned.

[30] Foreign Application Priority Data

Dec. 17, 1993 [JP] Japan ..... 5-344241
Dec. 17, 1993 [JP] Japan ..... 5-344242

[51] Int. Cl.[6] ..... G10F 1/02

[52] U.S. Cl. ..... 84/21; 84/22; 84/462; 84/601; 84/DIG. 7

[58] Field of Search ..... 84/20, 21, 22, 84/23, 33, 601, 626, 462, DIG. 7

[56] References Cited

U.S. PATENT DOCUMENTS

| | | | |
|---|---|---|---|
| 4,913,026 | 4/1990 | Kaneko et al. | 84/21 |
| 4,970,928 | 11/1990 | Tamaki | 84/21 |
| 5,083,491 | 1/1992 | Fields | 84/21 |
| 5,210,367 | 5/1993 | Taguchi et al. | 84/746 |
| 5,451,708 | 9/1995 | Fujiwara et al. | 84/21 |

FOREIGN PATENT DOCUMENTS

| | | |
|---|---|---|
| 58-169192 | 10/1983 | Japan . |
| 1-239594 | 9/1989 | Japan . |

*Primary Examiner*—Cassandra C. Spyrou
*Attorney, Agent, or Firm*—Graham & James LLP

[57] ABSTRACT

An automatic player piano controls keys to be rotated by solenoid-operated actuator units in such a manner as to pass a reference point on a trajectory of the key at a reference velocity in a playback mode, and a hammer driven by the depressed key strikes strings at the same intensity as that in a recording mode, because the intensity is variable with the reference velocity at the reference point.

24 Claims, 36 Drawing Sheets t10
t11
t12
10.00
0.00
(mm)
2000
3000(ms)
2200
2400
2600
2800
3000
[ms]

10.00
0.00
[mm]
2000
3000 [ms]
1750
1800
1850
1900
1950
2000
[ms]

10.00
0.00
[mm]
2000
3000 [ms]
2200
2400
2600
2800
3000
[ms]

10.00
0.00
[mm]
1750
2000 [ms]
1800
1850
1900
1950
2000
[ms]

10.00
0.00
[mm]
2000
3000
[ms]
2200
2400
2600
2800

10.00
[mm]
0.00
1750
2000 [ms]
1800
1850
1900
1950
2000
[ms]

10.00
0.00
[mm]
2000
2200
2400
2600
2800
3000
[ms]
H 10.00
0.00
[mm]
1750
2000
[ms]
1800
1850
1900
1950 t20
t21
t22
10.00
0.00
[mm]
2000
3000
[ms]
2200
2400
2600
2800
3000
[ms]

10.00
0.00
[mm]
1750
2000 [ms]
1850
1900
1950
2000
[ms]

10.00
0.00
[mm]
2000
2200
2400
2600
2800
3000
[ms]
H 10.00
0.00
[mm]
1750
2000 [ms]
1800
1850
1900
1950
2000
[ms]

10.00
0.00
[mm]
2000
2200
2400
2600
2800
3000
[ms]
H 10.00
0.00
[mm]
1750
2000
[ms]
1800
1850
1900
1950

AUTOMATIC PLAYER PIANO AND ESTIMATOR FOR ACCELERATION OF DEPRESSED KEY INCORPORATED IN THE AUTOMATIC PLAYER PIANO

This is a continuation of application Ser. No. 08/356,871 filed on Dec. 15, 1994 now abandoned.

FIELD OF THE INVENTION

This invention relates to an automatic player piano and, more particularly, to an automatic player piano equipped with an estimator for acceleration of a depressed key.

DESCRIPTION OF THE RELATED ART

In the automatic player piano, a solenoid-operated actuator rotates a key instead of a player, and, accordingly, a hammer is driven for rotation toward strings, thereby striking the strings for generating a piano tone. The hammer impact against the strings is dependent on the hammer velocity, and the hammer velocity is assumed to be dependent on the amount of driving current supplied to the solenoid. For this reason, the automatic player piano controls the amount of driving current for changing the hammer impact and the loudness of the piano tone.

This means that the automatic player piano requires information on the hammer velocity immediately before the hammer impact against the strings during a recording, and stores the information in a data storage as an impact data together with a key-on data and a key-off data. The hammer velocity is calculated on the basis of a time interval between measuring points, and the timing data indicative of the time intervals are also recorded for controlling a playback. The automatic player piano may store a series of values of lapse of time from a starting point of a performance.

In the playback, the automatic player piano sequentially reads out the impact data from the data storage, and controls the amount of driving current in accordance with the read-out impact data. Since the driving current is supplied to the solenoid-operated actuators in the form of a pulse, the automatic player piano changes the duty ratio of a driving pulse signal, and the impacts against the strings are modulated in the PWM (Pulse Width Modulation) manner.

In an acoustic piano, time lug is usually introduced between the key motion and the hammer impact against the strings. Accordingly, the automatic player piano starts to supply the driving pulse signal slightly before a time indicated by the timing data, and the time lug is variable with the hammer velocity.

Japanese Patent Publication of Unexamined Application No. 1-239594 discloses an automatic player piano, and the automatic player piano estimates a hammer velocity on the basis of a measured key velocity. The estimated hammer velocity is stored as the impact data in a data storage.

The prior art automatic player piano supplies the driving pulse signal indicative of the strength of the hammer impact to the solenoid-operated actuator at a time indicated by the timing data, and the solenoid-operated actuators are controlled in an open-loop fashion. In other words, the keys are moved with a depressing force at the initiation represented by the hammer impact data, and only the depressing force at the initiation is controlled in the playback. However, while a player is performing a music, he or she delicately changes the depressing force exerted on the keys of the automatic player piano, and the keys and, accordingly, the hammers travel respective trajectories at different velocities. In other words, the hammer velocity immediately before the hammer impact against the strings does not exactly represent the depressing force at the initiation. For this reason, even if the automatic player piano controls the depressing force at the initiation, the playback is not faithful, and is different in musical expression from the original performance.

The prior art automatic player piano detects a released timing at the end position in the recording mode, and cuts off the driving current at the same timing in the playback mode. For this reason, if the player depresses or releases a key at an intermediate point between the rest position and the end position in the recording mode, the prior art automatic player piano can not faithfully reproduce the key action, and the reproduced music becomes different from the originally performed music. The key motion depressed and released at the intermediate point is hereinbelow referred to as "half stroke", and another problem inherent in the prior art automatic player piano is that the half stroke key is not reproduced in the playback mode.

SUMMARY OF THE INVENTION

It is therefore an important object of the present invention to provide an automatic player piano which faithfully reproduces an original performance.

It is also an important object of the present invention to provide an automatic player piano which faithfully reproduces a half stroke key in a playback mode.

To accomplish the first object, the present invention proposes to control a key velocity at a reference point in a playback mode for striking strings at the same intensity as an original performance.

In accordance with one aspect of the present invention, there is provided a keyboard musical instrument comprising: an acoustic piano including a keyboard having a plurality of keys each rotated from a rest position to an end position when a player depresses, a plurality of key action mechanisms functionally connected to said plurality of keys, respectively, a plurality of sets of strings respectively associated with said plurality of keys, and a plurality of hammer assemblies respectively associated with said plurality of sets of strings, and respectively driven by said plurality of key action mechanisms for striking the associated sets of strings; and an automatic playing system including a plurality of key actuators respectively associated with said plurality of keys and operative to rotate the associated keys instead of said player, and a playback sub-system responsive to a music data code for controlling one of said plurality of key actuators in such a manner that the associated key passes a reference point on a trajectory thereof with a physical quantity determining a motion of said associated key, the physical quantity at the reference point causing the hammer assembly associated with the associated key to strike the associated set of strings at an expected intensity.

In accordance with another aspect of the present invention, there is provided a keyboard musical instrument comprising: an acoustic piano including a keyboard having a plurality of keys each rotated from a rest position to an end position when a player depresses, a plurality of key action mechanisms functionally connected to the plurality of keys, respectively, a plurality of sets of strings respectively associated with the plurality of keys, a plurality of hammer assemblies respectively associated with the plurality of sets of strings, and respectively driven by the plurality of key action mechanisms for striking the associated sets of strings; and an automatic playing system including a plurality of key actuators respectively associated with the plurality of keys and operative to rotate the associated keys instead of the player, and a playback sub-system responsive to a music data code containing at least a first piece of data information indicative of one of the plurality of keys to be depressed, a second piece of data information indicative of a hammer velocity of the hammer assembly associated with the aforesaid one of the plurality of keys and a third piece of data information indicative of an impact time when the hammer assembly rebounds on the associated set of strings for controlling the actuator associated with the aforesaid one of the plurality of keys, the playback sub-system determining a reference physical quantity at a reference point on a trajectory of the aforesaid one of the plurality of keys on the basis of the hammer velocity, the playback sub-system determining a reference time for the aforesaid one of the plurality of keys on the basis of the hammer velocity and the impact time, the playback sub-system controlling the actuator in such a manner as to cause the aforesaid one of the plurality of keys to pass the reference point at the reference time at the reference physical quantity, thereby causing the hammer assembly to strike the associated set of strings at the hammer velocity.

To accomplish the second object, the present invention proposes to discriminate a half stroke key from a full stroke key by comparing a finish time of a forward key motion with a starting time of a backward key motion.

In accordance with an aspect of the present invention, there is provided a keyboard musical instrument comprising: an acoustic piano including a keyboard having a plurality of keys each rotated from a rest position to an end position when a player depresses, a plurality of key action mechanisms functionally connected to the plurality of keys, respectively, a plurality of sets of strings respectively associated with the plurality of keys, a plurality of hammer assemblies respectively associated with the plurality of sets of strings, and respectively driven by the plurality of key action mechanisms for striking the associated sets of strings; and an automatic playing system including a plurality of key actuators respectively associated with the plurality of keys and operative to rotate the associated keys instead of the player, and a playback sub-system responsive to a music data code containing pieces of data information for determining a first trajectory of one of the plurality of keys to be rotated toward the end position, a second trajectory of the aforesaid one of the plurality of keys to be rotated toward the rest position, a first starting time of the first trajectory, a finish time of the first trajectory and a second starting time of the second trajectory, the playback sub-system deciding that the music data code represents a half stroke key when the second starting time is earlier than the finish time, the playback sub-system determining a crossing time for merging the first trajectory with the second trajectory for producing a composite trajectory when the music data code represents the half stroke key, the playback sub-system controlling the actuator in such a manner as to cause the aforesaid one of the plurality of keys to trace the composite trajectory.

In accordance with another aspect of the present invention, there is provided a keyboard musical instrument comprising: an acoustic piano including a keyboard having a plurality of keys each rotated from a rest position to an end position when a player depresses, a plurality of key action mechanisms functionally connected to the plurality of keys, respectively, a plurality of sets of strings respectively associated with the plurality of keys, a plurality of hammer assemblies respectively associated with the plurality of sets of strings, and respectively driven by the plurality of key action mechanisms for striking the associated sets of strings; and an automatic playing system including a plurality of key actuators respectively associated with the plurality of keys and operative to rotate the associated keys instead of the player, and a playback sub-system responsive to a music data code containing pieces of data information for determining a first trajectory of one of the plurality of keys to be rotated toward the end position, a second trajectory of the aforesaid one of the plurality of keys to be rotated toward the rest position, a reference physical quantity at a reference point on the first trajectory, a first starting time of the first trajectory, a reference time at the reference point, a finish time of the first trajectory and a second starting time of the second trajectory, the reference physical quantity determining a motion of the aforesaid one of the plurality of keys at the reference point, the playback sub-system deciding that the music data code represents a half stroke key when the second starting time is earlier than the finish time, the playback sub-system determining a crossing time for merging the first trajectory with the second trajectory for producing a composite trajectory when the music data code represents the half stroke key, the playback sub-system controlling the actuator in such a manner as to cause the aforesaid one of the plurality of keys to pass the reference point at the reference time with the reference physical quantity on the first trajectory or on the composite trajectory, thereby causing the hammer assembly to strike the associated set of strings at the hammer velocity.

BRIEF DESCRIPTION OF THE DRAWINGS

The feature and advantages of the automatic player piano and an estimator for acceleration of a depressed key according to the present invention will be more clearly understood from the following description taken in conjunction with the accompanying drawings in which.

DESCRIPTION OF THE PREFERRED EMBODIMENTS

First Embodiment

1-1. Controlling Principle

Figure 1:
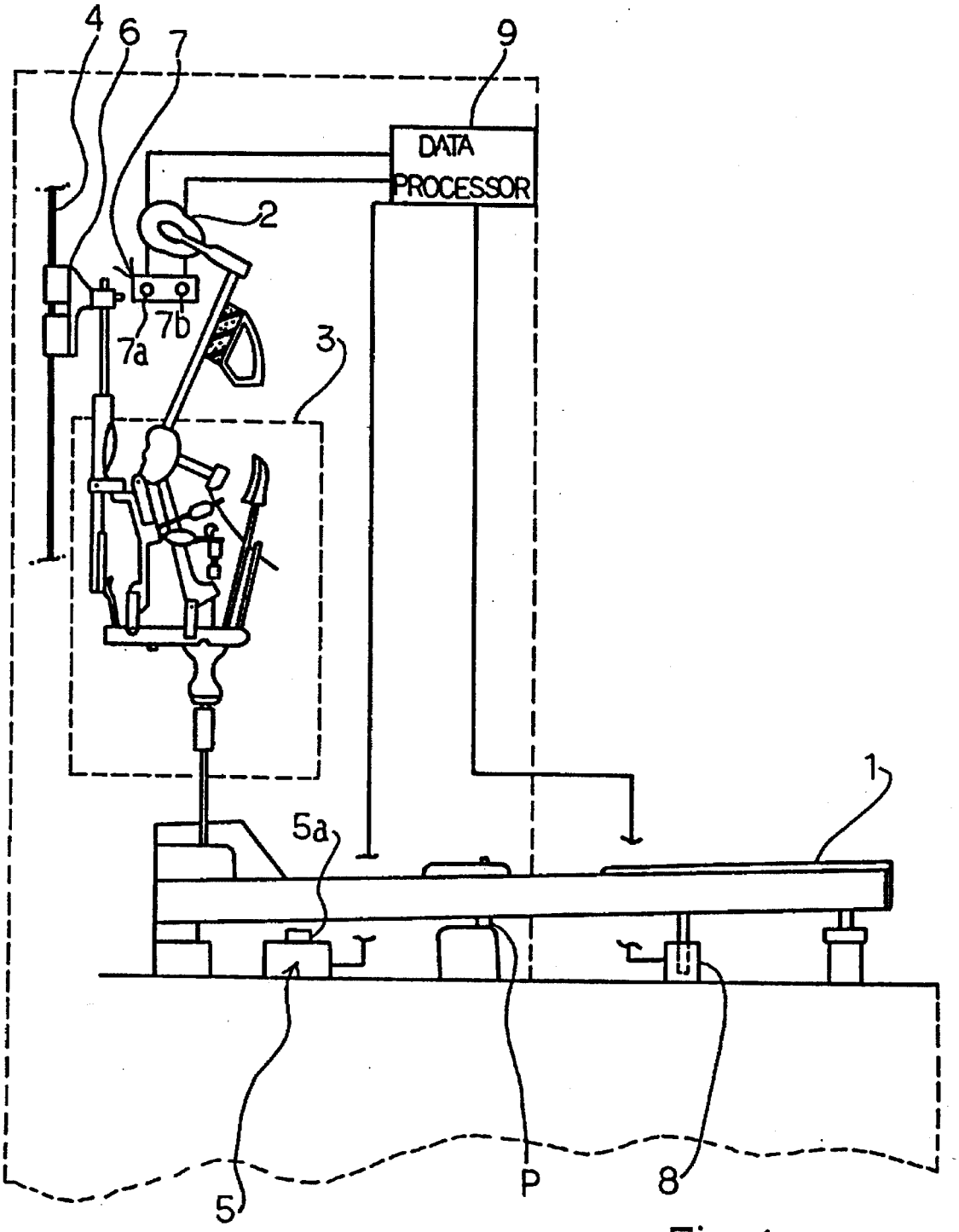
FIG. 1 is a schematic view showing an automatic player piano used for evaluation.

Description is firstly made on a controlling principle for an automatic player piano according to the present invention. FIG. 1 illustrates an automatic player piano comprising a key 1, a hammer 2, a key action mechanism 3 for driving the hammer 2 in response to the key 1 depressed by a player, a set of strings 4 struck by the hammer 2, a solenoid-operated actuator 5 for rotating the key 1 instead of the player, a damper 6 for absorbing vibrations of the strings 4, a hammer sensor 7 for monitoring the hammer motion, a key sensor 8 for monitoring the key motion and a data processor 9 connected to the hammer sensor 7, the key sensor 8 and the solenoid-operated actuator 5.

When the solenoid-operated actuator 5 is energized, the plunger 5*a* upwardly projects, and rotates the key 1 from a rest position to an end position around a balance key pin P. The key 1 actuates the key action mechanism 3 and the damper 6. The damper 6 actuated by the key action mechanism 3 leaves the set of strings 4, and the key action mechanism 3 drives the hammer 2 for rotation. The hammer 2 rebounds on the set of strings 4, and the damper 4 allows the set of strings to vibrate.

The key action mechanism 3, the hammer 2 and the damper 6 similarly behave in an original performance by a player, and the hammer sensor 7 and the key sensor 8 report a current position of the hammer 2 and the current position of the key 1 to the data processor 9.

The hammer sensor 7 is implemented by a pair of detectors 7*a* and 7*b* spaced along the trajectory of the hammer 2, and the detectors 7*a* and 7*b* determine respective timings when the hammer 2 passes in front thereof. The data processor 9 counts a time interval between the two timings, and a hammer velocity is calculated on the basis of the time interval. The timing at the detector 7*a* is memorized as an impact time when the hammer 2 strikes the set of strings 4, and, for this reason, the detector 7*a* is positioned at a rebounding point of the hammer 2.

The data processor similarly determines the trajectory of key 1 on the basis of detected various timings reported by the key sensor 8.

In an original performance, the player depresses the key 1 at a constant speed, or increases or decreases the key velocity for changing musical expression. The key velocity affects the hammer motion.

Using the automatic player piano shown in FIG. 1, the present inventors measured the key velocity and the hammer velocity at the impact against the strings 4, and noticed that the hammer velocity at the impact was explainable with a key velocity at a special point on the trajectory of the depressed key. Although the special point was variable not only between the piano models but also between the products of the same model, the special points ranged between 9.0 millimeters and 9.5 millimeters under the rest positions. Then, the present inventor concluded that the hammer impact was exactly controlled by controlling the key velocity at the special point.

The special point is hereinbelow referred to "reference point Xr", and the key velocity at the reference point Xr is called as "reference velocity Vr".

Figure 2:
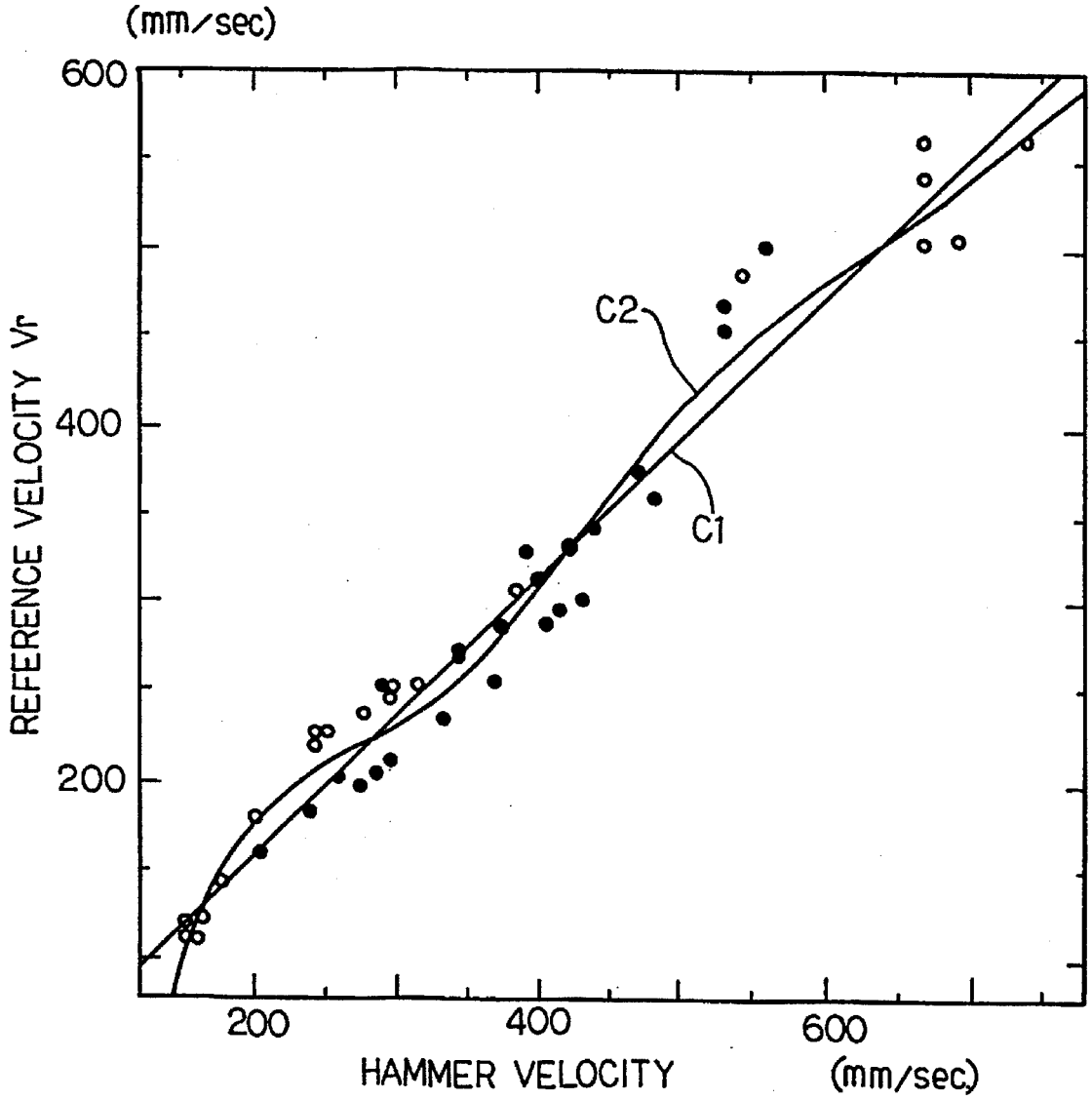
FIG. 2 is a graph showing a relation between a reference velocity and a hammer velocity.

The present inventors plotted the hammer velocity in terms of the reference velocity Vr in FIG. 2. The reference point Xr was set to 9.5 millimeters below the rest position. Bubbles stand for the hammer velocities measured in single key motions each depressed from the rest position to the end position, and dots represent the hammer velocities measured in repetition where the key 1 returns toward the rest position before reaching the end position.

C1 is indicative of the first-order least square approximation, and C2 is the sixth-order least square approximation. As will be understood, the relation between the reference velocity Vr and the hammer velocity at the impact is well approximated by using the linear line C1 and the non-linear line C2. In other words, the reference velocity of a key 1 is determined by using an impact data indicative of the hammer velocity. If the linear line C1 indicative of the first-order least square approximation is employed, the reference velocity Vr is calculated as follows.

$$Vr=alpha \times vH+beta \quad \text{Equation 1}$$

where vH is the hammer velocity indicated by the impact data and alpha and beta are constants. The constants alpha and beta are determined through experiments using an actual automatic player piano. The constants alpha and beta are variable by changing the reference point Xr.

Subsequently, it is necessary for us to determine a reference time tr when the key 1 passes the reference point Xr. Now, we define a reference time interval Tr as "a time interval between the reference time tr and an impact time when the hammer 2 strikes the strings 4". The detector 7*a* is positioned at the rebounding point, and the timing data reported by the detector 7*a* is indicative of the impact time.

Figure 3:
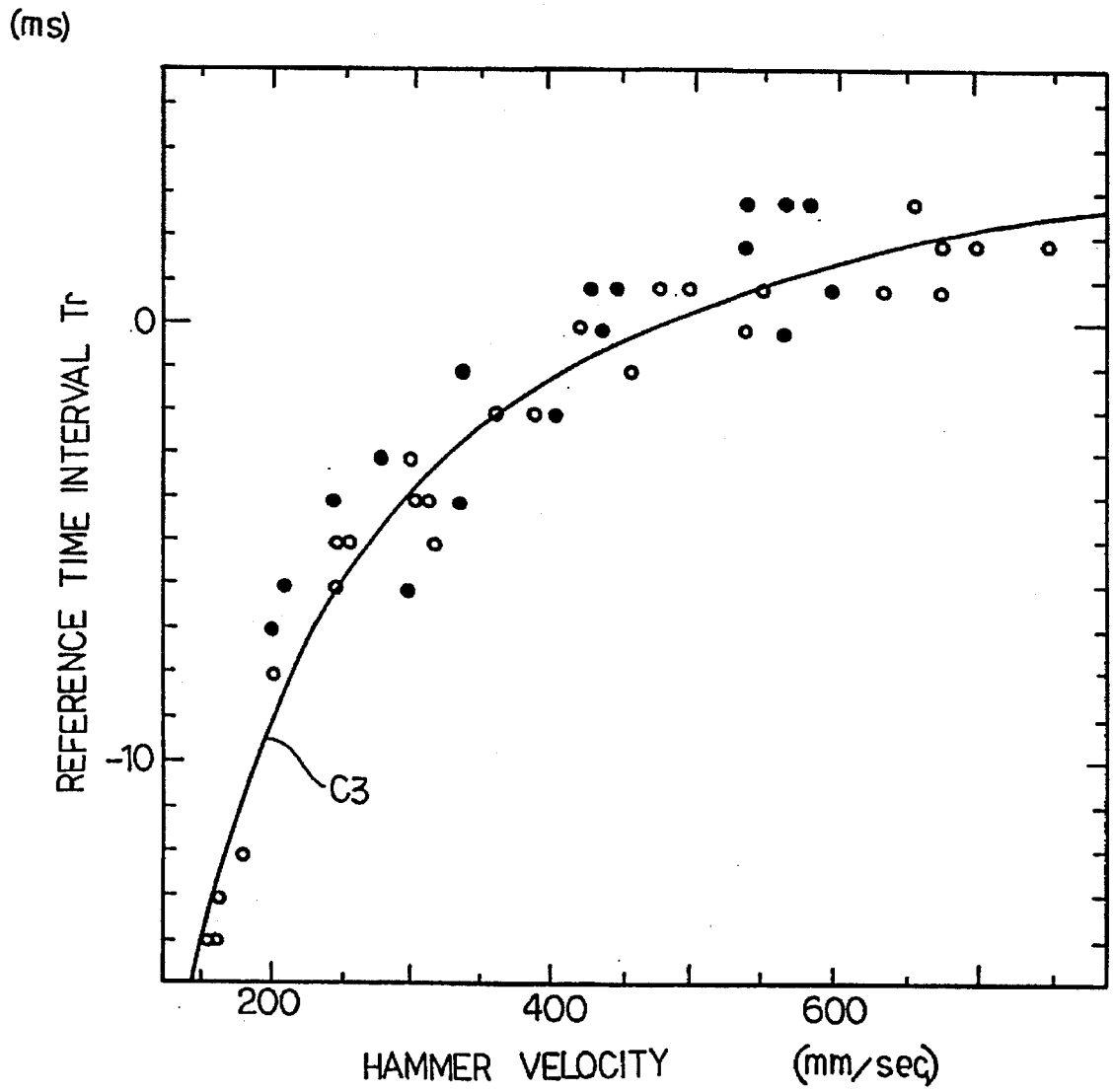
FIG. 3 is a graph showing a relation between a reference time interval and a hammer velocity.
Figure 4:
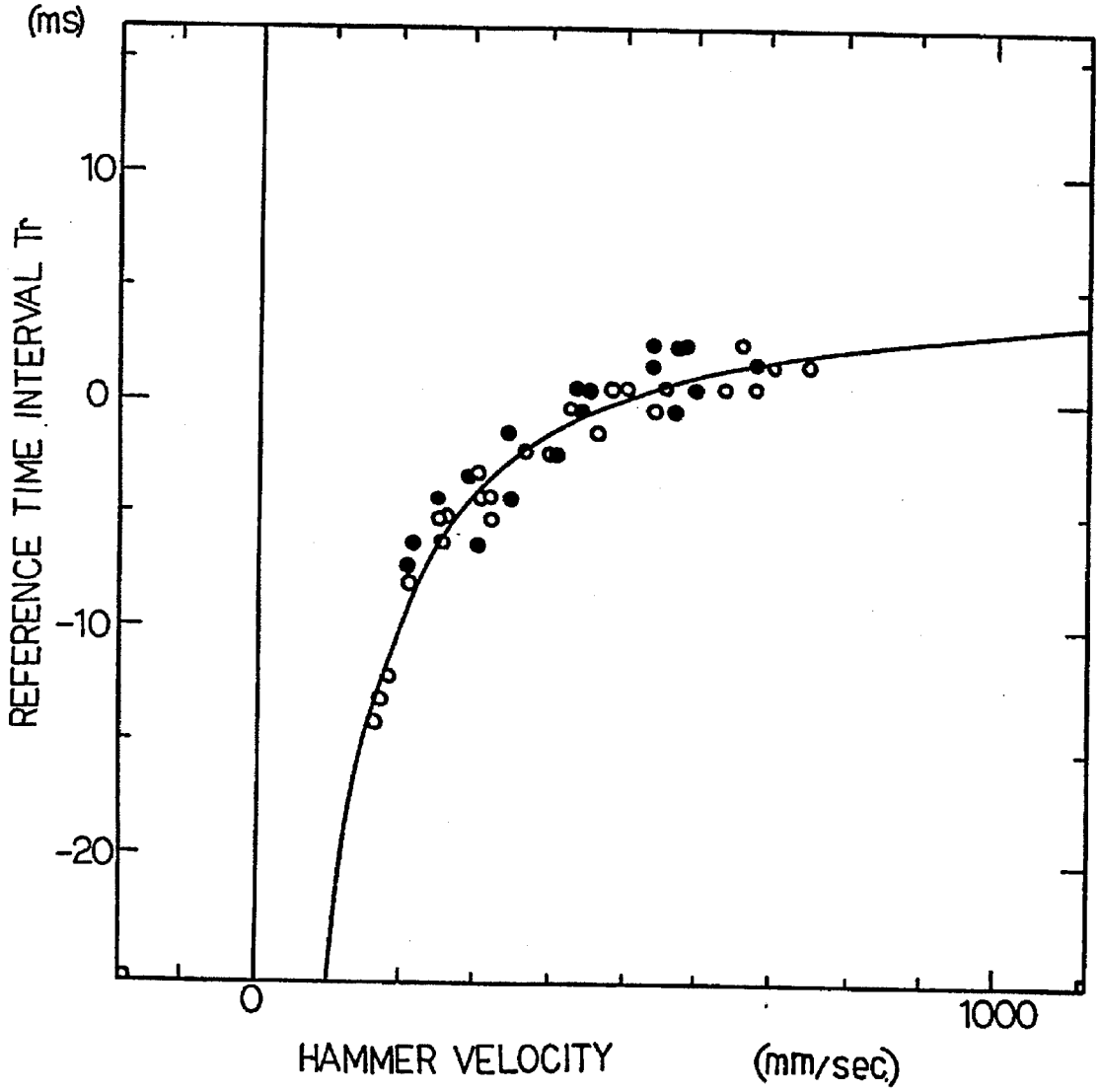
FIGS. 4 and 5 are graphs scaling up the relation shown in FIG. 3.
Figure 5:
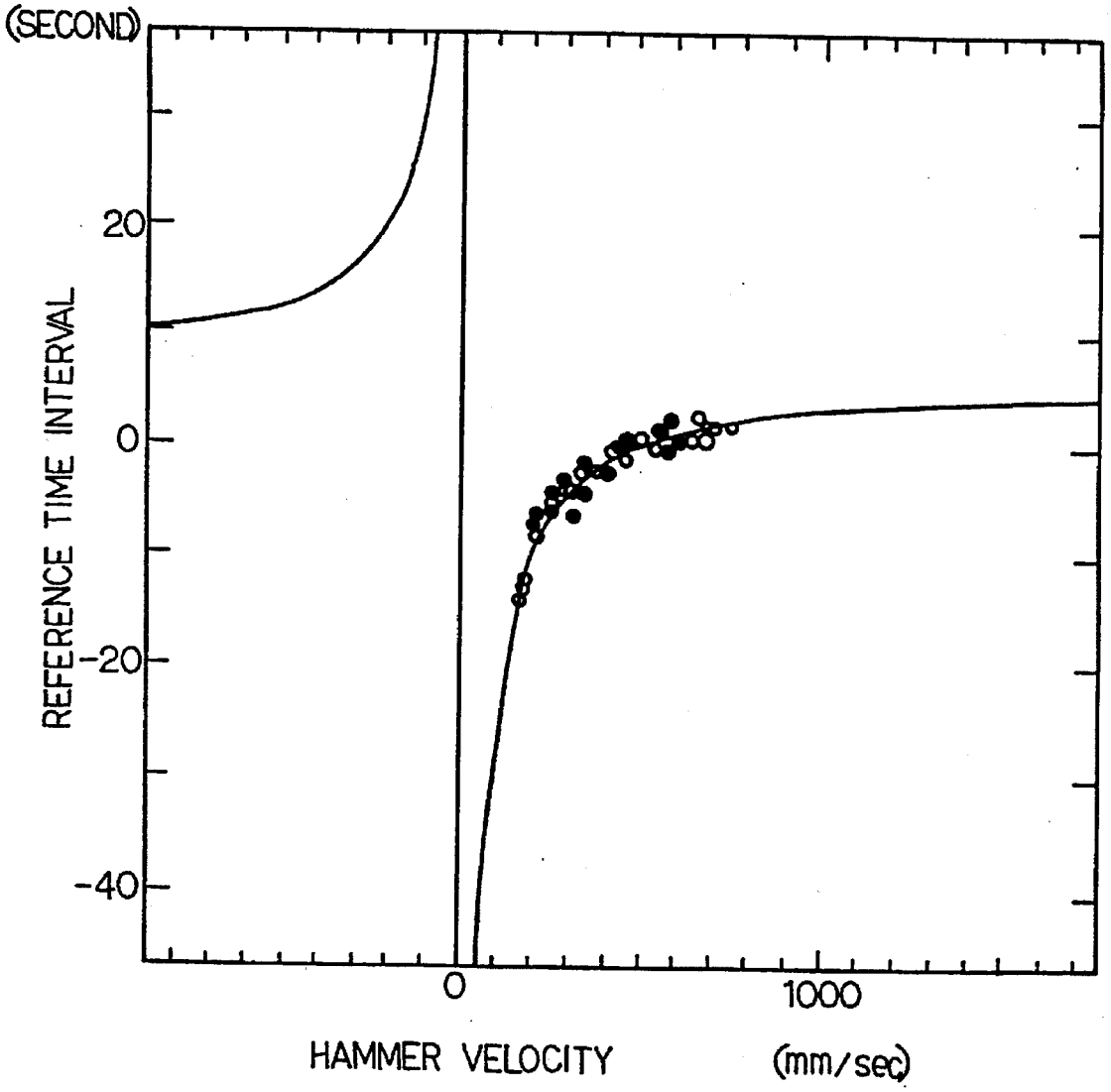

The present inventors plotted the reference time interval Tr in terms of the hammer velocity in FIG. 3. Bubbles stands for the reference time intervals in the single depressing, and dots represents the reference time intervals in the repetition as similar to FIG. 2. The relation between the reference time interval Tr and the hammer velocity is scaled up at 200 percent in FIG. 4, and at 400 percent in FIG. 5. The reference time intervals Tr are approximated by a hyperbolic line C3, and is expressed as Equation 2.

$$Tr=1(c/vH)+d \quad \text{Equation 2}$$

where c and d are constants, and are determined through experiments. When the reference point Xr is changed in the experiments, constants c and d are variable depending upon the reference point Xr.

If the reference time interval Tr is calculated by using Equation 2, the reference time tr is given by subtracting the reference time interval Tr from the difference between a lapse of time between a starting time of the key motion and the impact time. This means that the hammer 2 is expectable to faithfully reproduce an original tone if the key 1 is controlled in such a manner as to pass the reference point Xr at the reference time tr at the reference velocity Vr.

If the hammer 2 strikes the strings 4 at the reference point Xr, the reference time interval Tr is useless.

Thus, the reference velocity Vr at the reference point Xr results in a faithful reproduction of the original tone. The present inventors form a feedback loop for controlling the key 1, and controls the key 1 in accordance with a table indicating a relation between a target key position and a lapse of time. The table may be produced on the assumption that the key 1 behaves as a uniform motion, a uniformly accelerated motion and so forth.

1-2. Structure and Operation

Figure 6:
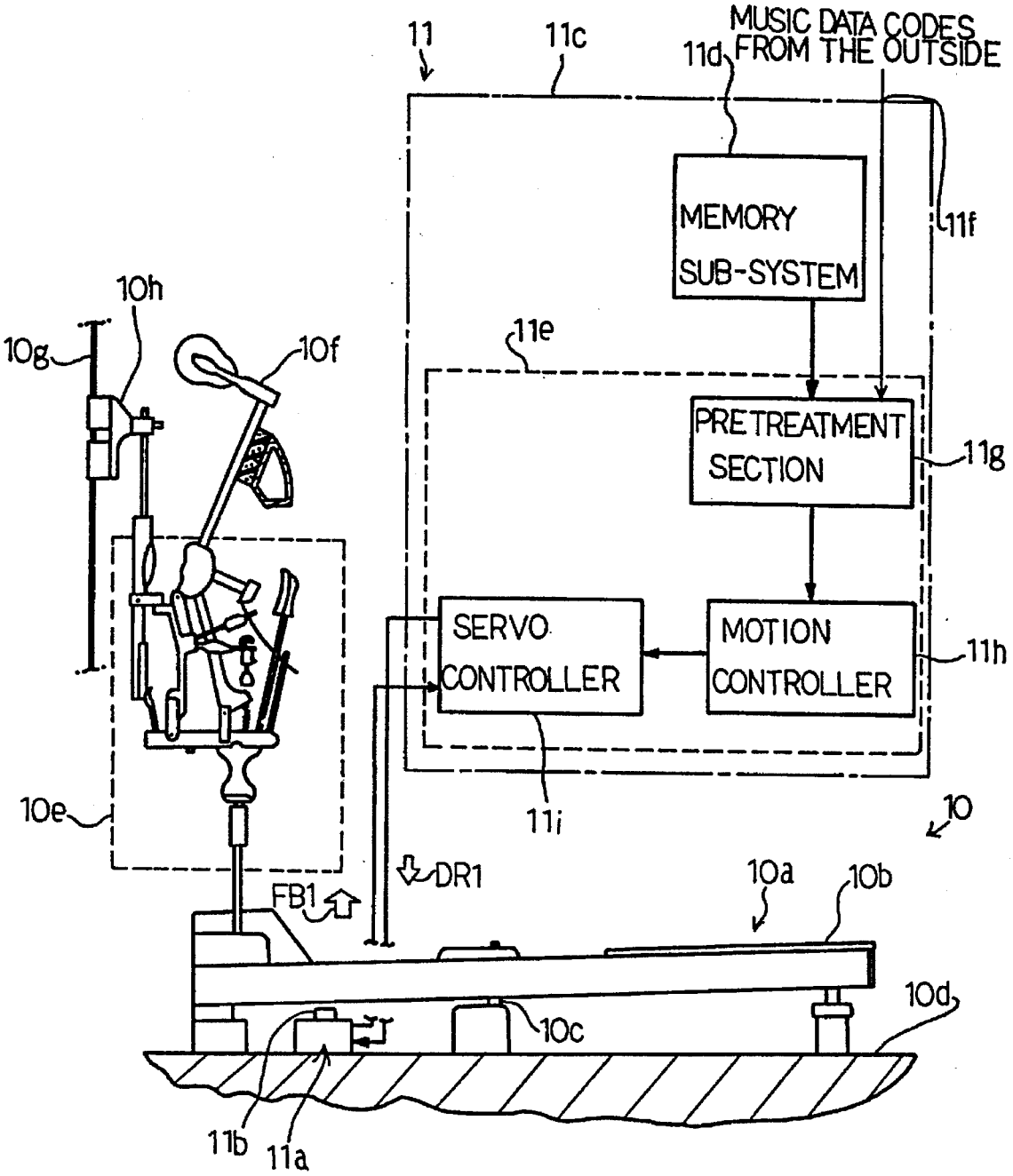
FIG. 6 is a schematic view showing the structure of an automatic player piano according to the present invention.

Referring to FIG. 6 of the drawings, an automatic player piano embodying the present invention largely comprises an acoustic piano 10 and an automatic player system 11.

The acoustic piano 10 is an upright piano, and largely comprises a keyboard 10*a* implemented by a plurality of keys 10*b* turnably supported by a balance key pin 10*c* on a key bed 10*d*. FIG. 6 illustrates the keys 10*b* at respective rest position, and each key 10*b* turns from the rest position to an end position around the balance key pin 10*c* when a player depresses.

The acoustic piano 10 further comprises a plurality of key action mechanisms 10*e* functionally connected to the keys 10*b*, respectively, a plurality of hammer assemblies 10*f* respectively driven for rotation by the key action mechanisms 10*e*, a plurality of sets of strings 10*g* respectively struck by the hammer assemblies 10*f* and a plurality of damper assemblies 10*h* actuated by the key action mechanisms 10*e* for leaving the associated sets of strings 10*g*. The acoustic piano 10 is similar to a standard upright piano, and the behaviors of the key action mechanism 10*e*, the hammer assembly 10*f*, the strings 10*g* and the damper assembly 10*h* are well known to a person skilled in the art. For this reason, no further description is incorporated hereinbelow.

The automatic playing system 11 comprises a plurality of solenoid-operated actuator units 11*a* provided under the keys 10*b* and having respective plungers 11*b* protectable for rotating the associated keys 10*b* around the balance key pins 10*c* instead of the player and a controller 11*c* connected to the solenoid-operated actuator units 11*a*. Each of the solenoid-operated actuator unit 11*a* has a built-in position sensor for reporting an actual position of the plunger 11*b* to the controller 11*c*.

The controller 11*c* comprises a memory unit sub-system 11*d* for storing music data codes indicative of a performance and a playback sub-system 11*e* responsive to the music data codes for controlling the solenoid-operated actuator units 11*a* in a playback mode. The memory sub-system 11*d* may be implemented by a floppy disk driver and a floppy disk. A data input port 11*f* is provided for music data codes supplied from the outside thereof through, for example, a real time communication system (not shown).

Each of the music data codes contains at least a first piece of data information indicative of a depressed/released key, a second piece of data information indicative of the hammer velocity vH and a third piece of data information indicative of the impact time.

The playback sub-system 11*e* comprises a pre-treatment section 11*g* for generating preliminary control data indicative of a target trajectory of each key 10*b* to be rotated by the solenoid-operated actuator unit 11*a*, a motion controller 11*h* for producing control data indicative of an expected motion of the plunger 11*b* and a servo controller 11*i* forming a plurality of feedback loops together with the solenoid-operated actuator units 11*a* and the built-in position sensors for driving the key 10*b* along the target trajectory.

The pretreatment section 11*g* firstly calculates the reference time tr and the reference velocity Vr, and estimates an acceleration, if necessary. The pretreatment section 11*g*, thereafter, determines a kind of the key motion, i.e., a uniform motion, a uniformly accelerated motion or other motion, and generates the preliminary control data. The preliminary control data are indicative of the target trajectory approximated to the original trajectory of the key 10*b* in an original performance.

The servo controller 11*i* produces a driving signal DR1 from the control data, and supplies the driving signal DR1 to the solenoid-operated actuator unit 11*a*. The servo controller 11*i* controls the plunger 11*b* with the driving signal DR1 so that the key 10*b* is urged to trace the target trajectory. The built-in position sensor monitors the plunger 11*b*, and supplies a feedback signal FB1 indicative of the actual position of the plunger 11*b* to the servo controller 11*i*. If the actual position is not matched to the corresponding position on the target trajectory, the servo controller 11*i* changes the amount of current specified by the driving signal DR1 so as to match the actual trajectory with the target trajectory. As a result, the key 10*b* is forced to trace the target trajectory, and the key motion is well approximated to the actual motion in the original performance. The key 10*b* passes the reference point Xr at the reference velocity Vr, and the hammer assembly 10*f* strikes the set of strings 10*g* at the same intensity as the hammer assembly 10*f* in the original performance. As a result, the set of strings 10*g* reproduces the original tone, and the automatic player piano faithfully reproduces the music originally performed in the recording mode.

Second Embodiment

Figure 7:
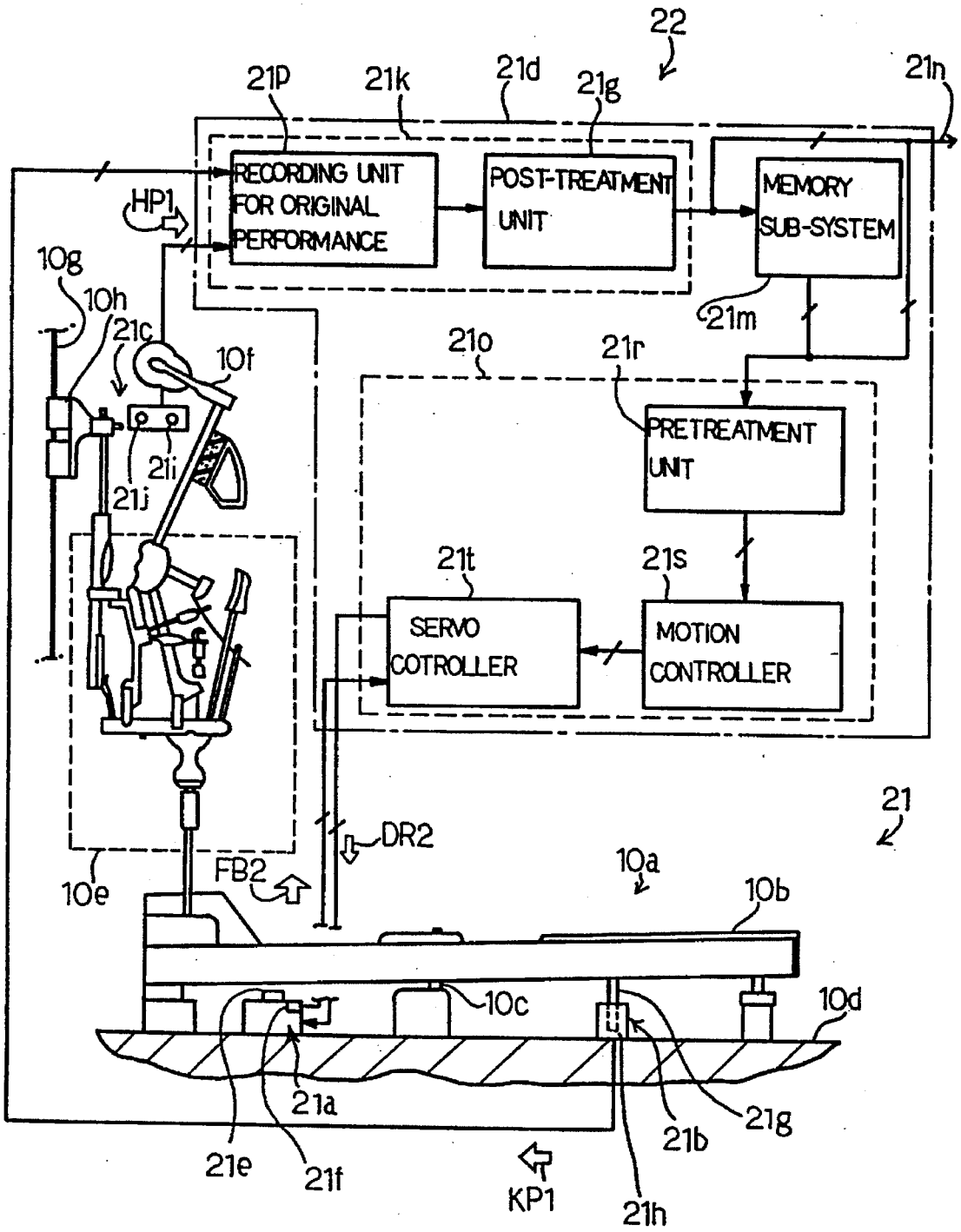
FIG. 7 is a schematic view showing the structure of another automatic player piano according to the present invention.

Turning to FIG. 7 of the drawings, another automatic player piano embodying the present invention largely comprises an acoustic piano 21 and an automatic playing system 22. The acoustic piano 21 is similar to the acoustic piano 10, and the components of the acoustic piano 21 are labeled with the same references as the corresponding components of the acoustic piano 10 without detailed description.

The automatic playing system 22 comprises a plurality of solenoid-operated actuator units 21*a* respectively provided under the keys 10*b*, a plurality of key sensors 21*b* also provided under the keys 10*b*, a plurality of hammer sensors 21*c* respectively associated with the hammer assemblies 10*f* and a controller 21*d* connected to the solenoid-operated actuator units 21*a*, the key sensors 21*b* and the hammer sensors 21*c*.

Each of the solenoid-operated actuator units 21*a* has a plunger 21*e* upwardly pushing the associated key 10*b* and a built-in position sensor 21*f* for monitoring the plunger 21*e*, and the built-in position sensor 21*f* generates a feedback signal FB2 indicative of an actual position of the plunger 21*e*.

Each of the key sensors 21*b* is implemented by a shutter plate 21*g* attached to the lower surface of the associated key 10*b* and a plurality of photo-couplers 21*h*, and a slit pattern is formed in the shutter plate 21*g*. The plurality of photo-couplers are provided along the trajectory of the shutter plate 21*g*, and are spaced by a predetermined distance.

When the key 10*b* is depressed, the shutter plate 21*g* is downwardly moved, and sequentially crosses optical paths of the photo-couplers 21*h*. In this instance, each of the key sensors 21*b* is implemented by lower and upper photo-couplers. The shutter plate 21*g* sequentially interrupts the optical radiation of the upper photo-coupler and the optical radiation of the lower photo-coupler on the way from the rest position to the end position, and the optical path of the lower photo-coupler and the optical path of the upper photo-coupler are successively established by the upwardly moving shutter plate 21*g*. The shutter plate 21*g* is moved together with the associated key 10*b*, and, for this reason, the actual position of the shutter plate 21*g* is equivalent to the actual position of the key 10*b*. The key sensor 21*b* generates a key position signal KP1 indicative of the actual position of the key 10*b*. The shutter plate 21*g* allows the upper photo-coupler to pass through the slit pattern when the damper assembly 10*h* comes into contact with the set of strings 10*g* again.

Each of the hammer sensors 21*c* is implemented by photo-couplers 21*i* and 21*j*, and the photo-couplers 21*j* are positioned at rebounding points of the associated hammer assemblies 10*f*. For this reason, an impact time ti or the rebound of the hammer assembly 10*f* on the strings 10*g* are detectable by the associated photo-coupler 21*j*. Each of the hammer sensors 21*c* produces a hammer position signal HP1 indicative of an actual position of the associated hammer assembly 10*f*.

The controller 21*d* is broken down into a recording sub-system 21*k* for producing music data codes indicative of an original performance on the key board 10*a*, a memory sub-system 21*m* for storing the music data codes, a data port 21*n* for communicating with the outside thereof and a playback sub-system 21*o* for controlling the solenoid-operated actuator units 21*a*. In this instance, each of the music data codes contains at least a first piece of data information indicative of a depressed/released key 10*b*, a second piece of data information indicative of a hammer velocity vH, a third piece of data information indicative of the impact time ti, a fourth piece of data information indicative of a released key velocity vkN and a fifth piece of data information indicative of a return time tkN. The fourth and fifth pieces of data information will be described hereinlater.

The recording sub-system 21*k* has a recording unit 21*p* for generating the first to fifth pieces of data information and a post-treatment unit 21*q* for normalizing the second to fifth pieces of data information.

The recording unit 21*p* behaves in a recording mode as follows. Assuming now that a player depresses one of the keys 10*b*, the depressed key 10*b* actuates the key action mechanism 10*e*. The actuated key action mechanism 10*e* drives the associated hammer assembly 10*f* for rotation at an escape, and the hammer assembly 10*f* rotates toward the strings 10*g*.

The hammer assembly 10*f* firstly interrupts the photo-radiation of the photo-coupler 21*i*, and, thereafter, interrupts the photo-radiation of the photo-coupler 21*j*. The recording unit 21*p* counts the time interval between the interruption of the photo-coupler 21*i* and the interruption of the photo-coupler 21*j*. The distance between the photo-couplers 21*i* and 21*j* is divided by the time interval, and determines the hammer velocity vH for the depressed key 10*b*. A code assigned to the depressed key 10*b* serves as the first piece of data information, and the hammer velocity vH serves as the second piece of data information.

When the hammer assembly 10*f* rebounds on the strings 10*g*, the hammer assembly 10*f* interrupts the photo-radiation of the photo-coupler 21*j*, and the recording unit 21*p* determines the impact time ti. The impact time serves as the third piece of data information.

When the player releases the key 10*b* at the end position, the key 10*b* backwardly moves from the end position to the rest position, and the shutter plate 21*g* sequentially allows the lower photo-coupler and the upper photo-coupler to establish the optical paths again. When the shutter plate 21*g* allows the lower photo-coupler of the key sensor 21*b* to sense the optical radiation, the recording unit 21*p* starts to count a time interval, and determines the time interval upon the photo-detection of the upper photo-coupler of the key sensor 21*b*. The recording unit 21*p* calculates a released key velocity vkN by dividing the predetermined distance between the lower and upper photo-couplers by the time interval. The recording unit 21*p* further determines a return time tkN upon the photo-detection of the upper photo-coupler. The released key velocity vkN and the return time tkN serve as the fourth piece of data information and the fifth piece of data information.

The post-treatment unit 21*q* normalizes the second to fifth pieces of data information supplied from the recording unit 21*p*, and the first to fifth pieces of data information are coded as the music data code. The normalization eliminates noise due to differences between the individual products from the second to fifth pieces of data information. In detail, the hammer velocity vH, the impact time ti, the released key velocity vkN and the return time tkN are affected by differences between designated positions of the key and hammer sensors 21*b* and 21*c* and actual positions thereof, difference in the dimensions and so forth. The post-treatment unit 21*q* stores parameters determined on the basis of these differences, and changes the second to fifth pieces of data information to those of an ideal product.

Thus, while the player is performing a music on the keyboard 10*a*, the recording unit 21*p* and the post-treatment unit 21*q* generate a series of music data codes indicative of the performance.

The playback sub-system 21*o* comprises a pretreatment unit 21*r*, a motion controller 21*s* and a servo controller 21*t* as similar to the playback sub-system 11*e* of the first embodiment.

Figure 8:
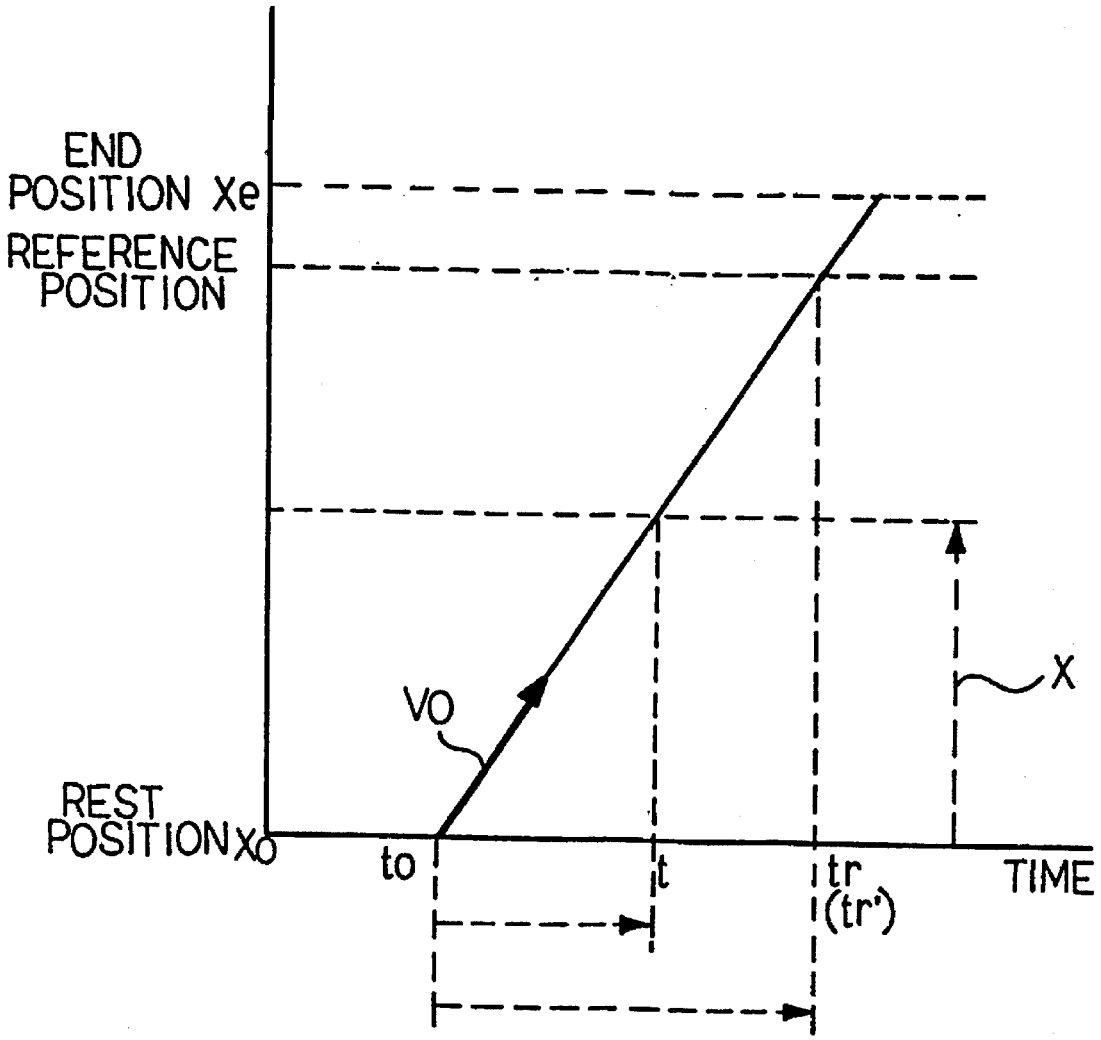
FIG. 8 is a diagram showing a trajectory of a depressed key of the automatic player piano shown in FIG. 7.

The pretreatment unit 21*r* generates preliminary control data indicative of a first trajectory of a depressed key and a second trajectory of a released key as follows. In this instance, the key 10*b* is assumed to behave in a uniform motion, and FIG. 8 illustrate the first trajectory of one of the keys 10*b*. If the key 10*b* starts the uniform motion from the rest position Xo at time t0, the key 10*b* is moved toward the end position Xe at a constant speed V0. The key 10*b* is assumed to move over distance X and reach there at time t. The distance X is expressed as Equation 3.

$X=V0\times t+X0+tm$ Equation 3

The reference point Xr is given as $$Xr=V0\times tr'+X0 \quad \text{Equation 4}$$

where tr' is the reference time on the assumption that the key 10*b* starts at time zero. Solving Equation 4 for the reference time tr', the reference time tr' is expressed as $$tr'=(Xr-X0)/V0 \quad \text{Equation 4'}$$

A starting time t0 of the depressed key 10*b* on an absolute time scale is given by Equation 5.

$$t0=tr-tr'=tr-(Xr-X0)/V0 \quad \text{Equation 5}$$

Therefore, if the solenoid-operated actuator unit 21*a* causes the plunger 21*e* to upwardly push the associated key 10*b* at time to and controls the distance X in accordance with Equation 3, the key 10*b* reaches the reference point Xr at the reference time tr, and the key velocity at the reference point Xr is equal to the reference velocity Vr.

In this instance, the key 10*b* is assumed to behave in the uniform motion, and the reference velocity Vr is equal to the constant key velocity V0. The music data code gives the hammer velocity vH, and the reference velocity Vr is calculated by using Equation 1. The reference time tr is calculated by subtracting the reference time interval Tr (see Equation 2) from the impact time ti.

The preliminary control data produced by the pretreatment unit 21*r* are further used for controlling a backward motion after a release of the depressed key 10*b* as follows.

Figure 9:
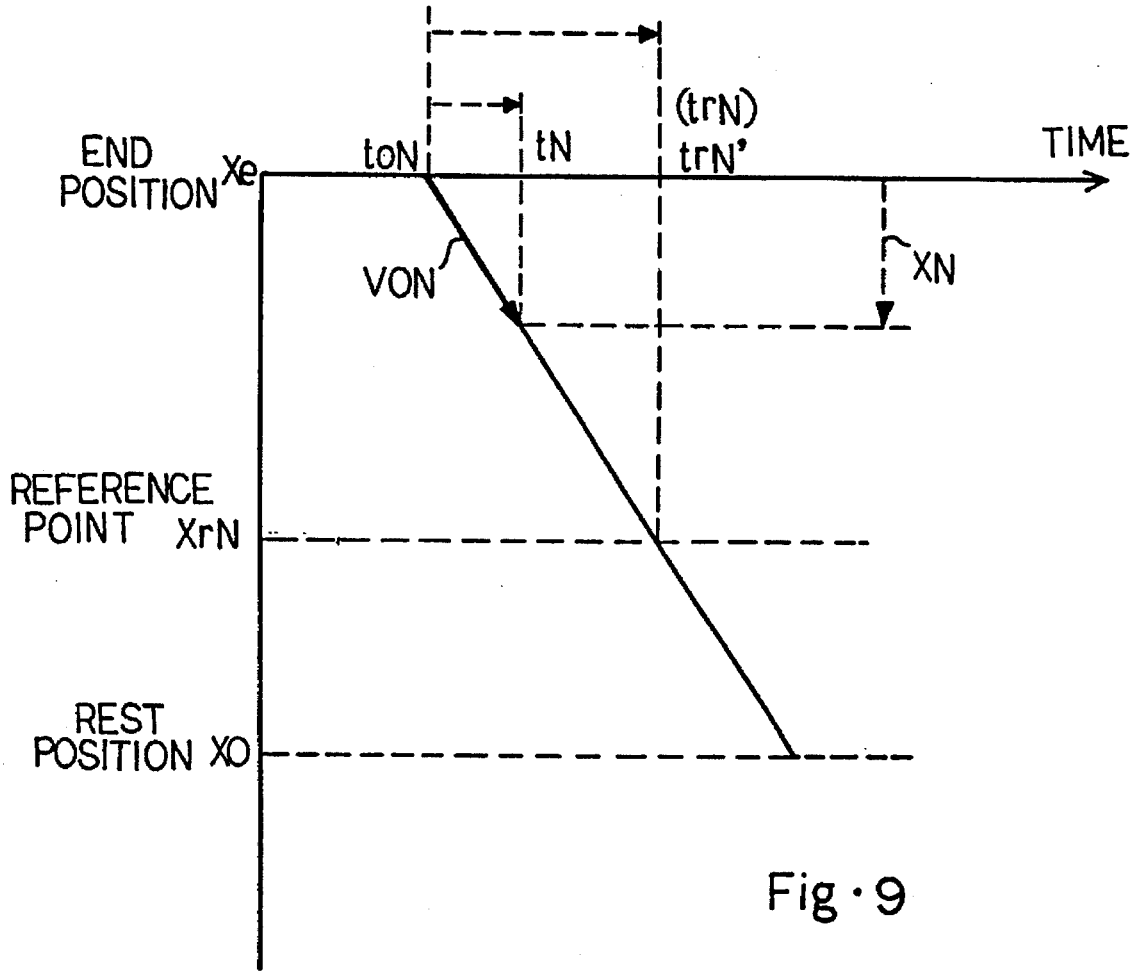
FIG. 9 is a diagram showing a trajectory of a released key of the automatic player piano.

A key position XN at a time tN is expressed by Equation 6.

$$XN=V0N\times tN+Xe \quad \text{Equation 6}$$

where V0N is the initial key velocity (<0) at the end position Xe. The second trajectory represented by Equation 6 is illustrated in FIG. 9 of the drawings.

As described hereinbefore, the damper assembly 10*h* comes into contact with the associated set of strings 10*g* at the return time tkN, and the damper assembly 10*h* starts the absorption of the vibrations on the strings 10*g*. Let us assume that the damper assembly 10*h* comes into contact with the strings 10*g* at a key position on the second trajectory defined as "released reference point XrN", the playback sub-system 21*o* controls the released key 10*b* in such a manner as to reach the reference point XrN at the return time tkN, and the decay of the reproduced tone is approximated to the decay of the original tone.

The damper velocity at the contact with the strings 10*g* strongly affects the decay of the tone, and the damper velocity is related to the key velocity. For this reason, the key velocity at the released reference point XrN is controlled to be matched with the released key velocity vkN. The key velocity at the released reference point XrN is referred to as "released reference velocity VrN".

If a key 10*b* is released at time zero, the released reference point XrN is expressed as $$XrN=V0N\times trN'+XeN \quad \text{Equation 7}$$

where trN' is a time when the released key 10*b* reaches the reference point. XrN and V0N are equal to VrN and VkN because of the uniform motion. From Equation 7, trN' is determined, and the starting time t0N is given by Equation 8.

$$t0N=trN-trN'=trN-(XrN-XeN)/V0N \quad \text{Equation 8}$$

The playback sub-system 21*o* controls the released key 10*b* from the starting time t0 for moving the key 10*b* on the second trajectory expressed by Equation 6. Then, the released key 10*b* passes the released reference point XrN at the return time tkN. In this instance, the initial key velocity V0N is equal to the reference key velocity vkN, and the reference key velocity vkN is equal to the released reference velocity VrN.

Figure 10:
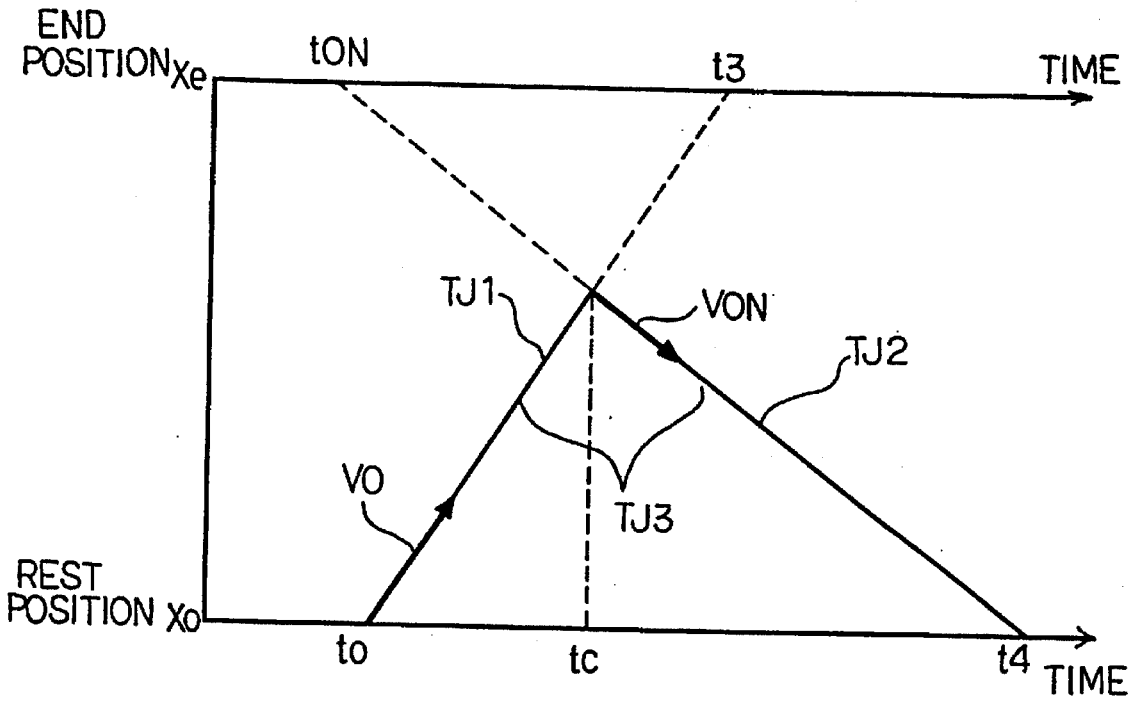
FIG. 10 is diagram showing a composite trajectory of a half stroke key of the automatic player piano.

If a player depresses or releases a key 10*b* at an intermediate point between the rest position and the end position, the half strike key traces a composite trajectory shown in FIG. 10. The key 10*b* starts the rest position Xo at time t0, and reaches the intermediate point at time tc. Then, the key changes the moving direction, and returns to the rest position Xo at time t4. If the player continuously depresses the key 10*b* over the intermediate point, the key 10*b* would reach the end position Xe at time t3. On the other hand, if the player releases the key at time t0N, the key would pass the intermediate point at time tc and reach the end position Xe at time t4.

The time tc is calculated as follows.

$$\begin{aligned} tc &= (V0\times t3-V0N\times t0N)/(V0-V0N) \\ &= t0N+V0\times(t3-t0N)/(V0-V0N) \end{aligned} \quad \text{Equation 9}$$

Equation 10 gives t3 as follows.

$$t3=t0+(Xe-X0)/V0 \quad \text{Equation 10}$$

The first trajectory TJ1 for the depressed key 10*b* is combined with the second trajectory TJ2 for the released key 10*b* at time tc, and the half stroke key traces the composite trajectory TJ3. If one of the music data codes is indicative of the half stroke key, the pretreatment unit 21*r* generates the preliminary control data indicative of the composite trajectory TJ3, and the preliminary control data is supplied to the motion controller 21*s*.

In case of a key 10*b* depressed at an intermediate point from the end position Xe to the rest position Xo, a composite trajectory is similarly generated for the half stroke key.

The motion controller 21*s* generates control data indicative of target positions for the keys 10*b*, and each of the target positions X is varied with time in accordance with the trajectory represented by the preliminary control data.

The control data are supplied to the servo controller 21*t*. The servo controller 21*t* form a plurality of feedback loops together with the solenoid-operated actuator units 21*a* and the built-in position sensors 21*f*. The serve controller 21*t* respectively supplies driving signals DR2 to the solenoid-operated actuator units 21*a*, and the amount of each driving signal DR2 is proportional to the target position X indicated by the control data. Each of the solenoid-operated actuator units 21*a* projects the plunger 21*e* so as to reach the target position X, and the associated built-in position sensor 21*f* produces the feedback signal FB2 indicative of an actual position of the plunger 21*e*. The servo controller 21*t* compares each actual position with the target position X, and changes the driving signal DR2 in such a manner as to match the actual position with the target position X.

Description is hereinbelow made on the recording mode and the playback mode of the automatic player piano shown in FIG. 7.

Assuming now that a player wants to record an original performance in the memory sub-system such as a floppy disk, the player is fingering on the keyboard 10*a*, and the keys 10*b* are selectively depressed and released. The depressed keys 10*b* actuate the associated key action mechanisms 10*e* and the damper assemblies 10*h*. The damper assemblies 10*h* leave the associated sets of strings 10*g*, and the key action mechanisms 10*e* drive the hammer assemblies 10*f* for rotation toward the associated sets of strings 10*g*. The hammer sensors 21*c* monitor the hammer assemblies 10*f*, and report the actual hammer positions to the recording unit 21*p*. The recording unit 21*p* determines the depressed keys 10*b*, the hammer velocities vH and the impact times ti.

On the other hand, when the player releases the keys 10*b*, the key sensors 21*b* monitor the released keys 10*b*, and report the actual key positions to the recording unit 21*p*. The recording unit 21*p* determines the released key velocities vkN and the return times tkN, and the post-treatment unit 21*q* normalizes the second piece of data information indicative of the hammer velocity vH, the third piece of data information indicative of the impact time ti, the fourth piece of data information indicative of the released key velocity vkN and the fifth piece of data information indicative of the return time tkN. The post-treatment unit 21*q* codes the depressed/released key, the hammer velocity vH, the impact time ti, the released key velocity vkN and the return time tkN into the music code for each of the depressed/released keys 10*b*, and stores the music data codes into the memory sub-system 21*m*.

After the performance, the player is assumed to reproduce the music. The pretreatment unit 21*r* sequentially fetches the music data codes stored in the memory sub-system 21*m*. The pretreatment unit 21*r* generates the preliminary control data indicative of the first trajectory and the second trajectory for each depressed/released key, and the motion controller 21*s* varies the control data indicative of the target positions X of the depressed/released keys 10*b*.

If one of the keys 10*b* is expected to be depressed at time t0, the pretreatment unit 21*r* supplies the first trajectory expressed by Equation 3 to the motion controller 21*s*, and the motion controller 21*s* sequentially changes the control data indicative of the position X on the first trajectory. The servo controller 21*t* is responsive to the control data for changing the driving signals DR2, and regulates the driving signals DR2 by using the feedback signals FB2. As a result, the solenoid-operated actuator units 21*a* project the respective plungers 21*e*, and cause the associated keys 10*b* to pass the reference points Xr at the reference velocity Vr at time tr.

The pretreatment unit 21*r* supplies the preliminary control data indicative of the second trajectory at time t0N for one of the released keys 10*b* to the motion controller 21*s*. The motion controller 21*s* changes the control data indicative of XN on the second trajectory expressed by Equation 6, and the servo controller 21*t* controls the solenoid-operated actuator units 21*a* so that each of the released keys 10*b* passes the released reference point XrN at the released reference velocity VrN at the return time tkN. Then, the damper assemblies 10*h* come into contact with the associated sets of strings 10*g* at expected velocities, and the tones are decayed as similar to the original tones.

If one of the music data codes is indicative of the half stroke key, the pretreatment unit 21*r* combines the first trajectory with the second trajectory at time tc, and the motion controller 21*s* and the servo controller 21*t* control the half strike key along the composite trajectory.

As will be appreciated from the foregoing description, the automatic player piano according to the present invention causes each key to pass the reference point Xr or XrN at the reference velocity Vr or VrN at time tr or tkN. As a result, the hammer strikes the associated set of strings at the same intensity as that of the original performance, and the damper assembly comes into contact with the set of strings at the same velocity. This results in that the original tone and the decay thereof are faithfully reproduced in the playback.

Third Embodiment

Figure 11:
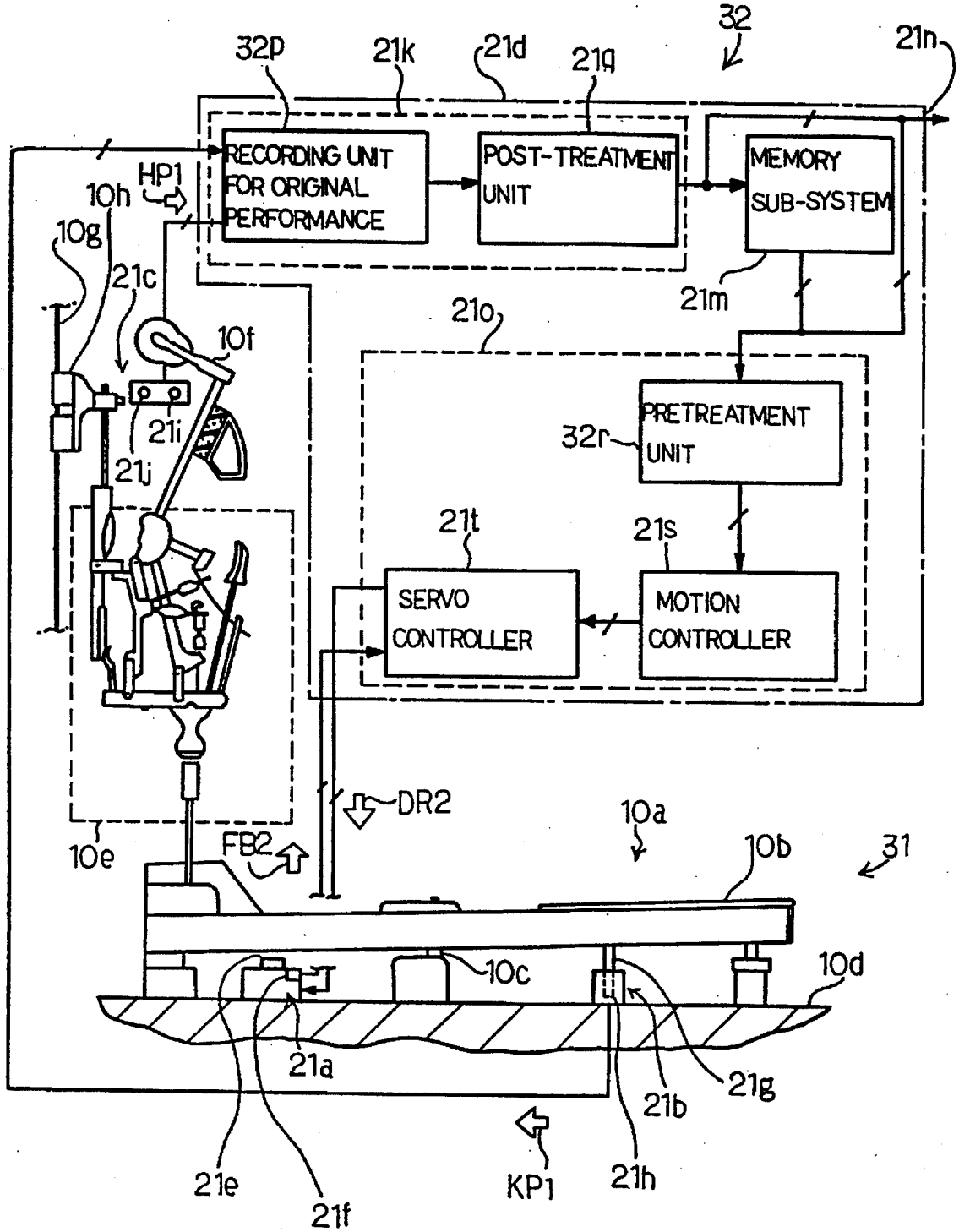
FIG. 11 is a schematic view showing the structure of yet another automatic player piano according to the present invention.

Turning to FIG. 11 of the drawings, an automatic player piano embodying the present invention is largely comprises an acoustic piano 31 and an automatic playing system 32. The acoustic piano is similar to that of the first embodiment, and components of the acoustic piano 31 are labeled with the same references as those designating the corresponding components of the acoustic piano 10.

The automatic playing system is similar to the automatic playing system 22 except for a recording unit 32*p* and a pretreatment unit 32*r*, and other components are also labeled with the same references as those of the automatic playing system 22 without detailed description.

The recording unit 32*p* determines a key-on velocity Vk as well as the released key velocity vkN and the return time tkN. In detail, while a player is depressing a key 10*b*, the shutter plate 21*g* interrupts the optical radiation of the upper photo-coupler and, thereafter, the optical radiation of the lower photo-coupler. The key position signal KP1 reports the early interruption and the later interruption to the recording unit 32*p*, and the recording unit 32*p* calculates the key-on velocity Vk by dividing the distance between the lower and upper photo-couplers by a time interval between the early and later interruptions. When the hammer assembly 10*h* interrupts the optical radiation of the lower photo-coupler, the recording unit 32*p* determines the time to be a key-on time tk2. The key-on velocity Vk serves as a sixth piece of data information, and the key-on time tk2 forms a seventh piece of data information. The sixth piece of data information and the seventh piece of data information are coded in the music data code together with the first to fifth pieces of data information.

The pretreatment unit 32*r* determines a first trajectory for a depressed key 10*b* and a second trajectory for a released key 10*b* on the assumption that the first trajectory and the second trajectory are a parabola and a straight line. The first trajectory is determined as follows.

First, a target position X on the first trajectory is expressed as follows.

$$X=a/2\times t^2+b\times t+c \qquad \text{Equation 11}$$

where a is an acceleration and is given by Equation 12.

$$a=(Vr-Vk)/(tr-(tk1+tk2)/2) \qquad \text{Equation 12}$$

Figure 12:
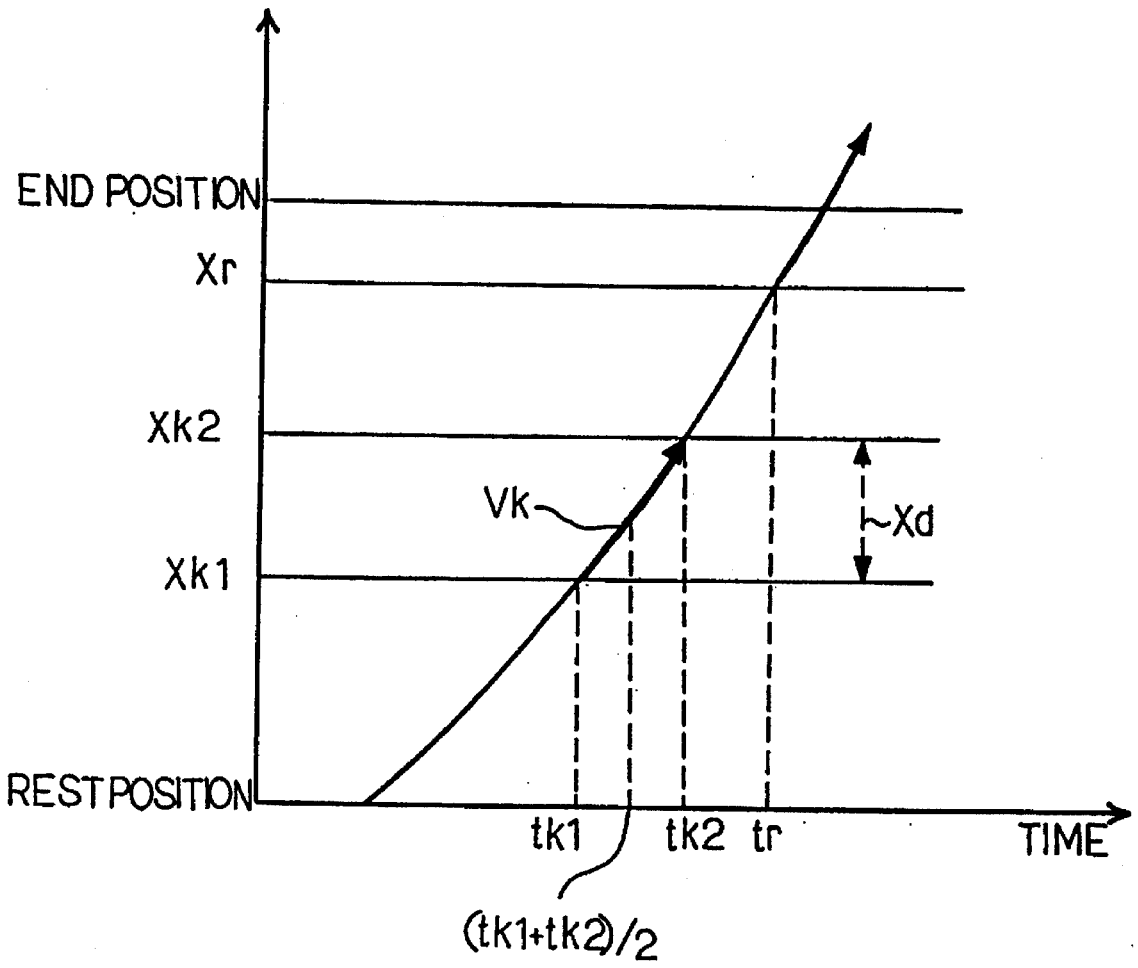
FIG. 12 is a diagram showing a trajectory of a depressed key of the automatic player piano shown in FIG. 11.
Figure 13:
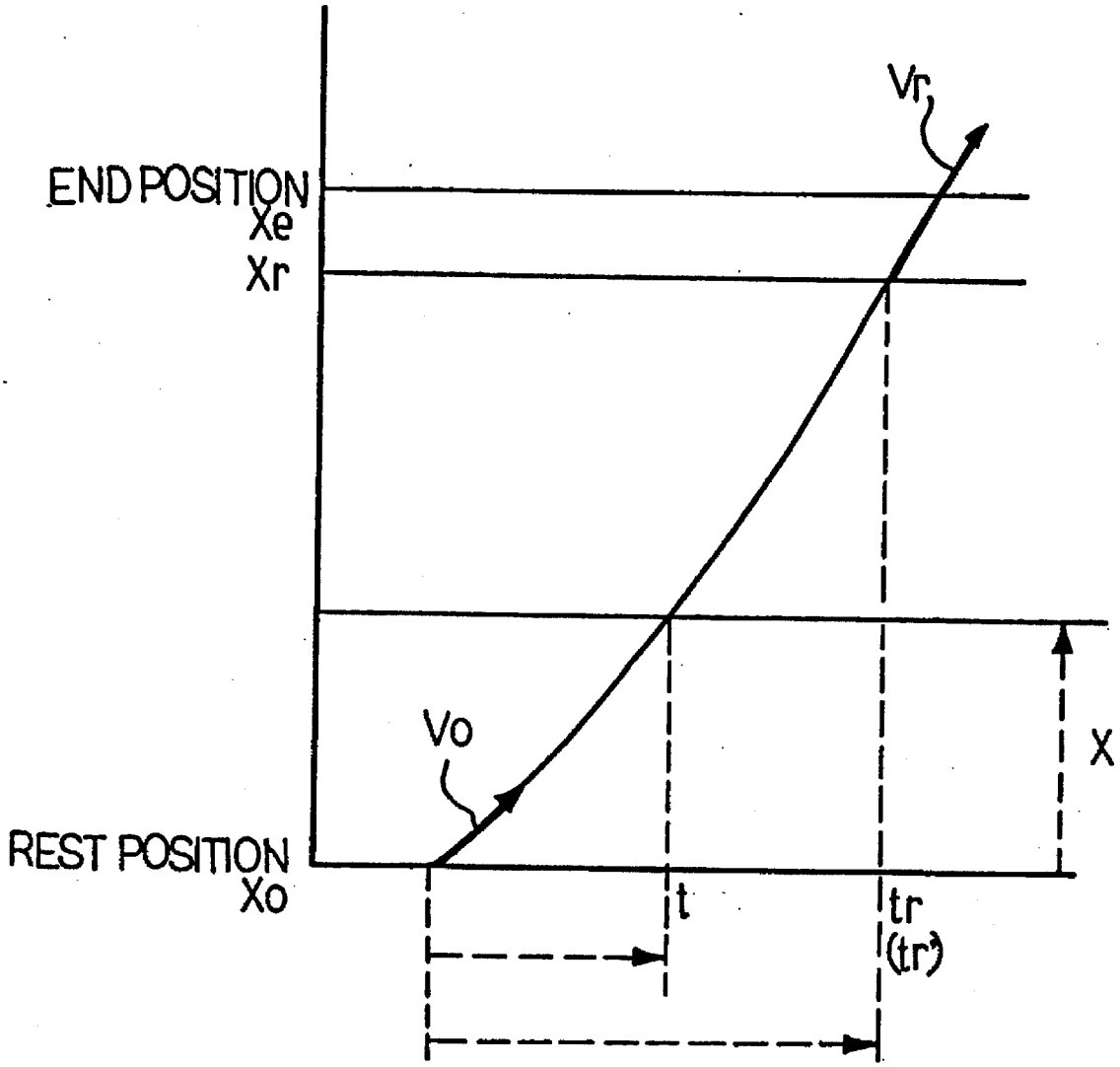
FIG. 13 is a diagram showing a trajectory of a depressed key the automatic player piano.

The reference velocity Vr is given by Equation 1, and is calculated on the basis of the hammer velocity vH. The time tk1 is indicative of a timing when the shutter plate 21*g* interrupts the optical radiation of the upper photo-coupler, and calculated on the basis of the key-on velocity Vk and the key-on time tk2 as follows.

$$tk1=tk2-Xd/Vk \quad \text{Equation 13}$$

where Xd is a distance between the upper photo-coupler and the lower photo-coupler of each key sensor 21*b*. The first trajectory is illustrated in FIG. 12, and Xk1 and Xk2 are indicative of the position of the upper photo-coupler and the position of the lower photo-coupler. The key-on velocity Vk is an average velocity in the interval between the upper photo-coupler and the lower photo-coupler, and is equal to the key velocity at an intermediate point (tk1+tk2)/2 on the parabolic trajectory. The acceleration a is given as a quotient of the division between the velocity difference (Vr−Vk) and the time difference (tr−(tk1−tk2)/2). However, the acceleration a may be calculated from a velocity difference between two arbitrary points under the conditions of a uniformly accelerated motion.

Thus, the pretreatment unit 32*r* determines the reference time tr and the reference velocity Vr on the basis of the second and third pieces of data information, i.e., the hammer velocity vH and the impact time ti, and the acceleration a on the basis of the key-on velocity Vk and the key-on time tk2. For this reason, if a starting time t0 for a depressed key and an initial velocity V0 at the starting time are given, the first trajectory shown in FIG. 12 is determined. The constants b and c of Equation 11 are given by Equations 14 and 15.

$$b=V0-a\times t0 \quad \text{Equation 14}$$

$$c=Xo-(a/2)\times t0^2+b\times t0 \quad \text{Equation 15}$$

where Xo is the rest position. If the starting time t0 is zero, Equation 11 is changed by using Equations 14 and 15 as follows.

$$Xr=(a/2)tr'^2+V0\times tr'+Xo \quad \text{Equation 16}$$

where tr' is the reference point on the assumption that the starting time t0 is zero. The reference velocity Vr is expressed as Equation 17.

$$Vr=a\times tr'+V0 \quad \text{Equation 17}$$

From Equations 16 and 17, we obtain Equation 18.

$$0=(a/2)\times tr'^2-Vr\times tr'-(Xo-Xr) \quad \text{Equation 18}$$

When Equation 18 is solved for tr', tr' is expressed as $$tr'=(Vr-(Vr^2+2a(Xo-Xr)^{1/2}/a \quad \text{Equation 19}$$

Thus, if the acceleration a, the reference velocity Vr, the reference point Xr and rest position Xo are known, we can determine the time tr' consumed in the motion from the starting time t0 to the reference point Xr. The relation between tr' and tr is given by Equation 20.

$$tr'=tr-t0 \quad \text{Equation 20}$$

The initial velocity V0 is calculated by using Equations 16 and 17.

$$V0=(Vr^2+2a(Xo-Xr))^{1/2} \quad \text{Equation 21}$$

The constant b is given by Equation 14 on the basis of the initial velocity V0, and Equation 15 gives the constant c. Then, the constants b and c and the acceleration a allows Equation 11 to determine the target position X on the parabolic trajectory for a depressed key.

An actual fingering on the keyboard 10*a* moves the keys 10*b* along actual trajectories well approximated to parabolic lines. For this reason, the pretreatment unit 32*r* generates parabolic trajectories for depressed keys, and the playback sub-system 21*o* causes the acoustic piano 31 to reproduce delicate musical expression by using the parabolic trajectories.

Finally, if the playback sub-system 21*o* starts the plunger 21*e* of the solenoid-operated actuator unit 21*a* with the initial velocity V0 at time t0 and increments the key velocity, the plunger 21*e* and the key 10*b* trace a parabolic trajectory, and achieves the same advantages as the key position control described hereinbefore.

The pretreatment unit 32*r* further determines the second trajectory for each released key 10*b*. However, the calculation is similar to that of the second embodiment, and description is omitted for the sake of simplicity.

When one of the music data codes is indicative of a half stroke key, the pretreatment unit 32*r* calculates a turning point or a time tc as follows.

$$tc=(-db+(db^2-2\times da\times dc)^{1/2})/da \quad \text{Equation 22}$$

where da, db and dc are given by Equations 23, 24 and 25, respectively.

$$da=a-aN \quad \text{Equation 23}$$

where aN is an acceleration of the released key.

$$db=Vr-VrN-(a\times tr-aN\times trN) \quad \text{Equation 24}$$

The acceleration aN is zero, and Equation 24 is rewritten as $$db = Vr-VrN-a\times tr \quad \text{Equation 24'}$$

$$\begin{aligned} dc &= Xr-XrN+(a\times tr^2-aN\times trN^2)/2-(Vr\times tr-VrN\times trN) \\ &= Xr-XrN+(a\times tr^2)/2-(Vr\times tr-VrN\times trN) \end{aligned} \quad \text{Equation 25}$$

Using da, db and dc, Equation 22 gives the time tc, and the pretreatment unit 32*r* combines the first parabolic trajectory with the second linear trajectory at time tc. The composite trajectory thus combined represents the half stroke key, and the motion controller 21*s* ad the servo controller 21*t* controls the plunger 21*e* and the key 10*b* along the composite trajectory.

The automatic player piano thus arranged behaves as follows. In the recording mode, a player is performing a music on the keyboard 10*a*, and the key sensors 21*b* and the hammer sensors 21*c* produce the key position signals KP1 and the hammer position signals HP1. The recording unit 32*p* periodically scans input nodes respectively assigned to the key position signals KP1 and the hammer position signals HP1. The recording unit 32*p* determines the hammer velocity vH, the impact time ti for each of the depressed keys 10*b* and the key-on velocity Vk, the key-on time tk2, the released key velocity vkN and the return time tkN for each released key 10*b*.

The post-treatment unit 21*q* normalizes the hammer velocity vH, the impact time ti, the key-on time tk2, the released key velocity vkN and the return time tkN, and stores in each music data code for one of the depressed/released key 10*b*. The music data codes are transferred to the memory sub-system 21*m*, and are stored therein.

After the original performance, if the player reproduces the music, the pretreatment unit 32r sequentially reads out the music data codes, and determines a parabolic trajectory for each depressed key 10b and a linear trajectory for the released key 10b.

Namely, the pretreatment unit 32r calculates a parabolic trajectory on the basis of the hammer velocity vH, the impact time ti, the key-on velocity Vk and the key-on time tk2, and supplies the preliminary control data indicative of the parabolic trajectory to the motion controller 21s at the starting time t0. The motion controller 21s varies the control data indicative of the target position X with time, and the servo controller 21t changes the driving signal DR2 or the amount of driving current depending upon the target position X. The solenoid-operated actuator unit 21a projects the plunger 21e depending upon the amount of the driving current, and the built-in position sensor 21f feedbacks the actual position of the plunger 21e. The servo controller 21t modifies the driving signal DR2 so as to match the target position X with the actual position. As a result, the key 10b specified by the first piece of data information is moved along the parabolic trajectory, and passes the reference point Xr at the acceleration a at the reference time tr. The depressed key 10b actuates the key action mechanism 10e, and the key action mechanism 10e drives the hammer assembly 10f for rotation. The hammer assembly 10f strikes the set of strings 10g at the hammer velocity vH, and the intensity of the impact is approximately equal to that of the original impact. The parabolic trajectory is analogous to the original trajectory in the recording, and the impact is well controlled by the playback sub-system 21o.

The pretreatment unit 32r further calculates the linear trajectory on the basis of the released key velocity vkN and the return time tkN, and supplies the preliminary control data indicative of the linear trajectory to the motion controller 21s at the starting time for the released key 10b. The motion controller changes the target position X in accordance with the given linear trajectory, and the released key 10b allows the damper assembly 10h to come into contact with the set of strings at the return time tkN. The return timing and the returning velocity of the damper assembly 10h are approximately equal to those of the damper assembly 10h in the recording, and the reproduced tone is decayed as similar to the originally produced tone.

If one of the music data codes is indicative of the half stroke key, the pretreatment unit 32r calculates the parabolic trajectory and the linear trajectory, and determines the time tc. The parabolic trajectory is merged with the linear trajectory at time tc, and the motion controller 21s and the servo controller 21t control the solenoid-operated actuator 21a so as to trace the composite trajectory.

Figures 14A, 14B, 14C:
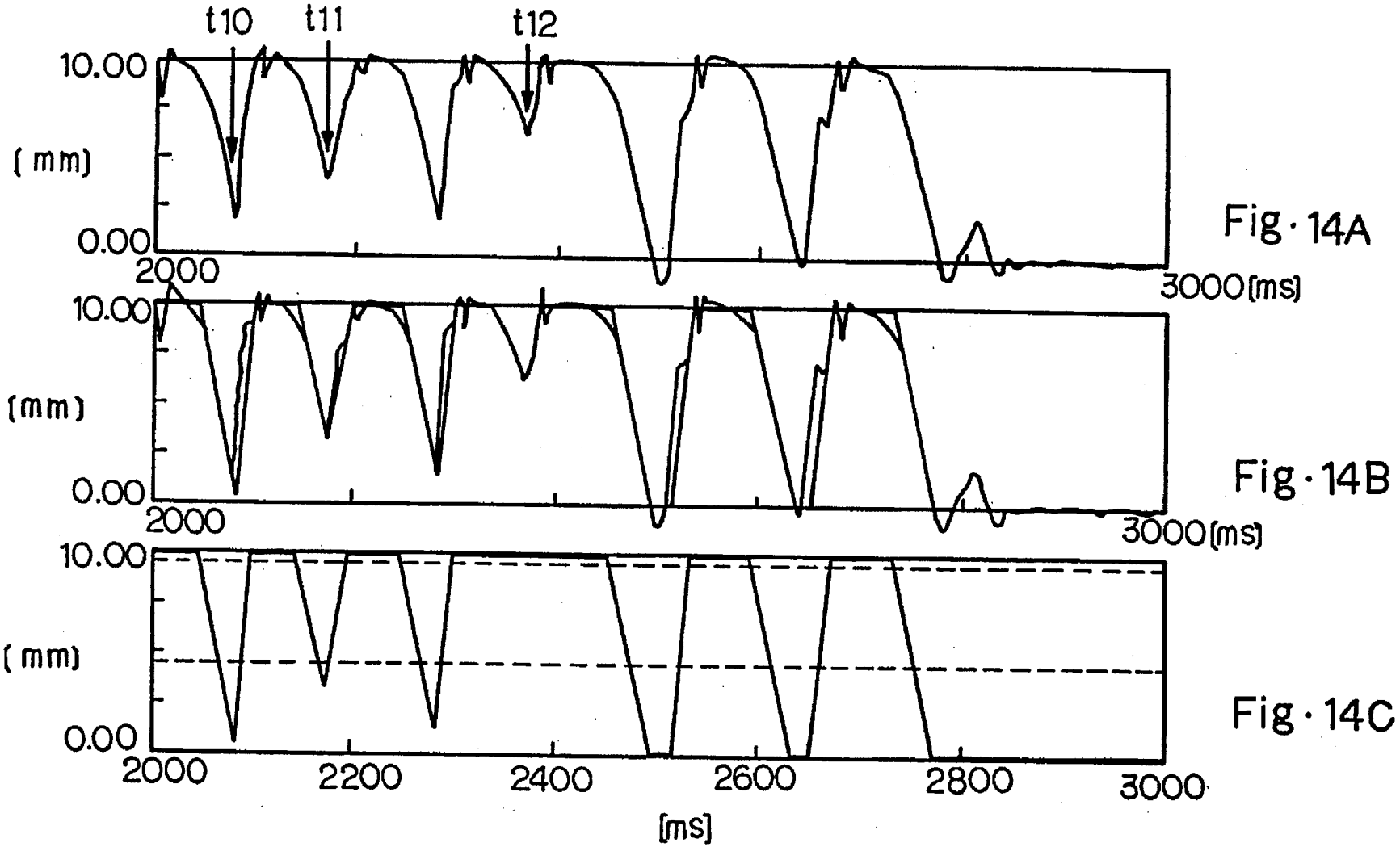
FIGS. 14A to 14C are diagrams showing a trajectory of an actual key motion and a trajectory of a reproduced key motion.
Figures 15A, 15B, 15C:
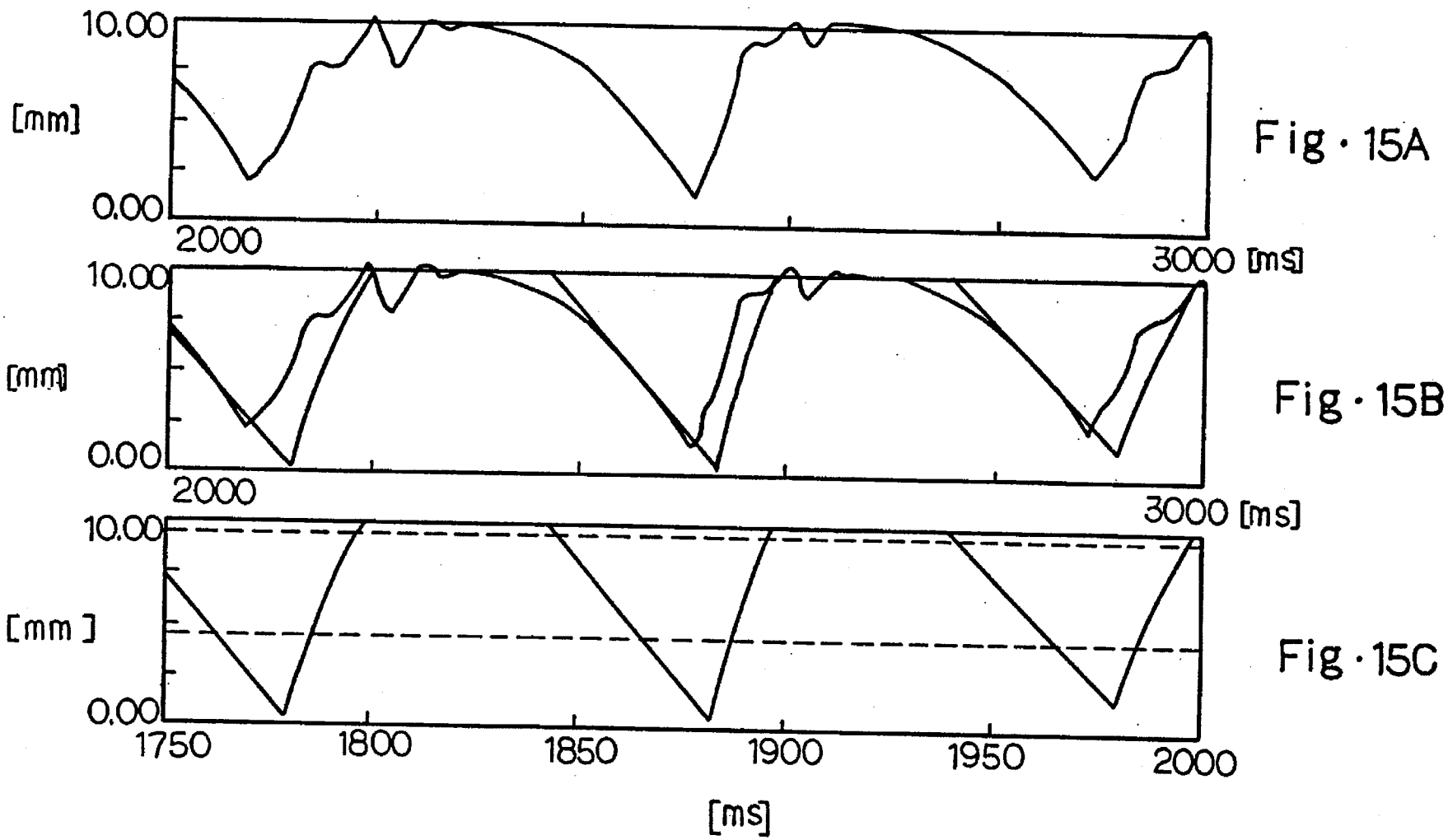
FIGS. 15A to 15C are diagrams showing parts of the trajectories shown in FIGS. 14A to 14C.

The present inventors evaluated the automatic player piano according to the present invention, and plotted trajectories in FIGS. 14A to 14C. FIG. 14A shows the original motions of a key 10b, and t10 and t11 indicate the half stroke keys. Time t12 indicates a key motion which did not strike the strings. FIG. 14C shows the reproduced key motion, and the original key motion is overlapped with the reproduced key motion in FIG. 14B. The half stroke keys at time t10 and t11 were exactly reproduced, and the key maintained the depressed state in the reproduced key motions at time t12. Parts of the key motions shown in FIGS. 14A to 14C are scaled up as shown in FIG. 15A to 15C. Although the reproduced key motion is smooth rather than the original key motion, the original key motion is affected by unintentionally noise due to, for example, the key action mechanism 10e, and the present inventors think that the ideal key motion without the noise is closer to the reproduced key motion.

From FIGS. 14B and 15B, the original key motion is approximated to the reproduced key motion, and the automatic player piano according to the present invention is advantageous over the prior art automatic player piano.

The automatic player piano implementing the third embodiment is modified as follows.

The first modification controls a separating timing of each of the damper assemblies 10h. After the separation of the damper assemblies 10h, the sets of strings are allowed to vibrate, and are resonant with other strings 10g already struck by the associated hammer assemblies 10f. The resonant tones are not ignoreable, and, for this reason, the first modification controls the separating timings of the damper assemblies 10h as follows.

Figure 16:
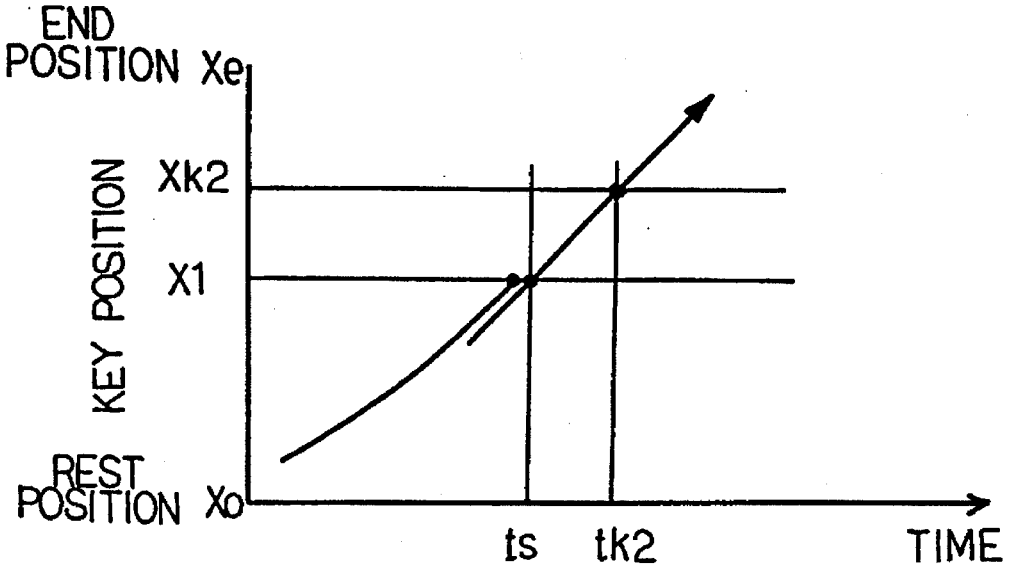
FIG. 16 is a diagram showing the trajectory of a damper assembly.

The shutter plate 21g is assumed to interrupt the optical radiation of the lower photo-coupler at a key-on position Xk2, and the damper assembly 10h is assumed to leave the set of strings 10g at a separating position X1. A straight line is drawn in parallel to the key-on velocity Vk, and a separating time ts is determined at a crossing point between the straight line and a horizontal line at the separating position X1 as shown in FIG. 16. The separating time ts is given by Equation 26.

$$ts=tk2-(Xk2-X1)/Vk \qquad \text{Equation 26}$$

Figure 17:
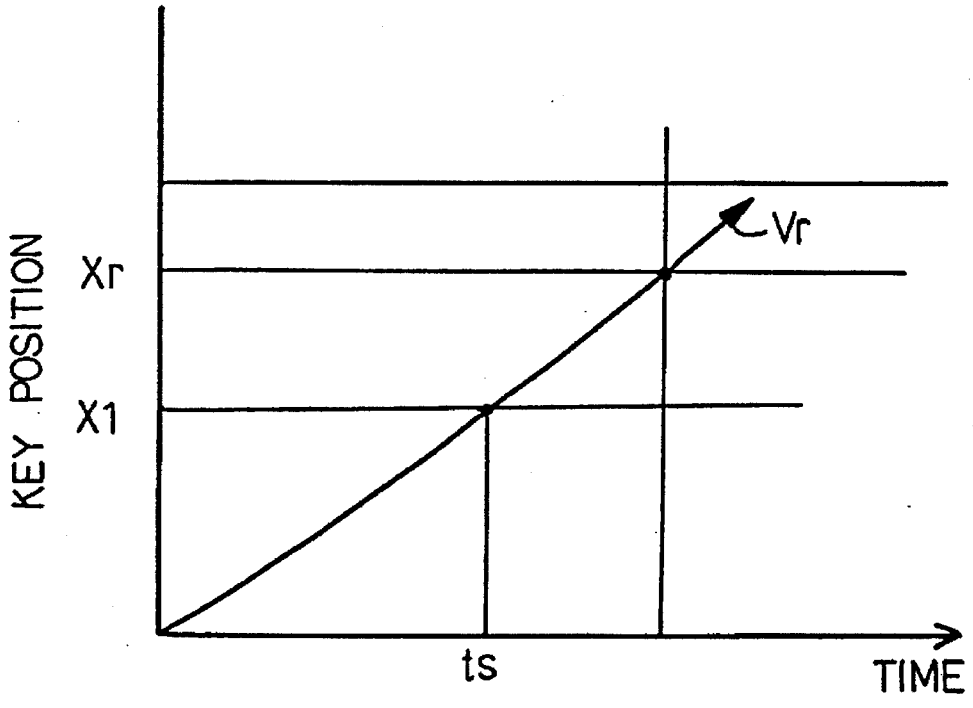
FIG. 17 is a diagram showing a parabolic trajectory taking a separating time of the damper assembly into account.

If the separating time ts is determined, the reference velocity Vr and the reference time tr are calculated as similar to the above described embodiment, and determines a parabolic trajectory shown in FIG. 17. The parabolic trajectory is expressed as $$X=(((X1-Xr)-Vr\times(ts-tr))/(ts-tr)^2)\ t2+Vr\times t \qquad \text{Equation 27}$$

Therefore, the motion controller 21s and the servo controller 21t controls the solenoid-operated actuator unit 21a so that the key 10b traces the parabolic trajectory.

In the second modification, a pretreatment unit 32r assumes the acceleration a to be constant. The constant value is determined through experiments. If the acceleration is fixed, Equation 12 is useless, and the calculation for a parabolic trajectory becomes simple.

Figures 18A, 18B, 18C:
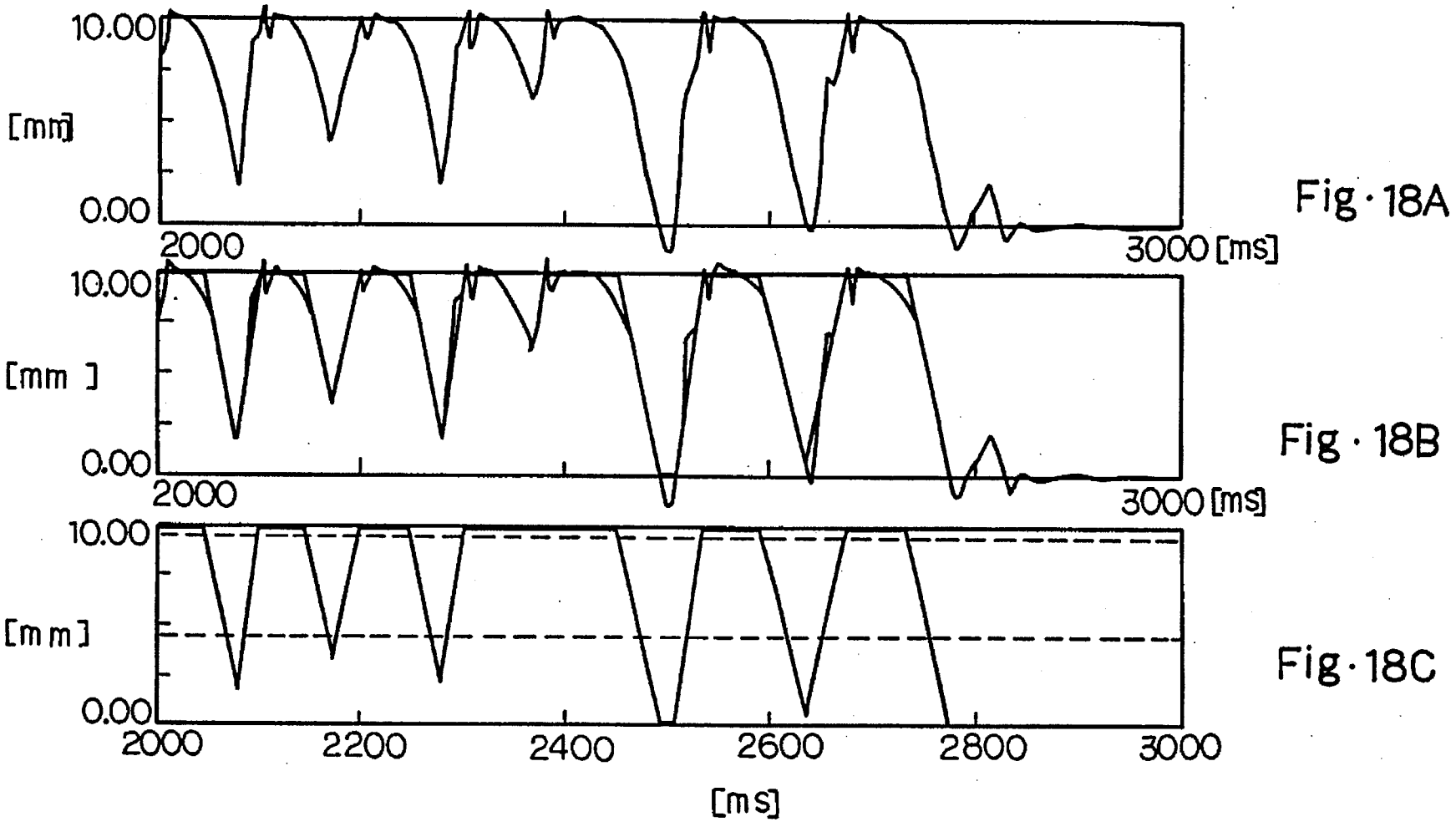
FIGS. 18A to 18C are graphs showing key motions produced on the assumption that an acceleration is fixed.
Figures 19A, 19B, 19C:
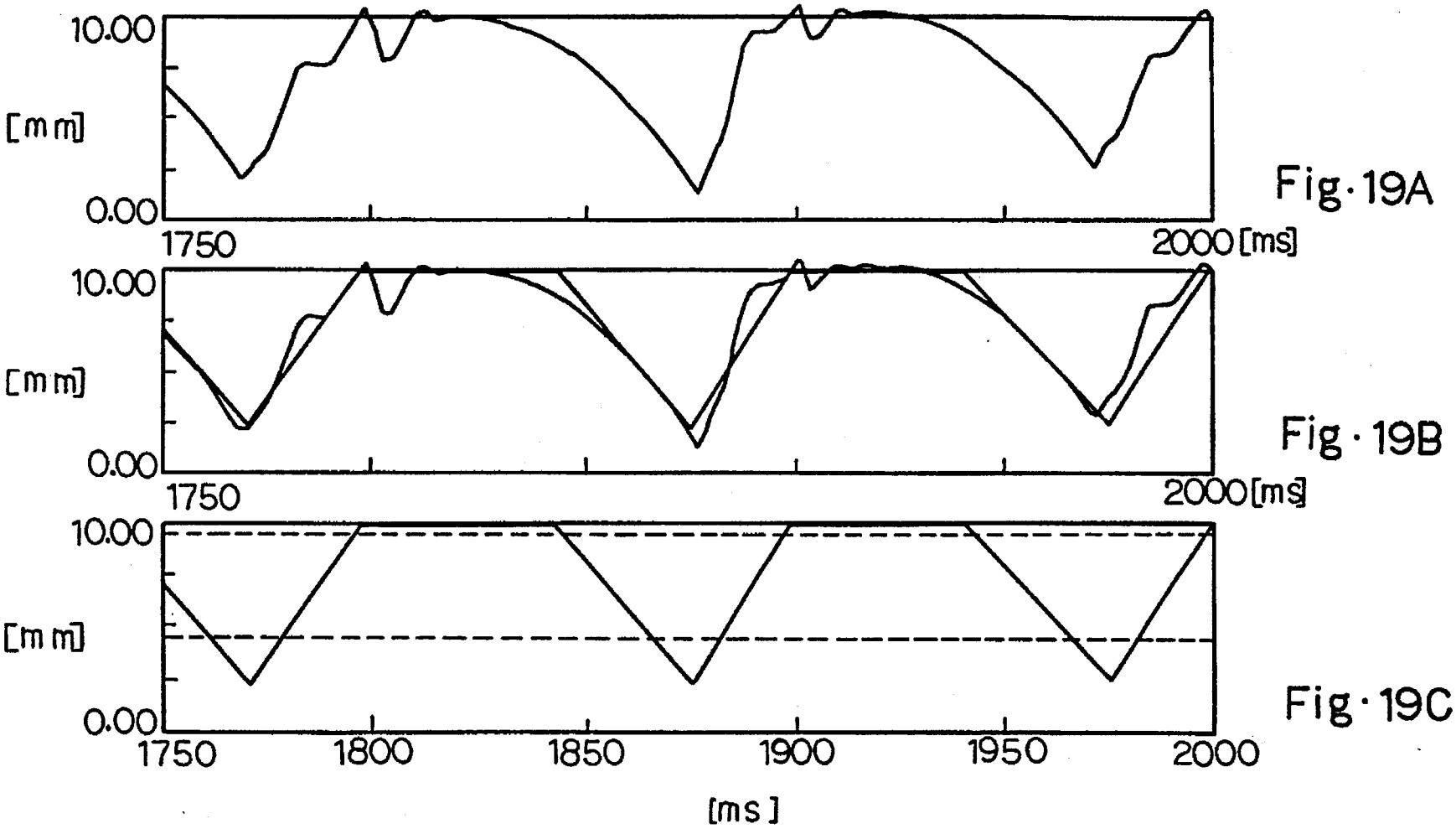
FIGS. 19A to 19C are graphs showing parts of the key motions shown in 18A to 18C in a large scale.

FIGS. 18A to 18C illustrates an original key motion, the original key motion overlapped with a reproduced key motion and the reproduced key motion, and the pretreatment unit 32r controls the key 10b on the assumption that the acceleration is fixed to 2.5 $m/s^2$. Parts of the key motions are scaled up, and are illustrated in FIGS. 19A to 19C. The original key motion is well approximated to the reproduced key motion, and the assumption does not deteriorate the faithfulness of the reproduced music.

In the third modification, the initial velocity is assumed to be a constant value. The assumption allows the pretreatment unit 32r to delete Equation 20, and a parabolic trajectory is directly given by Equation 11.

Figures 20A, 20B, 20C:
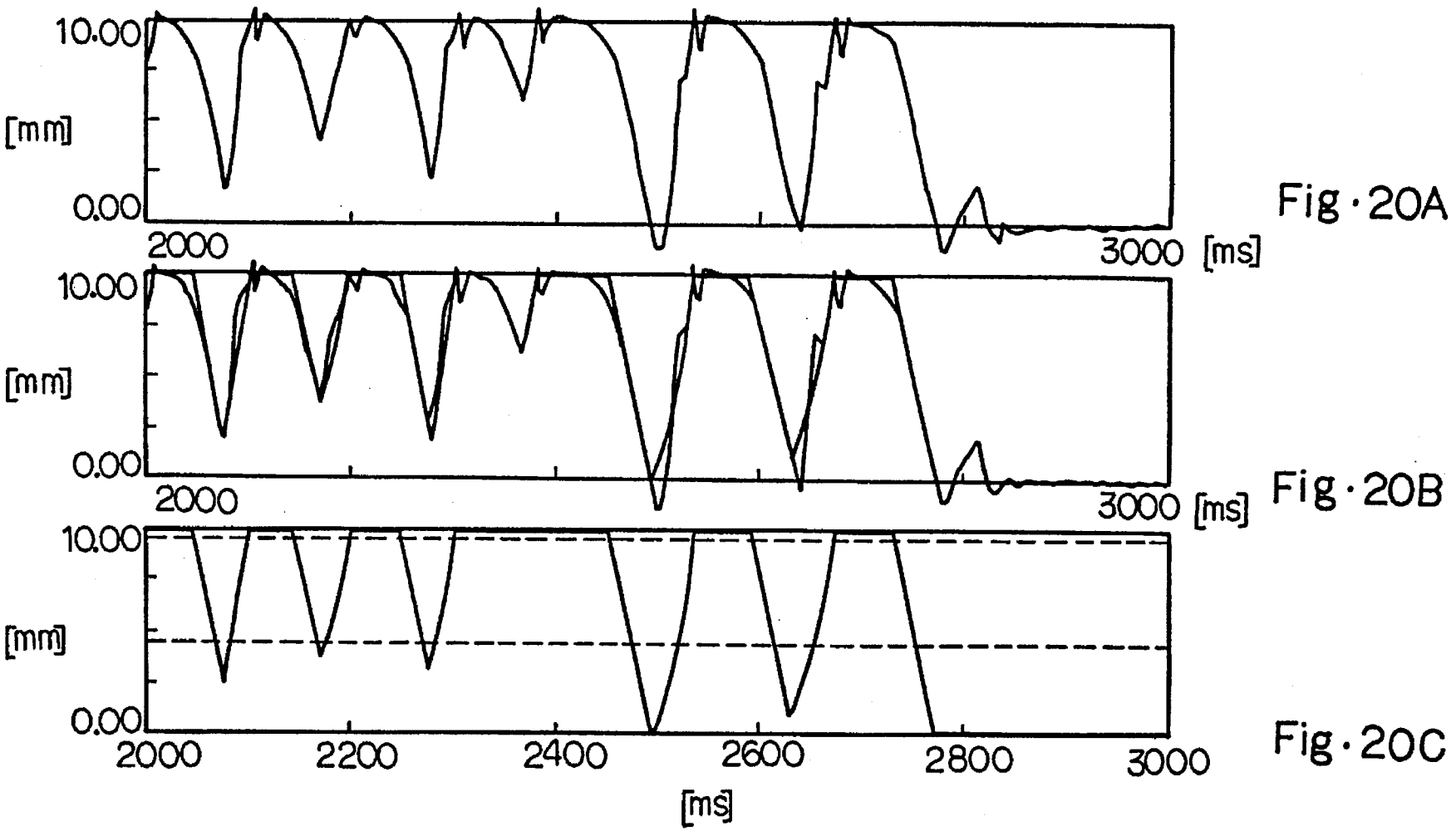
FIGS. 20A to 20C are showing key motions produced on the assumption that an initial velocity is fixed.
Figures 21A, 21B, 21C:
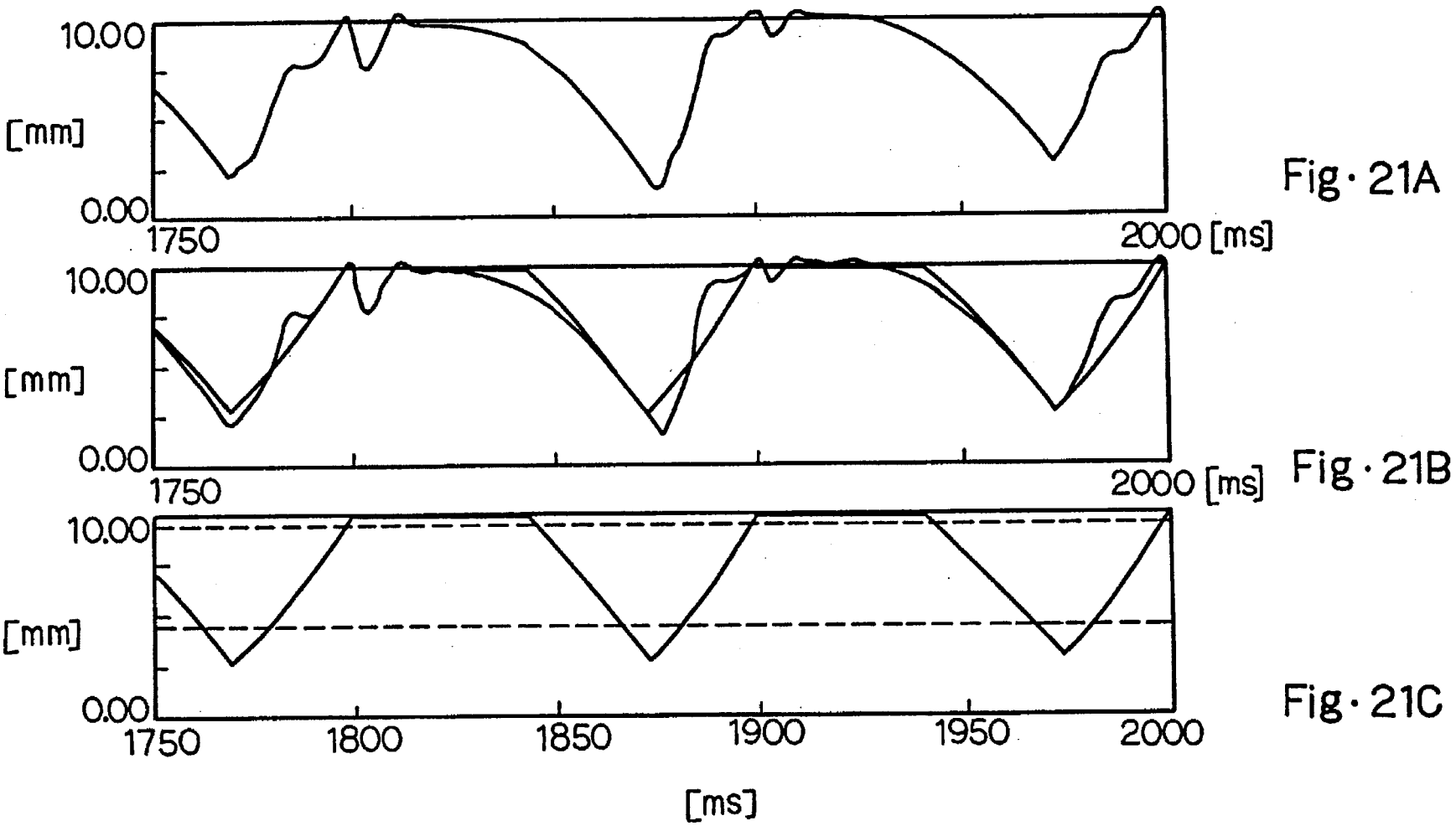
FIGS. 21A to 21C are graphs showing parts of the key motions in a large scale.

When the initial velocity V0 was assumed to 0.1 m/s, a key 10b was moved as shown in FIG. 20A, and the key motion was reproduced as shown in FIG. 20C. The original key motion was overlapped with the reproduced key motion as shown in FIG. 20B. Parts of the key motions are scaled up, and are shown in FIG. 21A to 21C. As will be understood from FIGS. 20B and 21B, the original key motion is well approximated to the reproduced key motion, and the approximation makes the calculation simple.

Although the above described embodiments carry out a position servo control, the second embodiment may carry out a velocity servo control, and the servo controller 21t maintains the initial velocity given by the motion controller 21*s*. Moreover, the third embodiment may carry out an acceleration servo control, and the motion controller 21*s* supplies the initial velocity and an increment of the velocity. The servo controller accumulates the initial velocity and the increments with time, and controls the acceleration of the plunger 21*e*.

The method of estimating the acceleration may be applied to an electronic keyboard musical instrument. Namely, if a key velocity and a hammer velocity are known, the acceleration is estimated for a depressed key, and the estimated acceleration is available for controlling the tone generation in the electronic keyboard musical instrument. An electronic keyboard musical instrument memorizes a plurality of tone waveforms, and the tone waveforms are selected by using the tone intensity and/or a pitch. If the electronic keyboard musical instrument estimates the acceleration, the tone waveforms are selected by using the estimated tone waveform.

The third embodiment estimates the acceleration on the basis of a difference between the key-on velocity Vk and the reference velocity Vt. However, another modification may estimates the acceleration on the basis of the hammer velocity vH and the key-on velocity Vk, two hammer velocities or two key velocities.

The estimation may be carried out in the recording mode or in an idling period between the recording and the playback.

The physical quantity is not limited to the velocity or the acceleration. If a physical quantity allows us to determine a key motion, the physical quantity is available. A force or a combination of the force, the key velocity and/or the acceleration are one of the available physical quantities.

Although the above described embodiments assume the second trajectory to be a uniform motion tracing a linear trajectory, another modification may assumes the second trajectory to be a uniformly accelerated motion. In order to determines a parabolic second trajectory, each of the key sensors 21*b* requires more than two photo-couplers.

Equation 18, 19 and 20 contain extractions of square root. If the extraction of square root is a problem for a data processor, a binary search may be available.

In actual recording, when a player softly depresses a key, the key tends to move along a parabolic trajectory, and it is impossible to reproduce a pianissimo (pppp) through a linear trajectory. For this reason, a modification of the second embodiment may estimates the first trajectory for a soft key touch to be a parabola and the other first trajectories to be linear lines.

Japanese Patent Publication of Unexamined Application No. 1-239594 discloses a keyboard musical instrument which estimates a hammer velocity on the basis of a key velocity of a depressed key. If such a velocity data is stored, the above described embodiments may use the velocity data. A piece of key-on or key velocity information of a MIDI (Musical Instruments Digital Interface) code is therefore available, and a time data for generating a sound or an intensity data for the sound are also available for the embodiments.

As will be appreciated from the foregoing description, the automatic player piano according to the present invention controls the key to pass the reference point with the reference physical quantity, and faithfully reproduces a music, because the hammer velocity is related to the physical quantity at the reference point.

Fourth Embodiment

Figure 22:
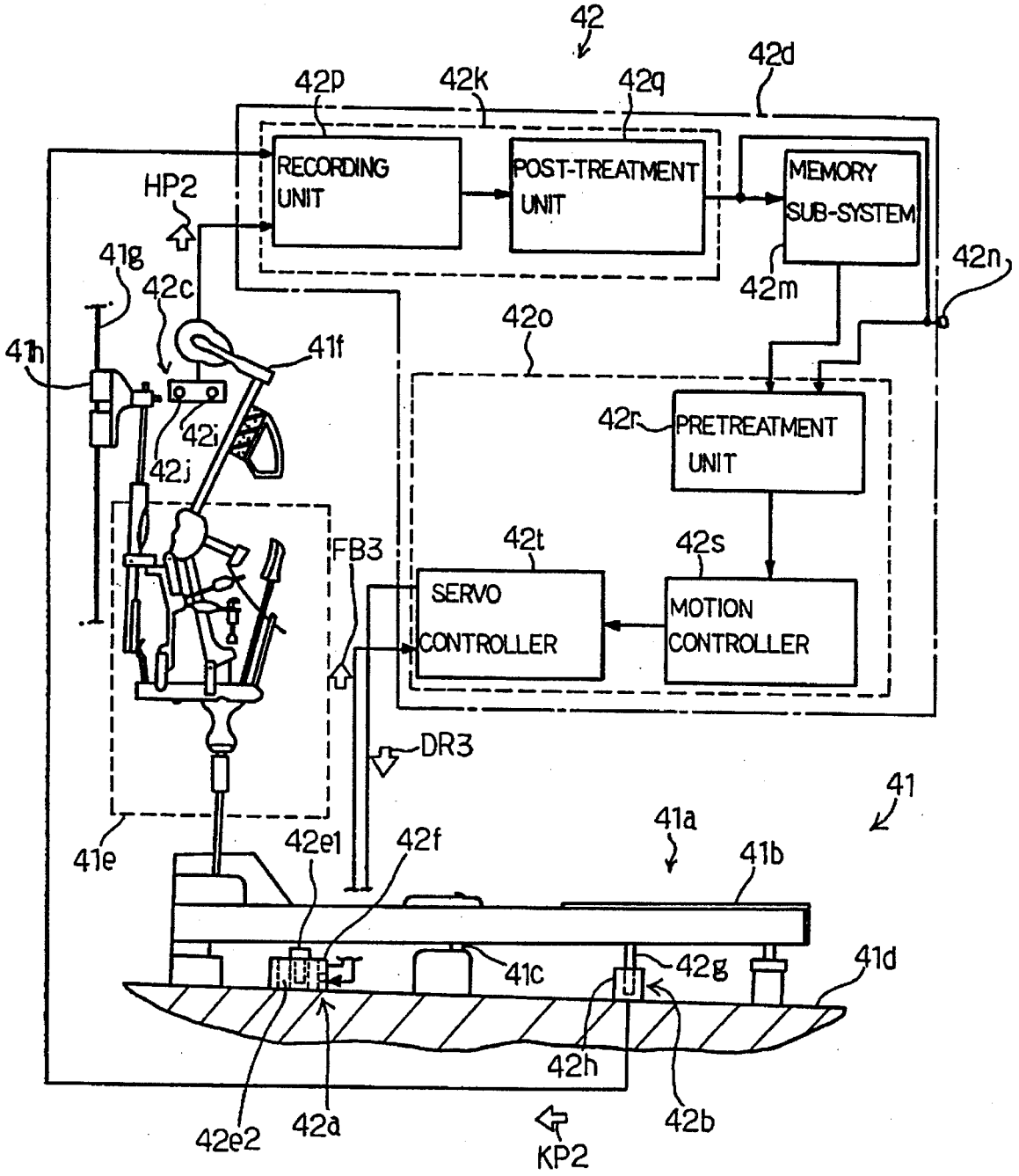
FIG. 22 is a schematic view showing an automatic player piano according to the present invention.

Turning to FIG. 22 of the drawings, an automatic player piano embodying the present invention largely comprises an acoustic piano 41 and an automatic playing system 42. The acoustic piano 41 is an upright piano, and largely comprises a keyboard 41*a* implemented by a plurality of keys 41*b* turnably supported by a balance key pin 41*c* on a key bed 41*d*. FIG. 22 illustrates the keys 41*b* at respective rest position, and each key 41*b* turns from the rest position to an end position around the balance key pin 41*c* when a player depresses.

The acoustic piano 41 further comprises a plurality of key action mechanisms 41*e* functionally connected to the keys 41*b*, respectively, a plurality of hammer assemblies 41*f* respectively driven for rotation by the key action mechanisms 41*e*, a plurality of sets of strings 41*g* respectively struck by the hammer assemblies 41*f* and a plurality of damper assemblies 41*H* actuated by the key action mechanisms 41*e* for leaving the associated sets of strings 41*g*. The acoustic piano 10 is similar to a standard upright piano, and the behaviors of the key action mechanism 41*e*, the hammer assembly 41*f*, the strings 41*g* and the damper assembly 41*H* are well known to a person skilled in the art. For this reason, no further description is incorporated hereinbelow.

The automatic playing system 42 comprises a plurality of solenoid-operated actuator units 41*a* respectively provided under the keys 41*b*, a plurality of key sensors 42*b* also provided under the keys 42*b*, a plurality of hammer sensors 42*c* respectively associated with the hammer assemblies 41*f* and a controller 42*d* connected to the solenoid-operated actuator units 42*a*, the key sensors 42*b* and the hammer sensors 42*c*.

Each of the solenoid-operated actuator units 41*a* has a plunger 42*e*1 upwardly pushing the associated key 41*b*, a solenoid coil 42*e*2 and a built-in position sensor 42*f* for monitoring the plunger 42*e*1, and the solenoid coil 42*e*2 generates electromagnetic force proportional to the amount of driving current flowing therethrough. The plunger 42*e*1 projects a length in proportional to the electromagnetic force, and the projection is controllable by changing the amount of driving current. The built-in position sensor 42*f* monitors the plunger 42*e*1, and generates a feedback signal FB3 indicative of an actual position of the plunger 42*e*1.

Each of the key sensors 42*b* is implemented by a shutter plate 42*g* attached to the lower surface of the associated key 41*b* and a plurality of photo-couplers 42*h*, and a slit pattern is formed in the shutter plate 42*g*. The plurality of photo-couplers 42*h* are provided along the trajectory of the shutter plate 42*g*, and are spaced by a predetermined distance.

When the key 41*b* is depressed, the shutter plate 42*g* is downwardly moved, and sequentially crosses optical paths of the photo-couplers 42*h*. In this instance, each of the key sensors 42*b* is implemented by lower and upper photo-couplers 42*h*. The shutter plate 42*g* sequentially interrupts the optical radiation of the upper photo-coupler and the optical radiation of the lower photo-coupler on the way from the rest position to the end position, and the optical path of the lower photo-coupler and the optical path of the upper photo-coupler are successively established in the upward motion of the shutter plate 42*g*. The shutter plate 42*g* is moved together with the associated key 41*b*, and, for this reason, the actual position of the shutter plate 42*g* is equivalent to the actual position of the key 41*b*. The key sensor 42*b* generates a key position signal KP2 indicative of the actual position of the key 41*b*. The shutter plate 42*g* allows the upper photo-coupler to pass through the slit pattern when the damper assembly 41*H* comes into contact with the set of strings 41*g* again.

Each of the hammer sensors 42*c* is implemented by photo-couplers 42*i* and 42*j*, and the photo-couplers 42*j* are positioned at rebounding points of the associated hammer assemblies 41*f*. For this reason, an impact time ti or the rebound of the hammer assembly 41*f* on the strings 41*g* are detectable by the associated photo-coupler 42*j*. Each of the hammer sensors 42*c* produces a hammer position signal HP2 indicative of an actual position of the associated hammer assembly 41*f*.

The controller 42*d* is broken down into a recording sub-system 42*k* for producing music data codes indicative of an original performance on the key board 41*a*, a memory sub-system 42*m* for storing the music data codes, a data port 42*n* for communicating with the outside thereof and a playback sub-system 42*o* for controlling the solenoid-operated actuator units 42*a*. In this instance, each of the music data codes contains at least a first piece of data information indicative of a depressed/released key 10*b*, a second piece of data information indicative of a hammer velocity vH, a third piece of data information indicative of the impact time ti, a fourth piece of data information indicative of a released key velocity vkN and a fifth piece of data information indicative of a return time tkN. The fourth and fifth pieces of data information will be described hereinlater.

The recording sub-system 42*k* has a recording unit 42*p* for generating the first to fifth pieces of data information and a post-treatment unit 42*q* for normalizing the second to fifth pieces of data information.

The recording unit 42*p* behaves in a recording mode as follows. Assuming now that a player depresses one of the keys 41*b*, the depressed key 41*b* actuates the key action mechanism 41*e*. The actuated key action mechanism 41*e* drives the associated hammer assembly 41*f* for rotation at an escape, and the hammer assembly 41*f* rotates toward the strings 41*g*.

The hammer assembly 41*f* firstly interrupts the photo-radiation of the photo-coupler 42*i*, and, thereafter, interrupts the photo-radiation of the photo-coupler 42*j*. The recording unit 42*p* counts the time interval between the interruption of the photo-coupler 42*i* and the interruption of the photo-coupler 42*j*. The distance between the photo-couplers 42*i* and 42*j* is divided by the time interval, and determines the hammer velocity vH for the depressed key 41*b*. A code assigned to the depressed key 41*b* serves as the first piece of data information, and the hammer velocity vH serves as the second piece of data information.

When the hammer assembly 41*f* rebounds on the strings 41*g*, the hammer assembly 41*f* interrupts the photo-radiation of the photo-coupler 42*j*, and the recording unit 42*p* determines the impact time ti. The impact time serves as the third piece of data information.

If the player releases the key 41*b* at an intermediate point between the rest position and the end position, the key 41*b* backwardly moves from the intermediate point toward the rest position, and the key motion is indicative of a half stroke key. The shutter plate 21*g* sequentially allows the lower photo-coupler and the upper photo-coupler to establish the optical paths again. When the shutter plate 42*g* allows the lower photo-coupler of the key sensor 42*b* to detect the optical radiation, the recording unit 42*p* starts to count a time interval, and determines the time interval upon the photo-detection of the upper photo-coupler of the key sensor 42*b*. The recording unit 42*p* calculates a released key velocity vkN by dividing the predetermined distance between the lower and upper photo-couplers by the time interval. The recording unit 42*p* further determines a return time tkN upon the photo-detection of the upper photo-coupler. The released key velocity vkN and the return time tkN serve as the fourth piece of data information and the fifth piece of data information.

The post-treatment unit 42*q* normalizes the second to fifth pieces of data information supplied from the recording unit 42*p*, and the first to fifth pieces of data information are coded into the music data code. The normalization eliminates noise due to differences between the individual products from the second to fifth pieces of data information. In detail, the hammer velocity vH, the impact time ti, the released key velocity vkN and the return time tkN are affected by the installation of the key and hammer sensors 42*b* and 42*c*, differences in the dimensions and so forth. The post-treatment unit 42*q* stores parameters determined on the basis of these differences, and changes the second to fifth pieces of data information to those of an ideal product.

Thus, while the player is performing a music on the keyboard 41*a*, the recording unit 42*p* and the post-treatment unit 42*q* generate a series of music data codes indicative of the performance, and the half stroke key is also represented by the music data code.

The playback sub-system 41*o* comprises a pretreatment unit 42*r*, a motion controller 42*s* and a servo controller 42*t*, and the servo controller 42*t* is connected to the solenoid coils 42*e*2 and the built-in position sensors 42*f* for forming a plurality of feedback loops.

The pretreatment unit 42*r* generates preliminary control data indicative of a first trajectory of a depressed key, a second trajectory of a released key and a composite trajectory for a half stroke key 41*b* as follows.

The pretreatment unit 42*r* controls a reference velocity Vr at a reference point Xr ranging between 9.0 millimeters and 9.5 millimeters below the rest position, and the reference velocity Vr and a reference time interval Tr are similarly expressed by Equations I and 2.

Figure 23:
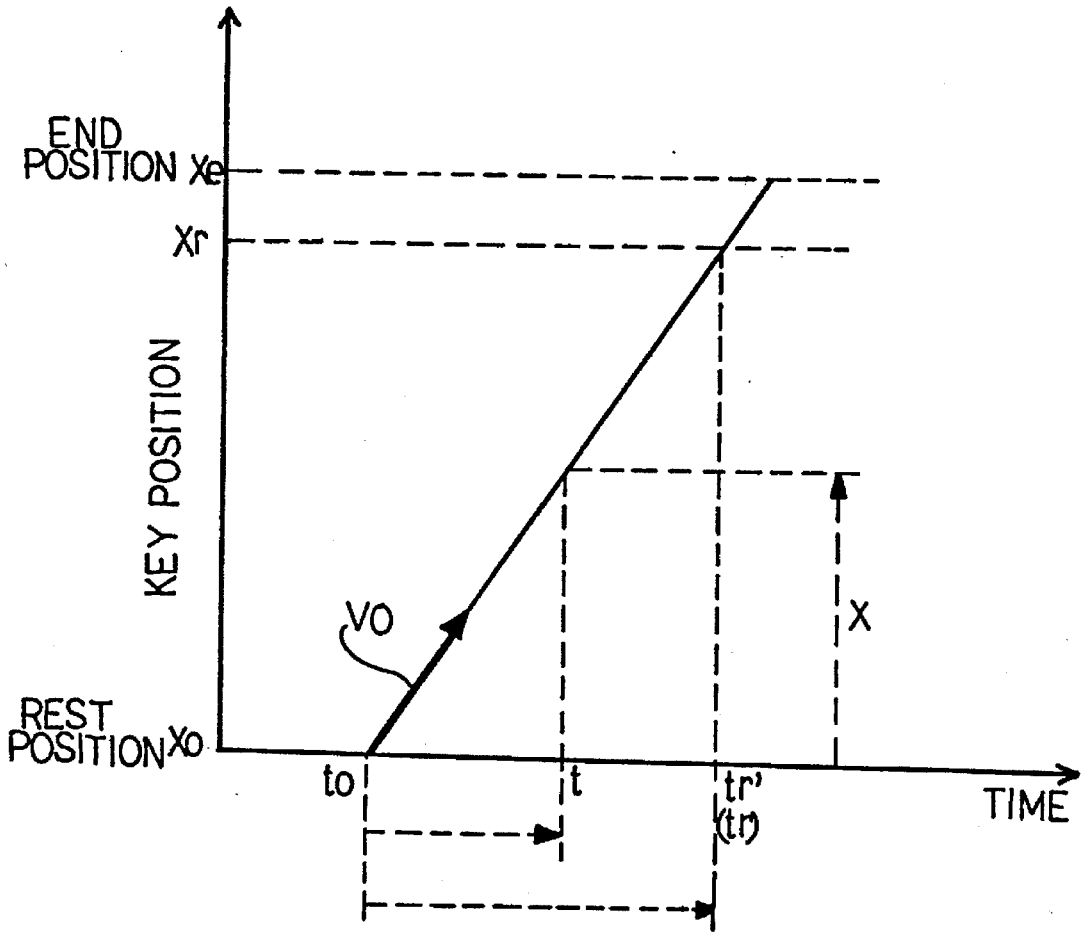
FIG. 23 is a diagram showing a key motion of a depressed key.

In this instance, the key 41*b* is assumed to behave in a uniform motion, and FIG. 23 illustrates the first trajectory of one of the keys 10*b* depressed from the rest position Xo to the end position Xe. If the key 41*b* starts the uniform motion from the rest position Xo at time t0, the key 41*b* is moved toward the end position Xe at a constant speed V0. The key 41*b* is assumed to move over distance X and reach the position X there at time t. The distance X is expressed as Equation 28.

$$X=V0\times t+X0 \qquad \text{Equation 28}$$

The reference point Xr is given as $$Xr=V0\times tr'+X0 \qquad \text{Equation 29}$$

where tr' is the reference time on the assumption that the key 41*b* starts at time zero. Solving Equation 29 for the reference time tr', the reference time tr' is expressed as $$tr'=(Xr-X0)/V0 \qquad \text{Equation 29'}$$

A starting time t0 of the depressed key 41*b* on an absolute time scale is given by Equation 30.

$$t0=tr-tr40=tr-(Xr-X0)/V0 \qquad \text{Equation 30}$$

Therefore, if the solenoid-operated actuator unit 42*a* causes the plunger 42*e*1 to upwardly push the associated key 41*b* at time t0 and controls the distance X in accordance with Equation 28, the key 41*b* reaches the reference point Xr at the reference time tr, and the key velocity at the reference point Xr is equal to the reference velocity Vr.

In this instance, the key 41b is assumed to behave in the uniform motion, and the reference velocity Vr is equal to the constant key velocity V0. The music data code gives the hammer velocity vH to the pretreatment unit 42r, and the reference velocity Vr is calculated by using Equation 1. The pretreatment unit 42r further calculates the reference time tr by subtracting the reference time interval Tr (see Equation 2) from the impact time ti.

The preliminary control data produced by the pretreatment unit 42r are further used for controlling a backward motion from the end position Xe and the rest position Xo as follows.

Figure 24:
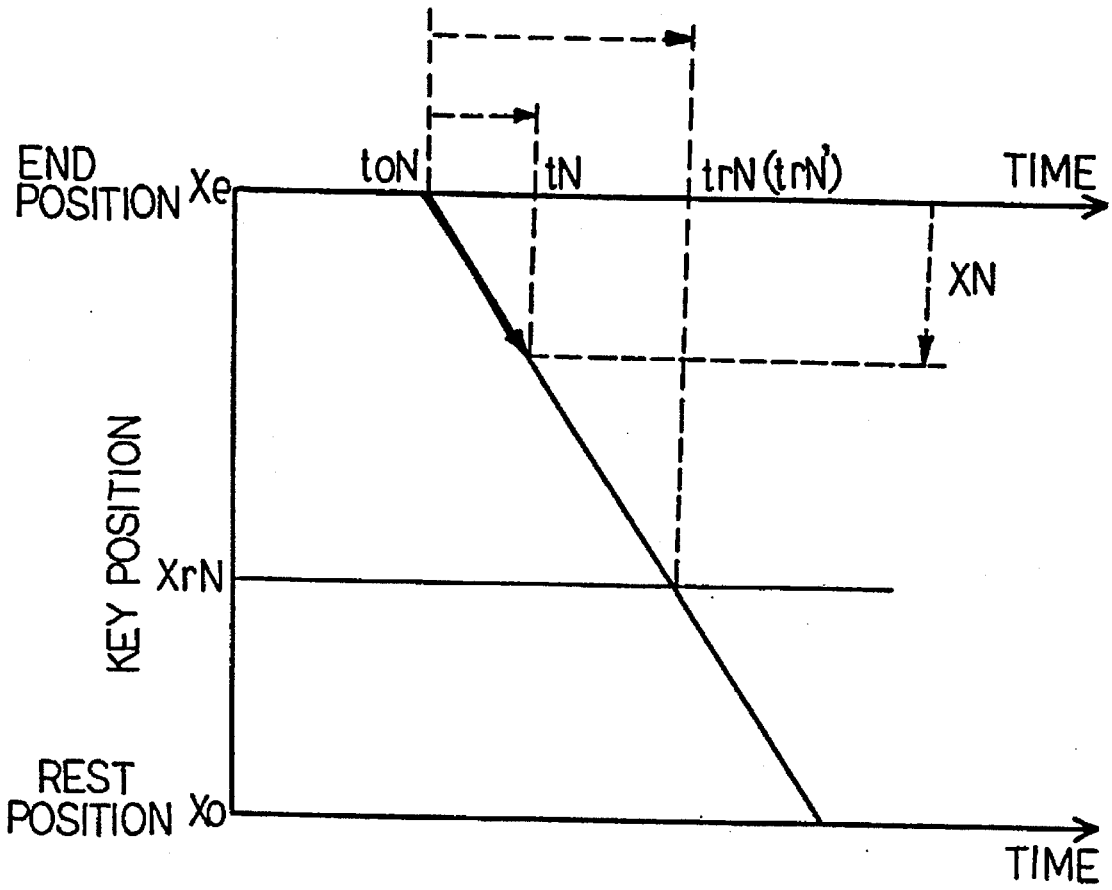
FIG. 24 is a diagram showing a key motion of a released key.

A key position XN at a time tN is expressed by Equation 31.

$$XN=V0N\times tN+Xe \qquad \text{Equation 31}$$

where V0N is the initial key velocity (<0) at the end position Xe. The second trajectory represented by Equation 31 is illustrated in FIG. 24 of the drawings.

As described hereinbefore, the damper assembly 42h comes into contact with the associated set of strings 42g at the return time tkN, and the damper assembly 41H starts the absorption of the vibrations on the strings 41g. Let us assume that the damper assembly 41H comes into contact with the strings 41g at a key position on the second trajectory called as "released reference point XrN", the playback sub-system 42o controls the released key 41b in such a manner as to reach the released reference point XrN at the return time tkN, and the decay of the reproduced tone is approximated to the decay of the original tone.

The damper velocity at the contact with the strings 41g strongly affects the decay of the tone, and the damper velocity is related to the key velocity. For this reason, the key velocity at the released reference point XrN is controlled to be matched with the released key velocity vkN. The key velocity at the released reference point XrN is referred to as "released reference velocity VrN".

If a key 41b is released at time zero, the released reference point XrN is expressed as $$XrN=V0N\times trN'+XeN \qquad \text{Equation 32}$$

where trN' is a time when the released key 41b reaches the reference point. XrN and V0N are equal to VrN and VkN because of the uniform motion. From Equation 32, trN' is determined, and the starting time t0N is given by Equation 33.

$$t0N=trN-trN'=trN-(XrN-XeN)/V0N \qquad \text{Equation 33}$$

The playback sub-system 42o controls the released key 41b from the starting time t0 for moving the key 41b on the second trajectory expressed by Equation 31. Then, the released key 41b passes the released reference point XrN at the return time tkN. In this instance, the initial key velocity V0N is equal to the reference key velocity vkN, and the reference key velocity vkN is equal to the released reference velocity VrN.

Figure 25:
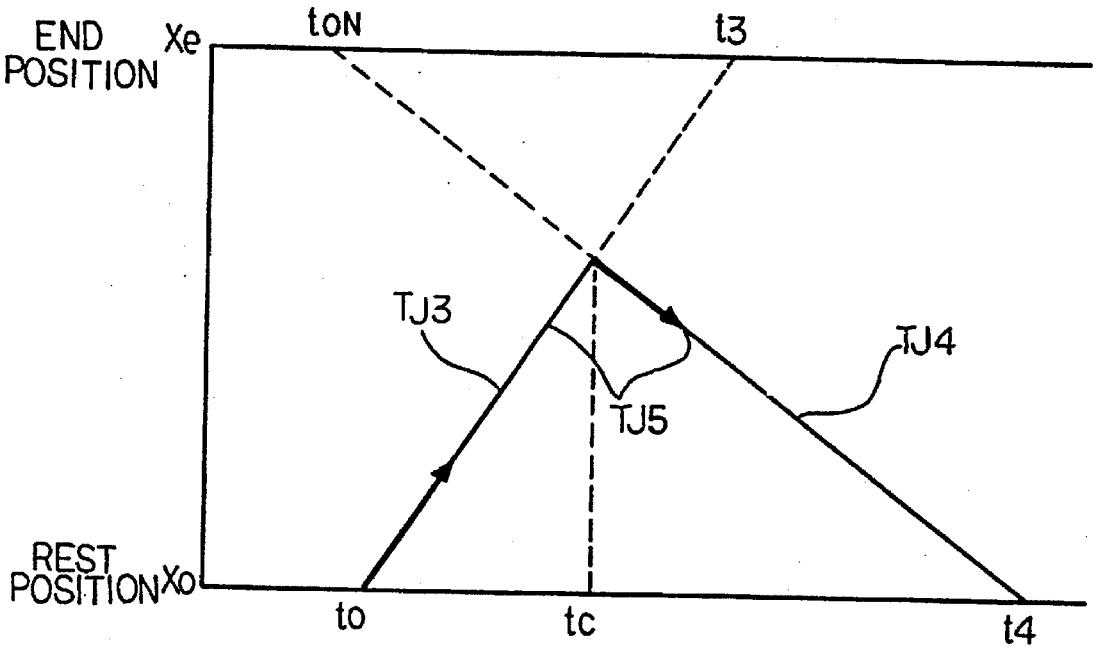
FIG. 25 is a diagram showing a motion of a half stroke key.

If a player depresses or releases a key 41b at an intermediate point between the rest position and the end position, the half strike key traces a composite trajectory shown in FIG. 25. The key 41b starts the rest position Xo at time t0, and reaches the intermediate point at time tc. Then, the key changes the direction, and returns to the rest position Xo at time t4. If the player continuously depresses the key 41b over the intermediate point, the key 41b would reach the end position Xe at time t3. On the other hand, if the player releases the key at time t0N, the key would pass the intermediate point at time tc and reach the end position Xe at time t4. The first trajectory TJ3 forms a part of the trajectory between time t0 and time t3, and the trajectory from time t0N to time t4 contains the second trajectory TJ4.

The time tc is calculated as follows.

$$\begin{aligned} tc &= (V0\times t3-V0N\times t0N)/(V0-V0N) \\ &= t0N+V0\times(t3-t0N)/(V0-V0N) \end{aligned} \qquad \text{Equation 34}$$

Equation 35 gives t3 as follows.

$$t3=t0+(Xe-X0)/V0 \qquad \text{Equation 35}$$

The first trajectory TJ3 for the depressed key 41b is merged with the second trajectory TJ4 for the released key 41b at time tc, and the half stroke key traces the composite trajectory TJ5.

In case of a key 41b depressed at an intermediate point from the end position to the rest position, a composite trajectory is similarly generated for the half stroke key.

Therefore, the pretreatment unit 42r generates the preliminary control data indicative of one of the first/second trajectories for a full stroke key and the composite trajectory for a half stroke key. The pretreatment unit 42r discriminates the half stroke key from the full stroke key by comparing the time t3 with the starting time t0N. Namely, if a player depresses a key 41b over the full stroke, the second trajectory has the starting time t0N later than the time t3. On the other hand, the half stroke key 41b has the starting time t0N earlier than the time t3 as shown in FIG. 25. Therefore, comparison between the starting time t0N and the time t3 results in the discrimination between the full stroke key and the half stroke key.

Description is hereinbelow made on the recording mode and the playback mode of the automatic player piano shown in FIG. 22.

Assuming now that a player wants to record an original performance in the memory sub-system 42m such as a floppy disk, the player is fingering on the keyboard 41a, and the keys 41b are selectively depressed and released by the player. The depressed keys 41b actuate the associated key action mechanisms 41e and the damper assemblies 41H. The damper assemblies 41H leave the associated sets of strings 41g, and the key action mechanisms 41e drive the hammer assemblies 41f for rotation toward the associated sets of strings 41g. The hammer sensors 42c monitor the hammer assemblies 41f, and report the actual hammer positions to the recording unit 42p. The recording unit 42p determines the depressed keys 41b, the hammer velocities vH and the impact times ti.

On the other hand, when the player releases the keys 41b, the key sensors 42b monitor the released keys 41b, and report the actual key positions to the recording unit 42p. The recording unit 42p determines the released key velocities vkN and the return times tkN, and the post-treatment unit 42q normalizes the second piece of data information indicative of the hammer velocity vH, the third piece of data information indicative of the impact time ti, the fourth piece of data information indicative of the released key velocity vkN and the fifth piece of data information indicative of the return time tkN. The post-treatment unit 42q codes the depressed/released key, the hammer velocity vH, the impact time ti, the released key velocity vkN and the return time tkN into the music code for each of the depressed/released keys 41b, and stores the music data codes into the memory sub-system 42m.

After the performance, the player is assumed to reproduce the music. The pretreatment unit 42r sequentially fetches the music data codes stored in the memory sub-system 42m. The pretreatment unit 42r generates the preliminary control data indicative of the first trajectory and the second trajectory for each depressed/released key regardless of the stroke of the key 41b, and discriminates whether or not the music data code represents either full or half stroke key. If the music data code represents the half stroke key, the pretreatment unit 42r calculates the time tc, and merges the first trajectory with the second trajectory for forming the composite trajectory.

If the music data code represents the full stroke key, the pretreatment unit 42r supplies the preliminary control data indicative of the first trajectory at time t0 and, thereafter, the control data indicative of the second trajectory at time t0N to the motion controller 42s. On the other hand, if the music data code represents the half stroke key, the pretreatment unit 42r supplies the preliminary control data indicative of the first trajectory to the motion controller 42s, and changes the preliminary control data indicative of the early part of the first trajectory to the preliminary control data indicative of the later part of the second trajectory at time tc.

The motion controller 42s varies the control data indicative of the target positions X of the depressed/released keys 41b. The servo controller 42t is responsive to the control data for changing the driving signals DR3, and regulates the driving signals DR3 by using the feedback signals FB3. As a result, the solenoid-operated actuator units 41a project the respective plungers 42e1, and cause the associated keys 41b to pass the reference points Xr at the reference velocity Vr at time tr and the released reference point XrN at the released reference velocity VrN at the return time tkN. The hammer assemblies 41f strike the associated sets of strings 41g at the same intensities as those in the original performance, and the reproduced tones are decayed as similar to the original tones.

If the preliminary control data are indicative of the composite trajectory, the motion controller sequentially changes the control data indicative of the target positions X, and the servo controller 42t controls the solenoid operated actuator unit 41a for moving the half stroke key 41b along the composite trajectory.

As will be appreciated from the foregoing description, the automatic player piano according to the present invention causes each key to pass the reference points Xr and XrN at the reference velocities Vr and VrN at times tr and tkN, and discriminates the half strokes for moving the half stroke keys 41b along the composite trajectories. As a result, the hammer strikes the associated set of strings at the same intensities as those in the original performance, and the damper assemblies come into contact with the sets of strings at the same velocity. This results in that the original tones and the decays thereof are faithfully reproduced in the playback.

Figure 26:
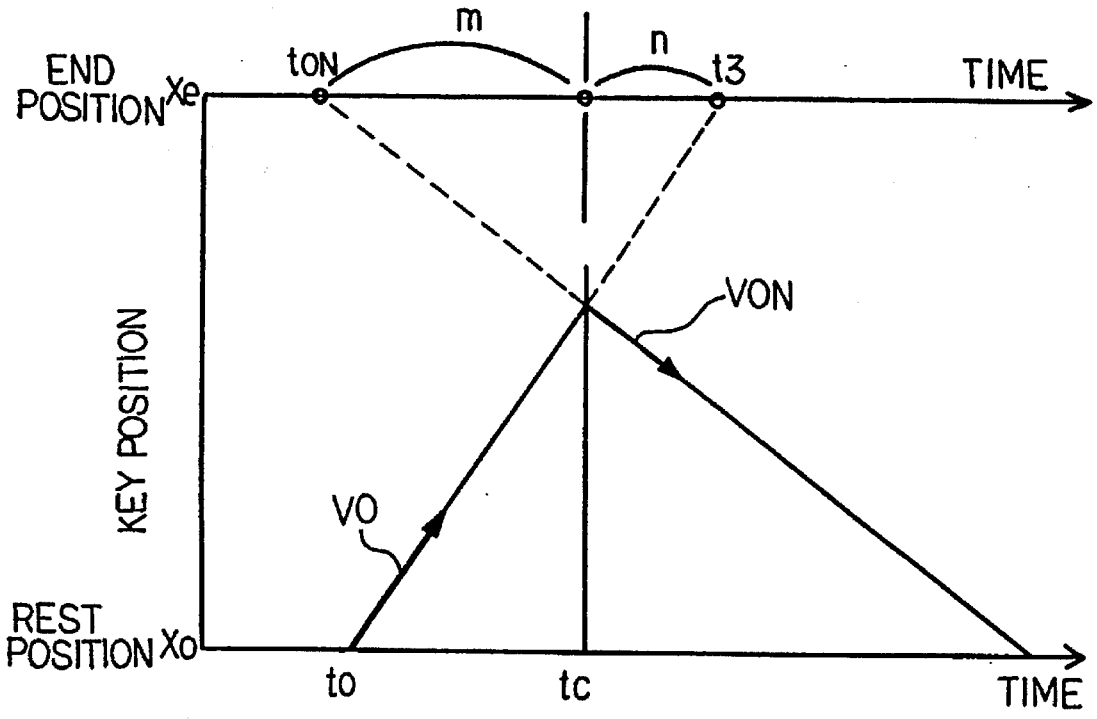
FIG. 26 is a diagram showing a relation between a ratio and a composite trajectory.

In the above described embodiment, the pretreatment unit 42r firstly determines the first and second trajectories, and calculates the time tc for merging the first trajectory with the second trajectory. However, the amount of calculation is so large that Equation 36 can be available for determining the time tc instead of Equation 34.

$$\begin{aligned} tc &= (n \times t0N + m \times t3)/(m+n) \\ &= t0N + m \times (t3 - t0N)/(m+n) \end{aligned} \qquad \text{Equation 36}$$

where n and m are constants representing a ratio shown in FIG. 26. The time tc divides the time interval between the starting time t0N and the time t3 at m:n, and the constants m and n are determined by using a statistical method on experimental results. This is because of the fact that a key velocity for a depressed key 41b tends to be proportional to a key velocity for a released key 41b at a constant ratio. In fact, even though the ratio of the time interval between t0N and tc to the time interval between time tc and t3 is fixed, the key motion for a half stroke key is well approximated. The ratio m:n makes the released key velocity vkN useless, because the initial velocity V0 gives the released initial key velocity without the released key velocity vkN. Therefore, recording unit 42p is not expected to determine the released key velocity vkN.

If the time tc is calculated through Equation 36, the pretreatment unit 42r determines the time t3 on the basis of the starting time t0 and the key velocity V0, and estimates the released key velocity VON. The estimated released key velocity V0N is substituted for V0N in Equation 33, and the starting time t0N is calculated through Equation 33. The relation between the starting time t0N and the time t3 decides whether or not the music data code represents the half stroke key. The starting time t0N thus calculated is substituted for t0N in Equation 36, and the time tc is determined. The pretreatment unit 42r merges the first trajectory with the second trajectory at time tc, and generates the composite trajectory.

Figures 27A, 27B, 27C:
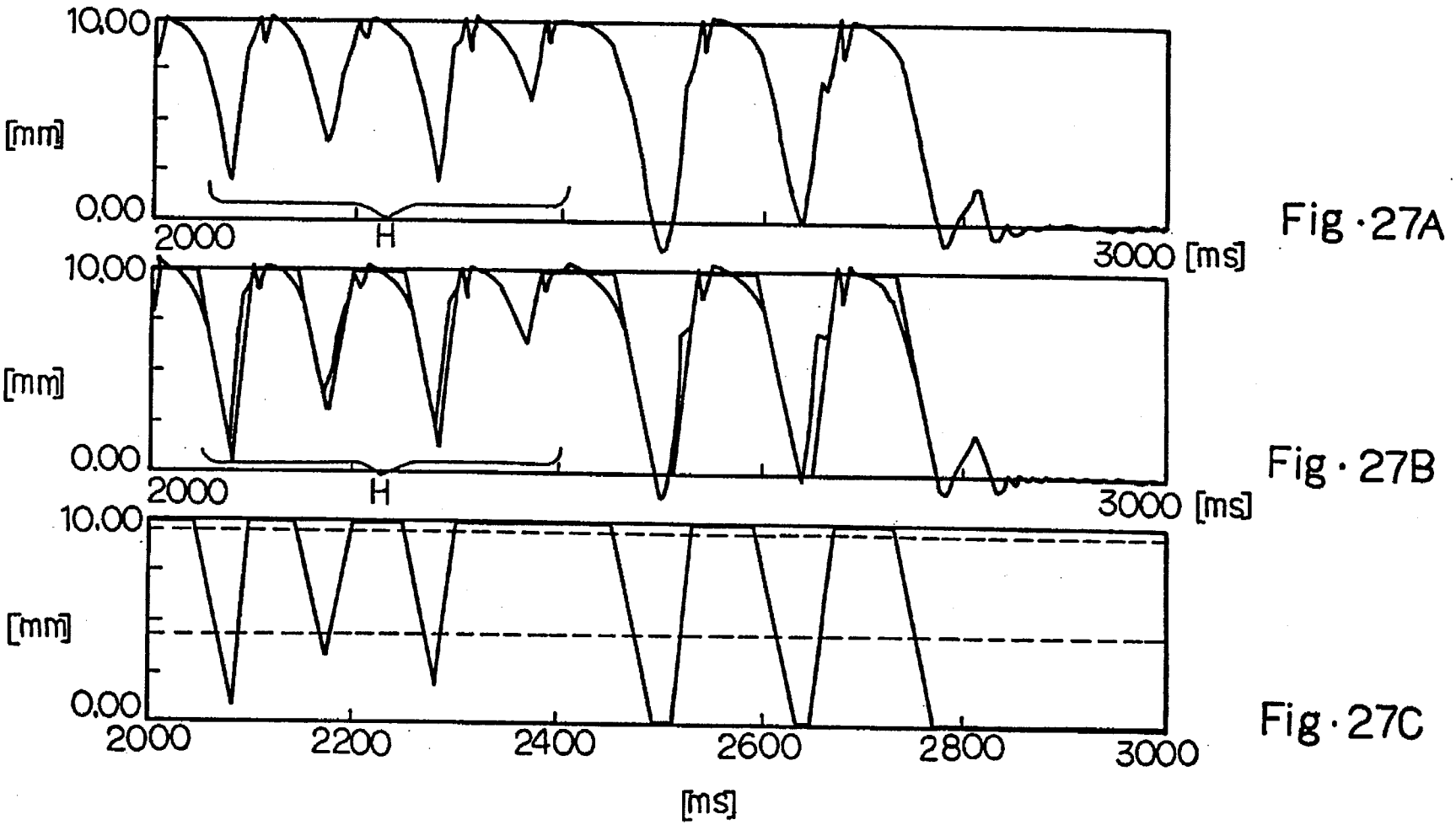
FIG. 27A to 27C are graphs showing an original key motion and a reproduced key motion.
Figures 28A, 28B, 28C:
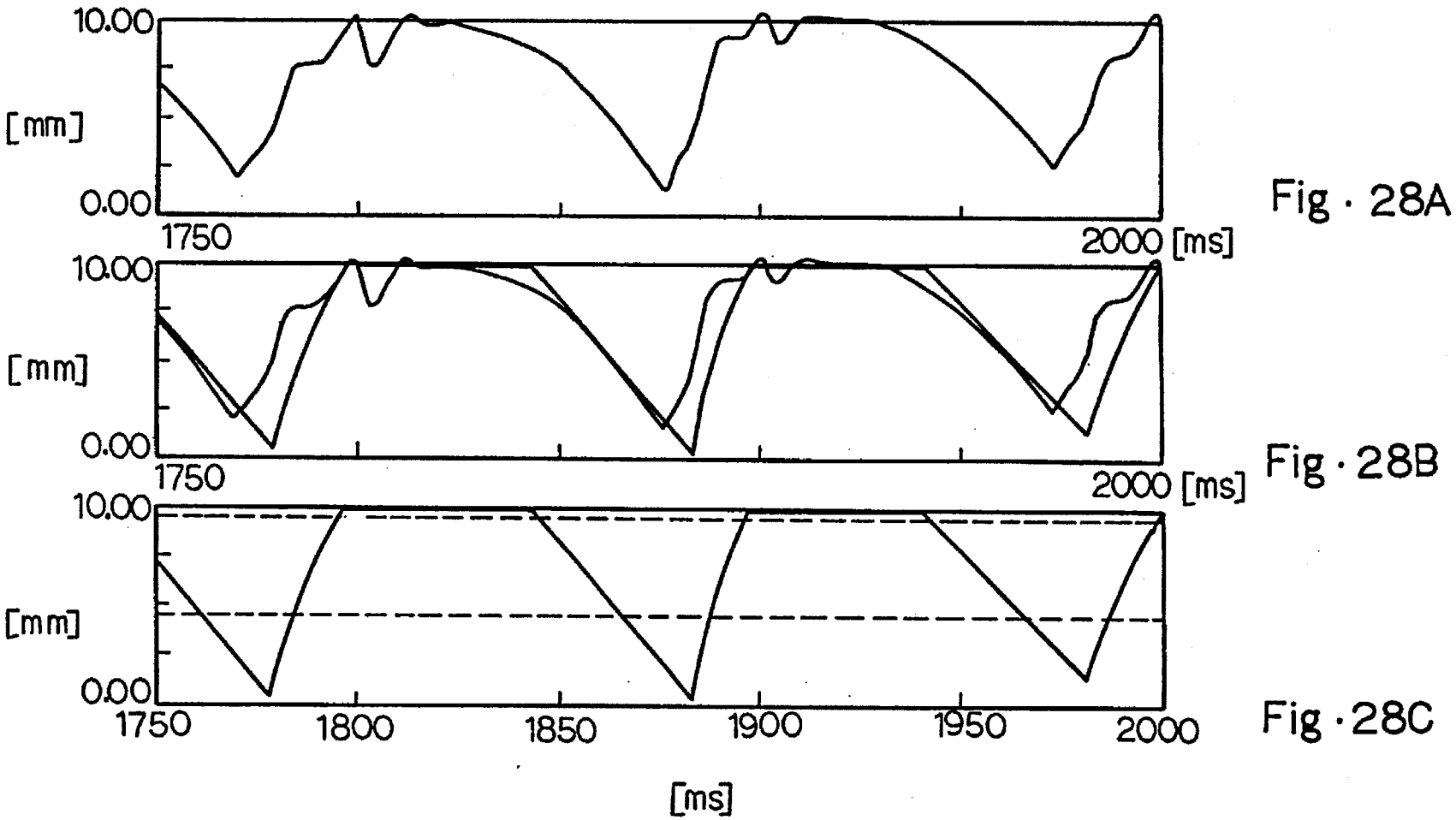
FIGS. 28A to 28C are graphs showing parts of the original key motion and the reproduced key motion in a large scale.

The ratio m:n is effective. The present inventors recorded a key motion, and reproduced the key motion through the calculation using the ration m:n. FIGS. 27A and 27C illustrates the original key motion and the reproduced key motion, and "H" indicates the half stroke keys. The original key motion is overlapped with the reproduced key motion in FIG. 27B, and parts of the original and reproduced key motions are scaled up as shown in FIGS. 28A to 28C. As will be understood from FIGS. 27B and 28B, even if the ratio m:n is used in the calculation, the original key motion is well approximated to the reproduced key motion.

Fifth Embodiment

Figure 29:
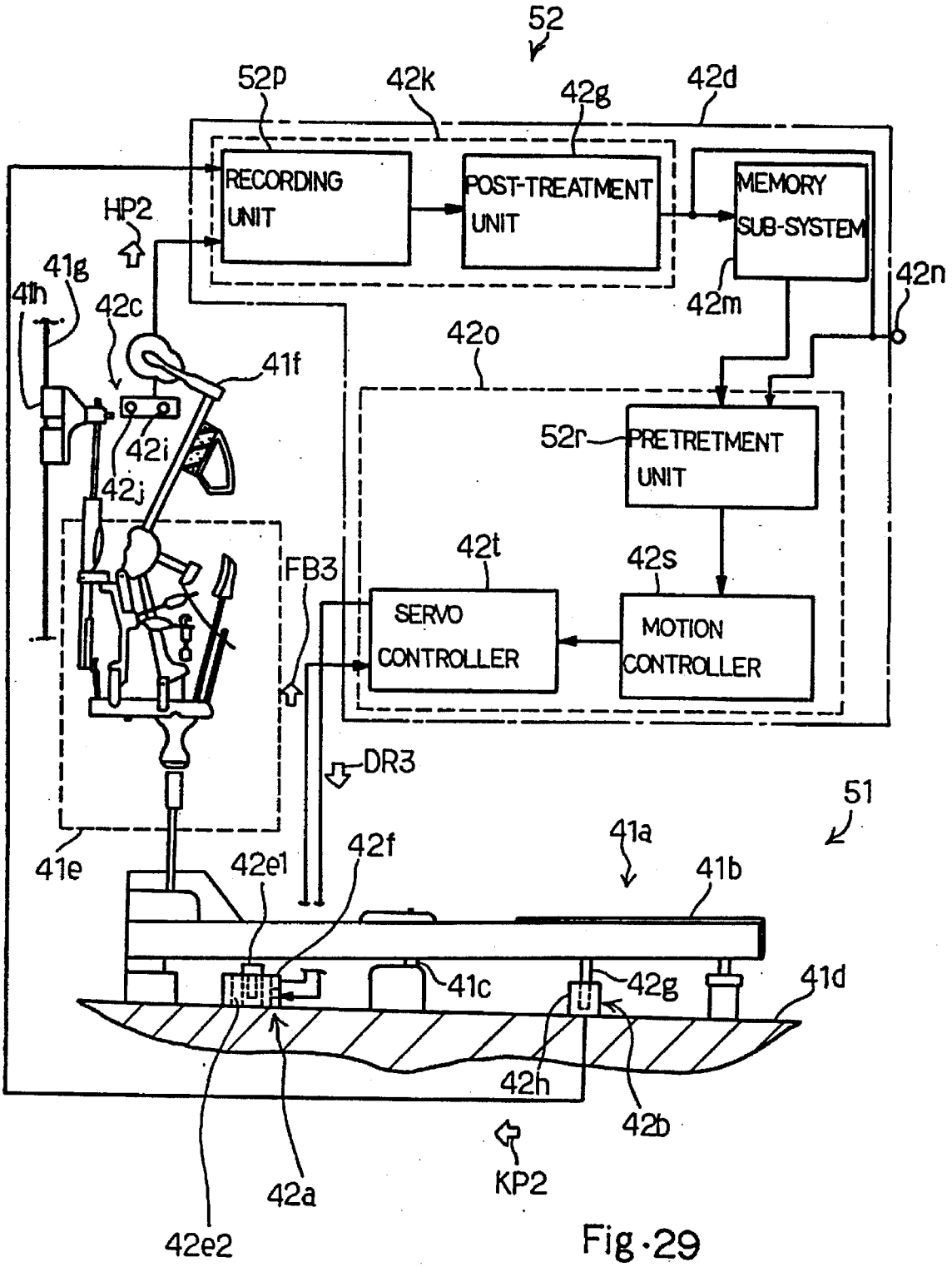
FIG. 29 is a schematic view showing another automatic player piano according to the present invention.

Turning to FIG. 29 of the drawings, another automatic player piano embodying the present invention largely comprises an acoustic piano 51 and the automatic playing system 52. The acoustic piano is similar to the acoustic piano 41, and components are labeled with the corresponding components of the acoustic piano 41 without detailed description.

The automatic playing system 52 is similar to the automatic playing system 42 except for a recording unit 52p and a pretreatment unit 52r, and the other components are designated by the same references for the fourth embodiment without detailed description.

The recording unit 52p determines a key-on velocity Vk as well as the released key velocity vkN and the return time tkN. In detail, while a player is depressing a key 41b, the shutter plate 42g interrupts the optical radiation of the upper photo-coupler and, thereafter, the optical radiation of the lower photo-coupler. The key position signal KP2 reports the early interruption and, thereafter, the later interruption to the recording unit 52p, and the recording unit 52p calculates the key-on velocity Vk by dividing the distance between the lower and upper photo-couplers by a time interval between the early and later interruptions.

The recording unit 52p further determines a hammer velocity. When the hammer assembly 41H interrupts the optical radiation of the lower photo-coupler, the recording unit 52p determines the time to serve as a key-on time tk2. The key-on velocity Vk forms as a sixth piece of data information, and the key-on time tk2 forms a seventh piece of data information. The sixth piece of data information and the seventh piece of data information are coded in the music data code together with the first to fifth pieces of data information.

The pretreatment unit 52r not only determines first and second trajectories but also decides whether to be a half stroke key or a full stroke key. The half stroke key is depressed or released at an intermediate point between the rest position and the end position, and the full stroke key is moved between the rest position and the end position.

The pretreatment unit 52r determines a first trajectory for each depressed key 41b and a second trajectory for the released key 41b on the assumption that the first trajectory and the second trajectory are a parabola and a straight or linear line. The first trajectory is determined as follows.

First, a target position X on the first trajectory is expressed as follows.

$$X=a/2\times t^2+b\times t+c \qquad \text{Equation 37}$$

where a is an acceleration and is given by Equation 38.

$$a=(Vr-Vk)/(tr-(tk1+tk2)/2) \qquad \text{Equation 38}$$

Figure 30:
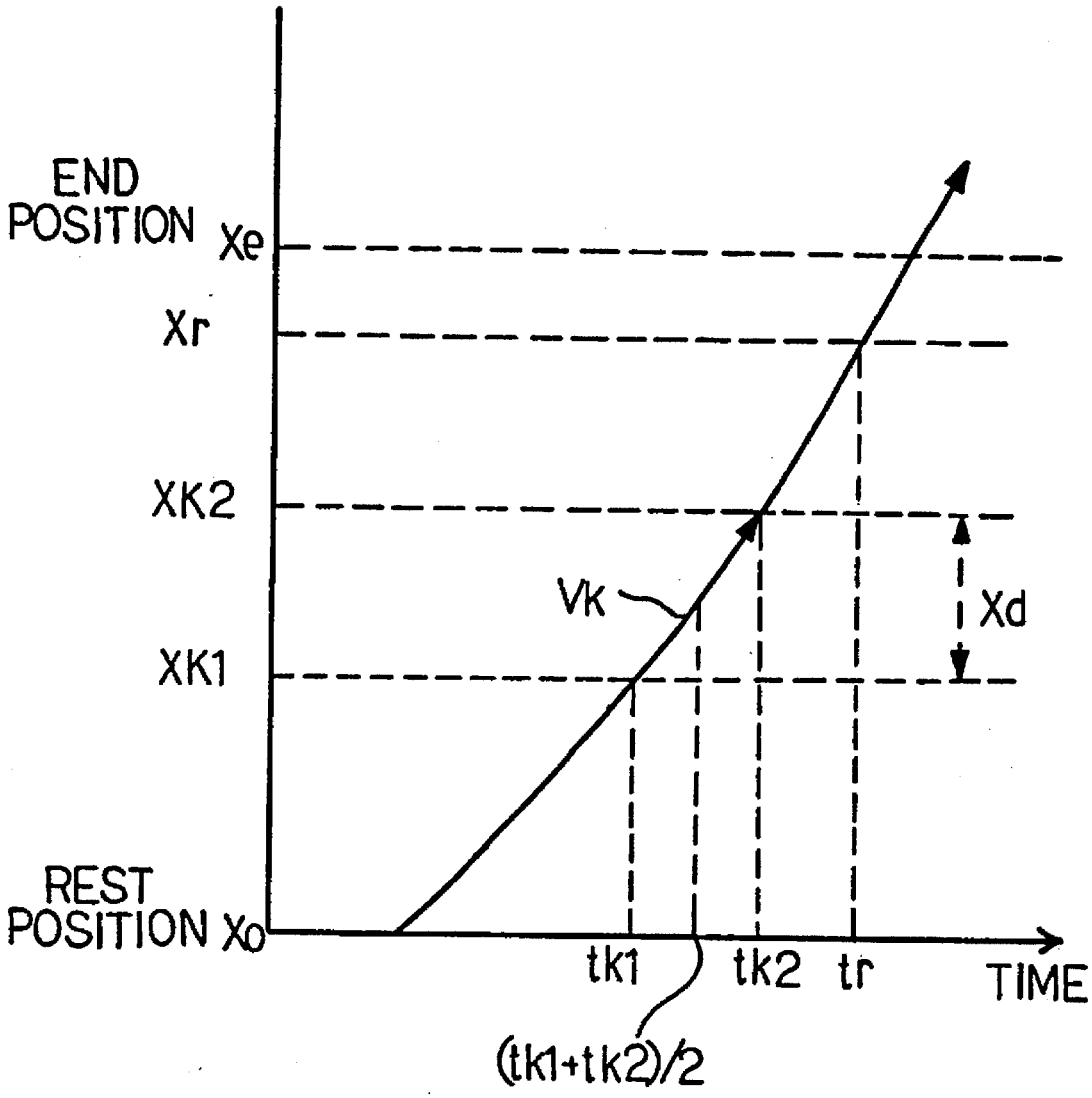
FIG. 30 is a diagram showing a key motion in the automatic player piano shown in FIG. 29.

The reference velocity Vr is given by Equation 1, and is calculated on the basis of the hammer velocity vH. The time tk1 is indicative of a timing when the shutter plate 42g interrupts the optical radiation of the upper photo-coupler of each key sensor 42b, and calculated on the basis of the key-on velocity Vk and the key-on time tk2 as follows.

$$tk1=tk2-Xd/Vk \qquad \text{Equation 39}$$

where Xd is a distance between the upper photo-coupler and the lower photo-coupler of each key sensor 42b. The first trajectory is illustrated in FIG. 30, and Xk1 and Xk2 are indicative of the position of the upper photo-coupler and the position of the lower photo-coupler. The key-on velocity Vk is an average velocity in the interval between the upper photo-coupler and the lower photo-coupler, and is equal to the key velocity at an intermediate point (tk1+tk2)/2 on the parabolic trajectory. The acceleration a is given as a quotient of the division between the velocity difference (Vr−Vk) and the time difference (tr −(tk1−tk2)/2). However, the acceleration a may be calculated from a velocity difference between two arbitrary points under the conditions of a uniformly accelerated motion.

Figure 31:
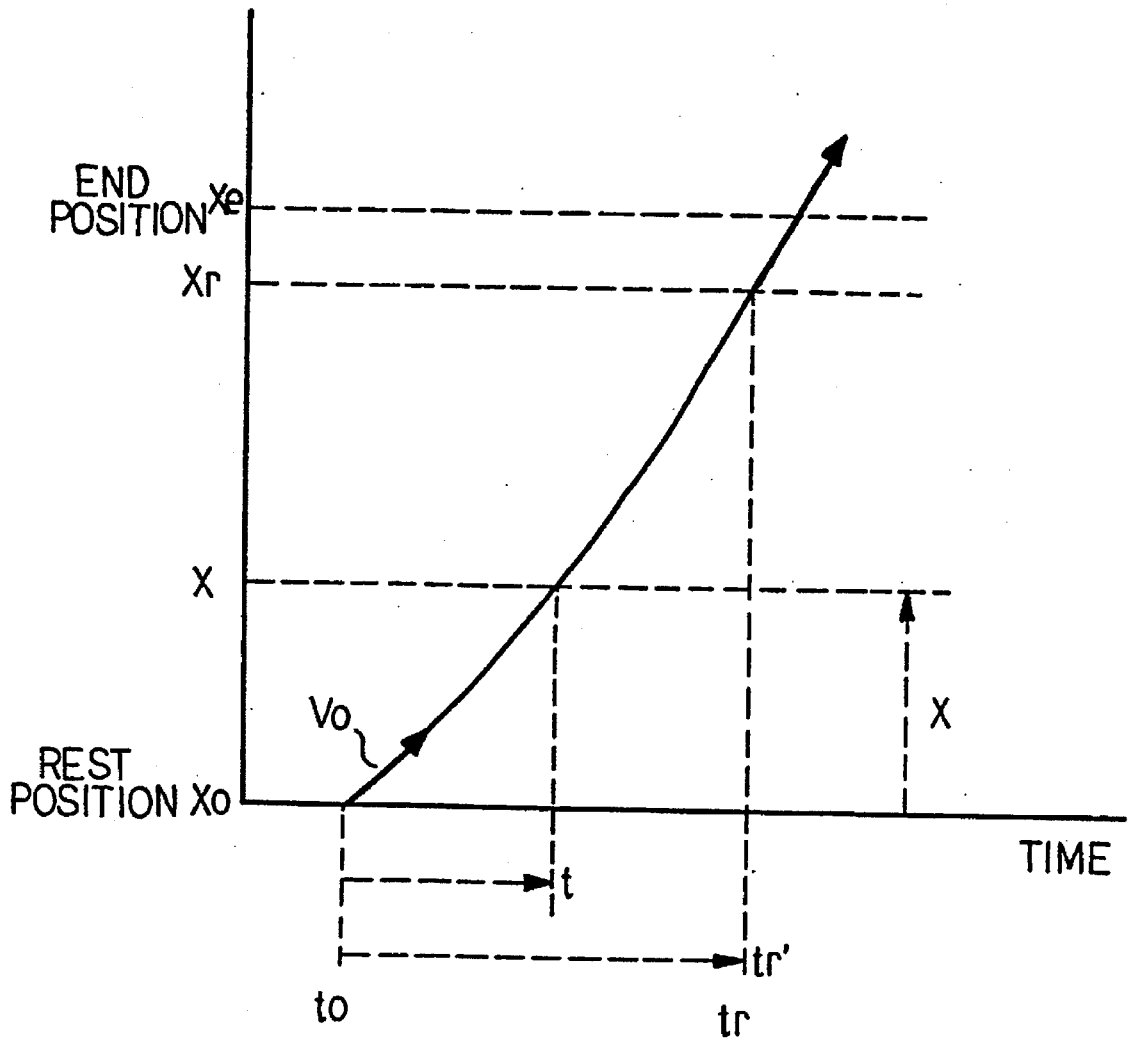
FIG. 31 is a diagram showing a key motion in the automatic player piano.

Thus, the pretreatment unit 52r determines the reference time tr and the reference velocity Vr on the basis of the second and third pieces of data information, i.e., the hammer velocity vH and the impact time ti, and the acceleration a on the basis of the key-on velocity Vk and the key-on time tk2. For this reason, if a starting time t0 for a depressed key and an initial velocity V0 at the starting time are given, the first trajectory shown in FIG. 31 is determined. The constants b and c of Equation 11 are given by Equations 40 and 41.

$$b=V0-a\times t0 \qquad \text{Equation 40}$$

$$c=Xo-(a/2)\times t0^2+b\times t0 \qquad \text{Equation 41}$$

where Xo is the rest position. If the starting time t0 is zero, Equation 37 is changed by using Equations 40 and 41 as follows.

$$Xr=(a/2)tr'^2+V0\times tr'+Xo \qquad \text{Equation 42}$$

where tr' is the reference point on the assumption that the starting time t0 is zero. The reference velocity Vr is expressed as Equation 43.

$$Vr=a\times tr'+V0 \qquad \text{Equation 43}$$

From Equations 42 and 43, we obtain Equation 44.

$$0=(a/2)\times tr'^2-Vr\times tr'-(Xo-Xr) \qquad \text{Equation 44}$$

When Equation 44 is solved for tr', tr' is expressed as $$tr'=(Vr-(Vr^2+2a(Xo-Xr)^{1/2}/a \qquad \text{Equation 45}$$

Thus, if the acceleration a, the reference velocity Vr, the reference point Xr and rest position Xo are known, we can determine the time tr' consumed in the motion from the starting time t0 to the reference point Xr. The relation between tr' and tr is given by Equation 46.

$$tr'=tr-t0 \qquad \text{Equation 46}$$

From Equations 42 and 43, the initial velocity V0 is calculated as follows.

$$V0=(Vr^2+2a(Xo-Xr))^{1/2} \qquad \text{Equation 47}$$

The constant b is given by Equation 40 on the basis of the initial velocity V0, and Equation 41 gives the constant c. Then, the constants b and c and the acceleration a allow Equation 37 to determine the target position X on the parabolic trajectory for a depressed key.

An actual fingering on the keyboard 41a moves the keys 41b along actual trajectories well approximated to parabolic lines. For this reason, the pretreatment unit 52r generates parabolic trajectories for depressed keys, and the playback sub-system 42o causes the acoustic piano 51 to reproduce delicate musical expression by using the parabolic trajectories.

Finally, if the playback sub-system 42o starts the plunger 42e1 of the solenoid-operated actuator unit 42a with the initial velocity V0 at time t0 and increments the key velocity, the plunger 42e1 and the key 41b trace a parabolic trajectory, and achieves the same advantages as the key position control described hereinbefore.

The pretreatment unit 52r further determines the second trajectory for each released key 41b. However, the calculation is similar to that of the second embodiment, and description is omitted for the sake of simplicity.

The pretreatment unit 52r compares the starting time t0N with a finish time at the end position of the depressed key 41b to see whether or not the finish time is later than the starting time t0N. If the answer is given affirmative, the music data code is indicative of the half stroke key, and the pretreatment unit 52r calculates a time tc as follows.

When one of the music data codes is indicative of a half stroke key, the pretreatment unit 52r calculates a turning point or a time tc as follows.

$$tc=(-db+(db^2-2\times da\times dc)^{1/2})/da \qquad \text{Equation 47}$$

where da, db and dc are given by Equations 48, 49 and 50, respectively.

$$da=a-aN \qquad \text{Equation 48}$$

where aN is an acceleration of the released key.

$$db=Vr-VrN-(a\times tr-aN\times trN) \qquad \text{Equation 49}$$

The acceleration aN is zero, and Equation 49 is rewritten as $$db = Vr - VrN - a \times tr \quad \text{Equation 49'}$$

$$dc = Xr - XrN + (a \times tr^2 - aN \times trN^2)/2 - (Vr \times tr - VrN \times trN) = Xr - XrN + (a \times tr^2)/2 - (Vr \times tr - VrN \times trN) \quad \text{Equation 50}$$

Using da, db and dc, Equation 47 gives the time tc, and the pretreatment unit 52r merges the first parabolic trajectory with the second linear trajectory at time tc. The composite trajectory thus merged represents the half stroke key, and the motion controller 42s ad the servo controller 42t controls the plunger 42e1 and the key 41b along the composite trajectory.

The automatic player piano thus arranged behaves as follows. In the recording mode, a player is performing a music on the keyboard 41a, and the key sensors 42b and the hammer sensors 42c produce the key position signals KP2 and the hammer position signals HP2. The recording unit 52p periodically scans input nodes respectively assigned to the key position signals KP2 and the hammer position signals HP2. The recording unit 52p determines the hammer velocity vH, the impact time ti for each of the depressed keys 41b and the key-on velocity Vk, the key-on time tk2, the released key velocity vkN and the return time tkN for each released key 41b.

The post-treatment unit 42q normalizes the hammer velocity vH, the impact time ti, the key-on time tk2, the released key velocity vkN and the return time tkN, and stores in each music data code for one of the depressed/released key 41b. The music data codes are transferred to the memory sub-system 42m, and are stored therein.

After the original performance, if the player reproduces the music, the pretreatment unit 52r sequentially reads out the music data codes, and determines a parabolic trajectory for each depressed key 41b and a linear trajectory for the released key 41b.

Namely, the pretreatment unit 52r calculates a parabolic trajectory on the basis of the hammer velocity vH, the impact time ti, the key-on velocity Vk and the key-on time tk2, and supplies the preliminary control data indicative of the parabolic trajectory to the motion controller 42s at the starting time t0. The motion controller 42s varies the control data indicative of the target position X with time, and the servo controller 42t changes the driving signal DR3 or the amount of driving current depending upon the target position X. The solenoid-operated actuator unit 41a projects the plunger 42e1 depending upon the amount of the driving current, and the built-in position sensor 42e2 feedbacks the actual position of the plunger 42e1. The servo controller 42t modifies the driving signal DR3 so as to match the target position X with the actual position. As a result, the key 41b specified by the first piece of data information is moved along the parabolic trajectory, and passes the reference point Xr at the acceleration a at the reference time tr. The depressed key 41b actuates the key action mechanism 41e, and the key action mechanism 41e drives the hammer assembly 41f for rotation. The hammer assembly 41f strikes the set of strings 41g at the hammer velocity vH, and the intensity of the impact is approximately equal to that of the original impact. The parabolic trajectory is analogous to the original trajectory in the recording, and the impact is well controlled by the playback sub-system 42o.

The pretreatment unit 52r further calculates the linear trajectory on the basis of the released key velocity vkN and the return time tkN, and supplies the preliminary control data indicative of the linear trajectory to the motion controller 42s at the starting time t0N for the released key 41b. The motion controller changes the target position XN in accordance with the given linear trajectory, and the released key 41b allows the damper assembly 41H to come into contact with the set of strings 41g at the return time tkN. The return timing and the returning velocity of the damper assembly 41H are approximately equal to those of the damper assembly 41H in the recording, and the reproduced tone is decayed as similar to the originally produced tone.

If one of the music data codes is indicative of the half stroke key, the pretreatment unit 52r calculates the parabolic trajectory and the linear trajectory, and determines the time tc. The parabolic trajectory is merged with the linear trajectory at time tc, and the motion controller 42s and the servo controller 42t control the solenoid-operated actuator 41a so as to trace the composite trajectory.

Figures 32A, 32B, 32C:
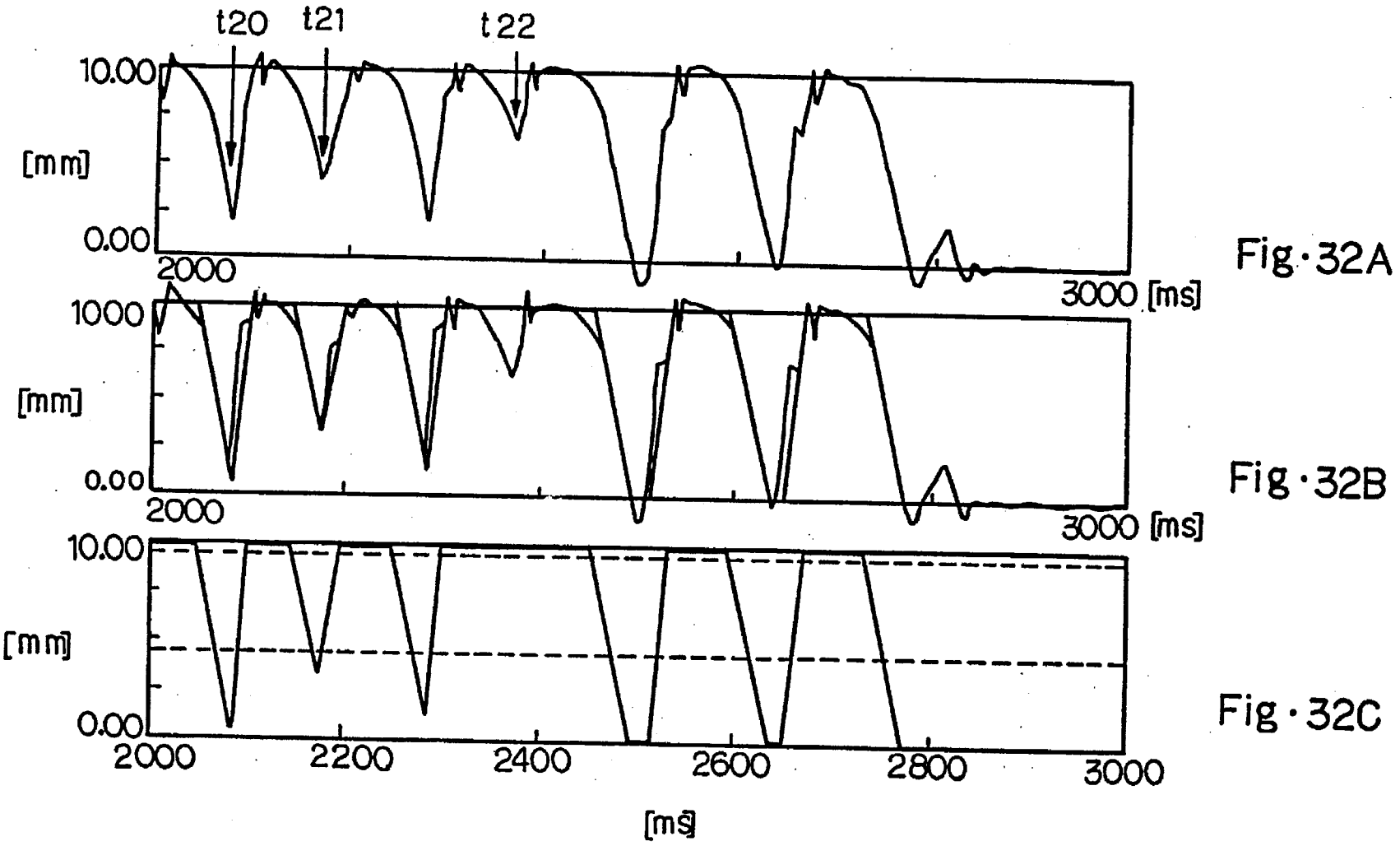
FIGS. 32A to 32C are graphs showing a key motion and the reproduced key motion.

The present inventors evaluated the automatic player piano implementing the fifth embodiment, and plotted original and reproduced trajectories in FIGS. 32A to 32C. FIG. 32A shows the original motions of a key 41b, and t20 and t21 indicate the half stroke keys. Time t22 indicates a key motion which did not strike the strings 41g. FIG. 32C shows the reproduced key motion, and the original key motion is overlapped with the reproduced key motion in FIG. 32B. The half stroke keys at time t20 and t21 were reproduced and the reproduced key motion maintained the key 41b in the depressed state at time t22. Parts of the key motions shown in FIGS. 32A to 32C are scaled up as shown in FIG. 32A to 32C. Although the reproduced key motion is smooth rather than the original key motion, the original key motion is affected by unintentionally noise due to, for example, the key action mechanism 41e, and the present inventors think that the ideal key motion without the noise is closer to the reproduced key motion.

Figures 33A, 33B, 33C:
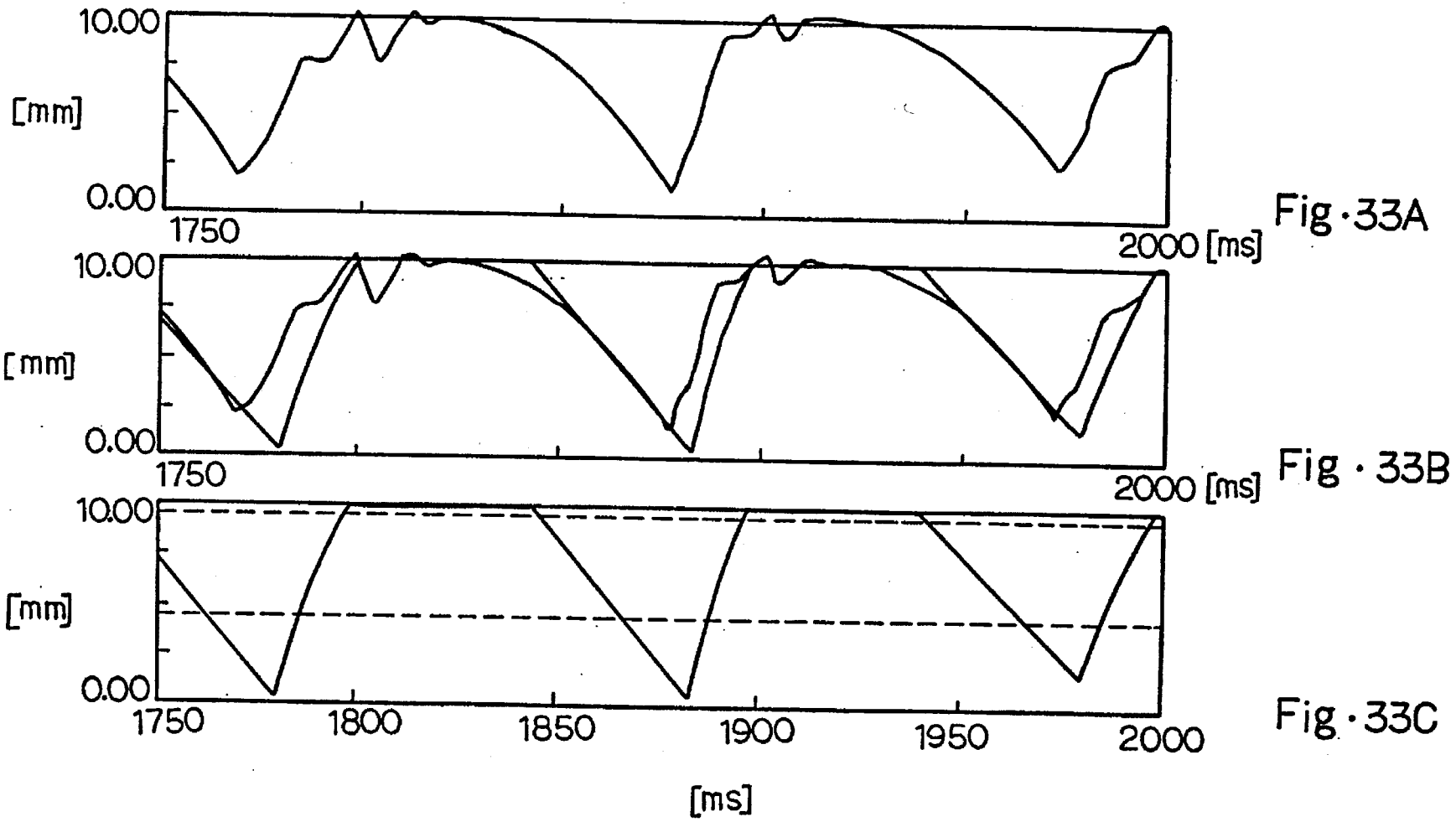
FIGS. 33A to 33C are graphs showing parts of the key motions shown in FIGS. 32A to 32C at a large scale.

From FIGS. 32B and 33B, the original key motion is approximated to the reproduced key motion, and the automatic player piano according to the present invention is advantageous over the prior art automatic player piano.

The automatic player piano implementing the fifth embodiment is modified as follows.

Figures 34A, 34B, 34C:
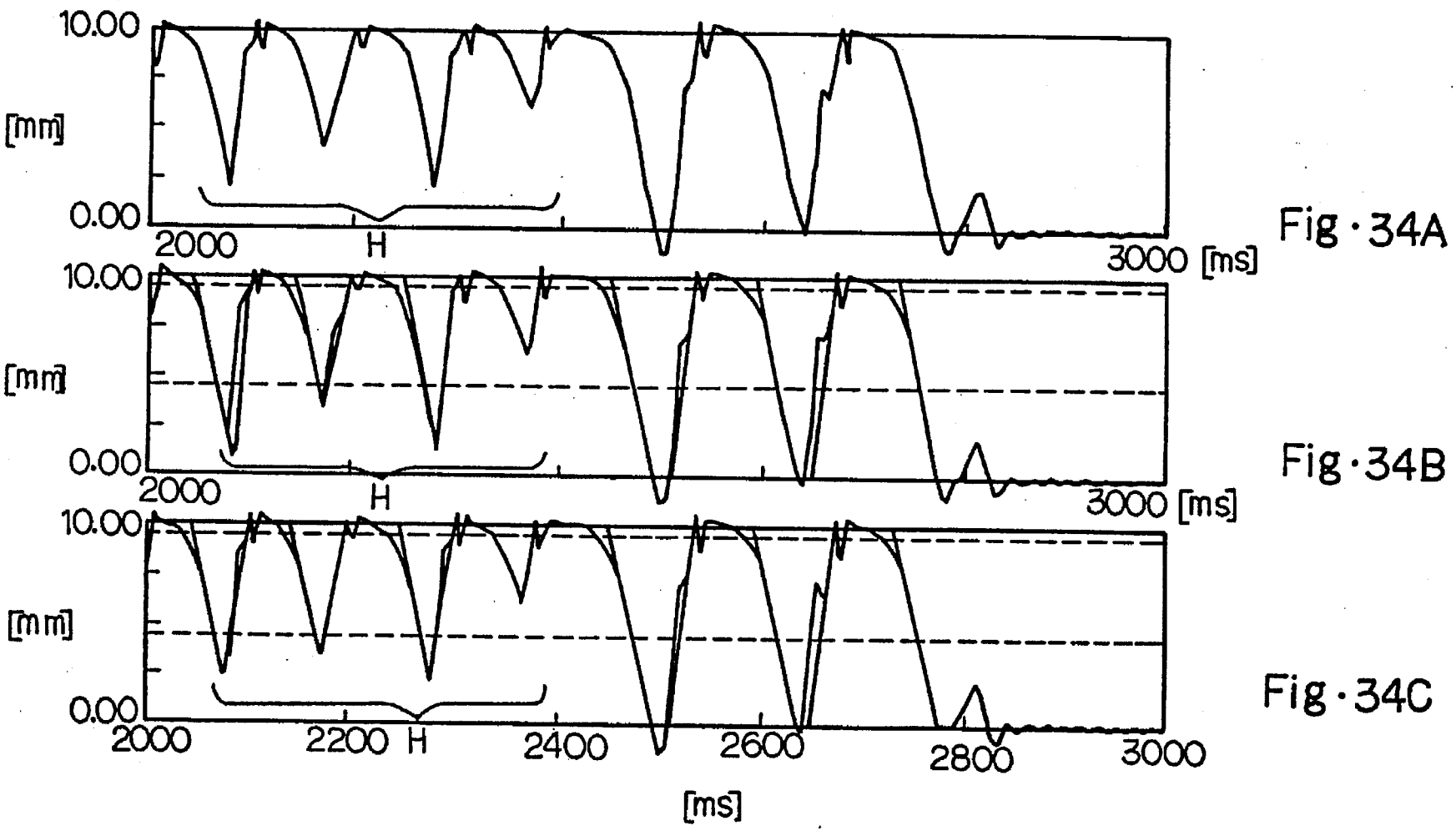
FIGS. 34A to 34C are graphs showing another key motion and the reproduced key motion.
Figures 35A, 35B, 35C:
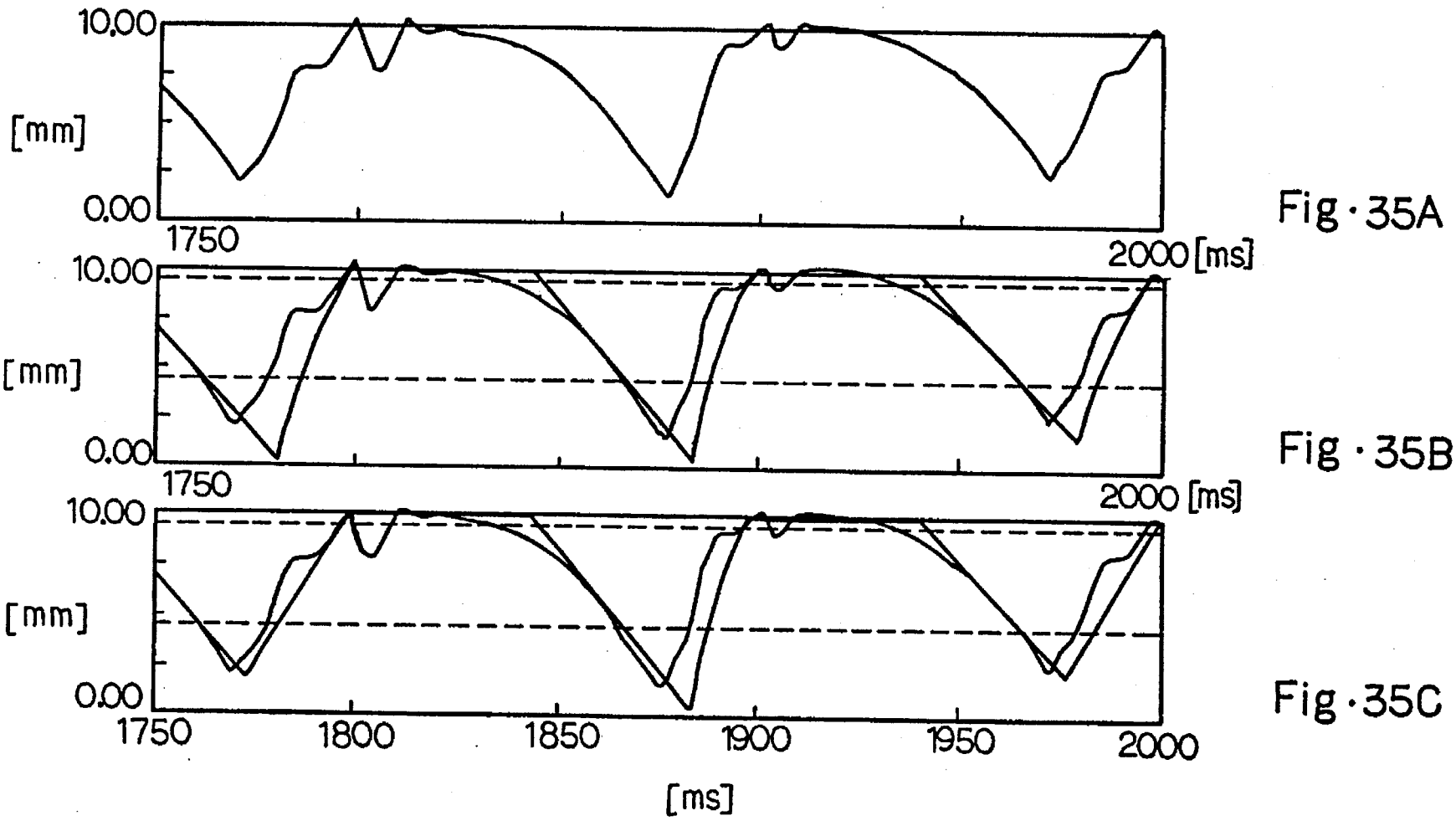
FIGS. 35A to 35C are graphs showing parts of the key motions shown in Figs. 34A to 34C at a large scale.

When the half stroke takes place, the acceleration of a depressed key 41b is temporally changed to negative. However, it is better for the playback-system to assume the acceleration zero. The present inventors instructed the pretreatment unit 52r to assume a negative acceleration zero, and plotted an original key motion and the reproduced key motion in FIGS. 34A to 34C. "H" indicates the half stroke keys, and the acceleration were changed to negative. The original key motion shown in FIG. 34A is overlapped with the reproduced key motion without the instruction in FIG. 34B, and is further overlapped with the reproduced key motion with the above assumption in FIG. 34C. Comparing FIG. 34B with FIG. 34C, the reproduced key motion with the assumption is matched with the original key motion rather than the reproduced key motion without the assumption. FIGS. 35A to 35C shows parts of the key motions shown in FIGS. 34A to 34C at a large scale.

Figures 36A, 36B, 36C:
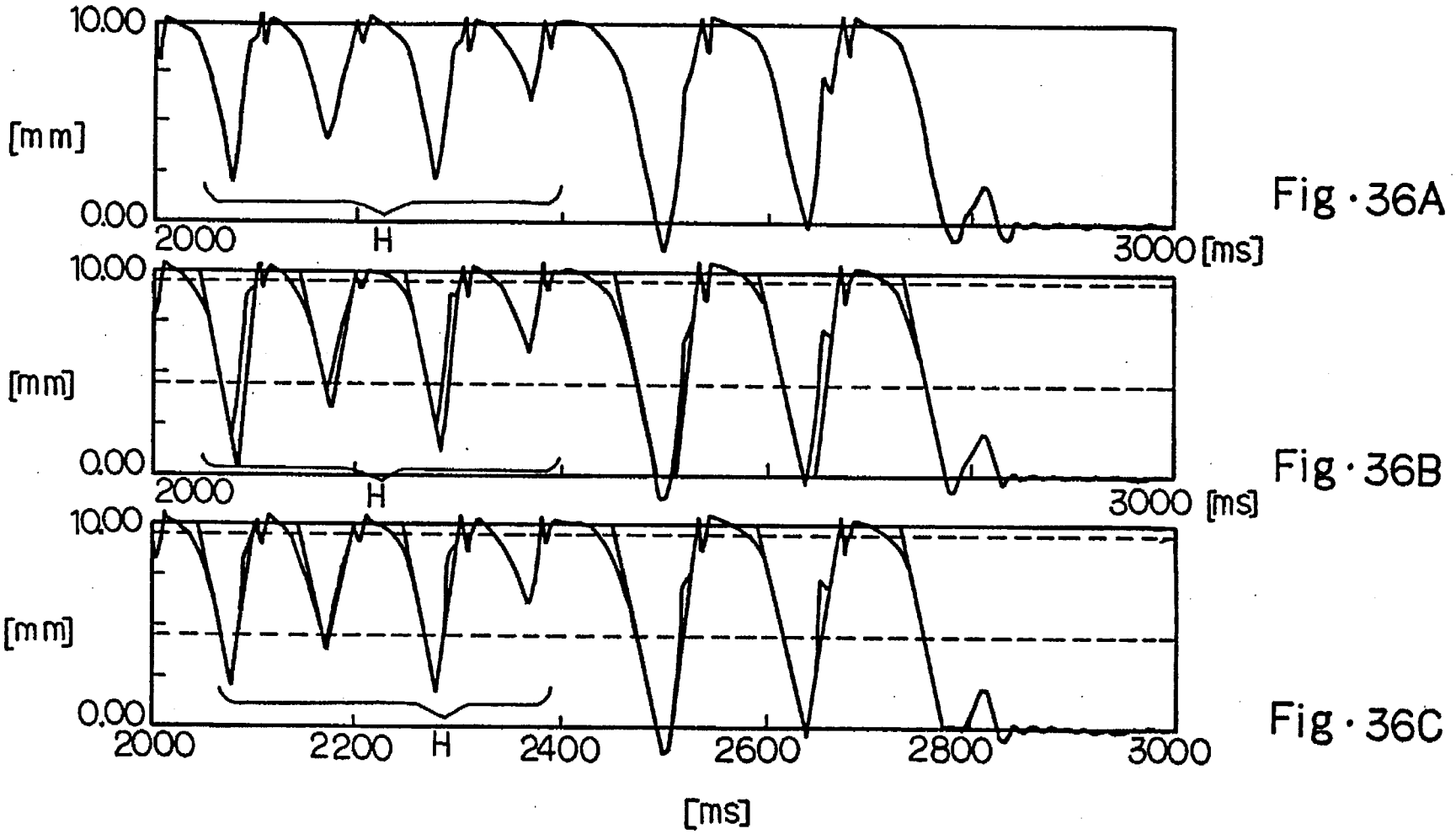
FIGS. 36A to 36C are graphs showing yet another key motion and the reproduced key motion.
Figures 37A, 37B, 37C:
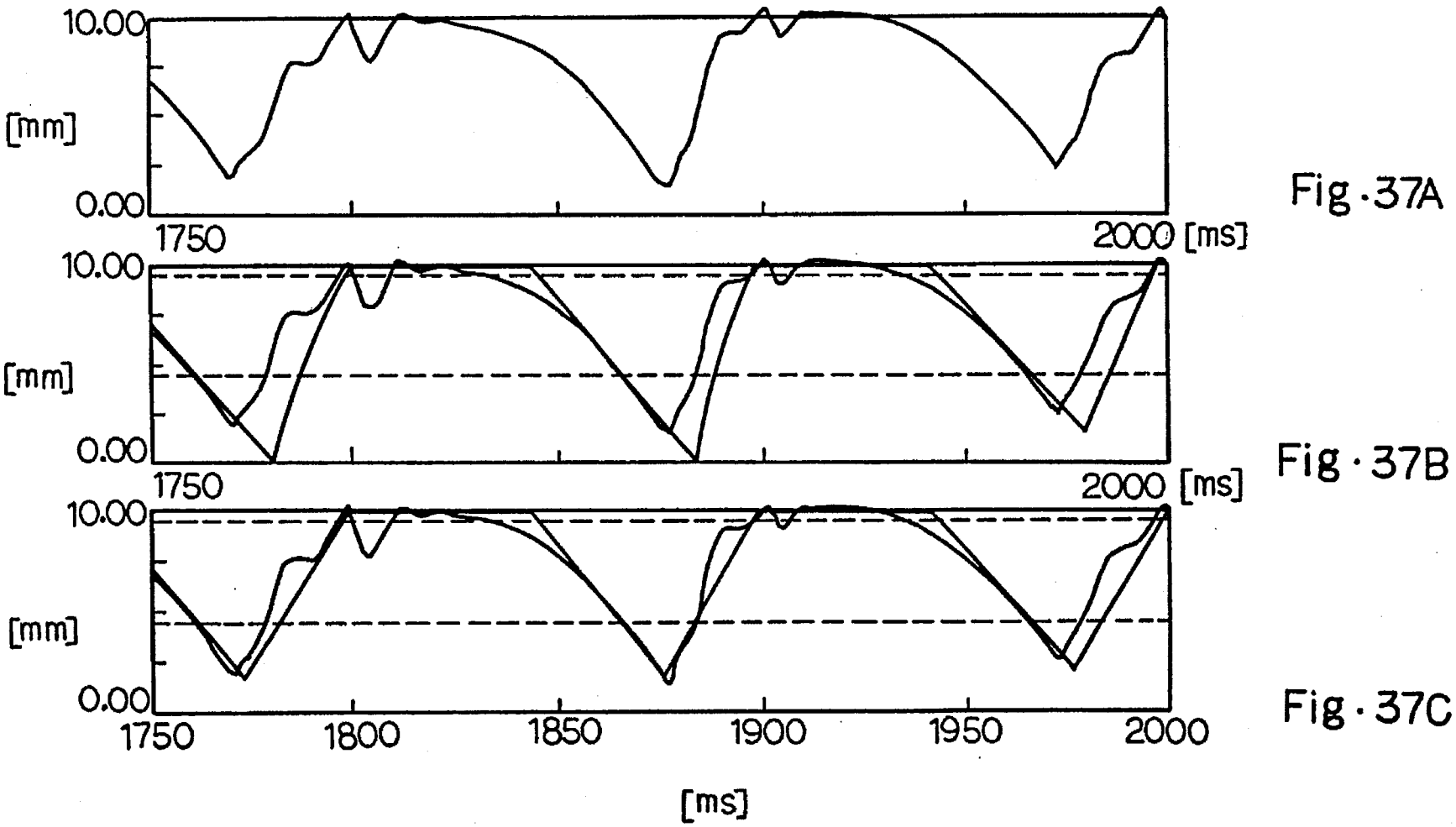
FIGS. 37A to 37C are graphs showing parts of the key motions shown in FIGS. 36A to 36C at a large scale.

In another modification, the pretreatment unit 52r assumes the acceleration a of the half stroke key 41b zero at all times. The present inventors plotted an original key motion in FIG. 36A, and "H" indicates the half stroke keys 41a. A reproduced key motion was plotted in FIG. 36B without the assumption, i.e., the acceleration of the half stroke keys were always zero, and a reproduced key motion in FIG. 36C was plotted on the assumption that the acceleration of the half stroke keys were zero at all times. Parts of the key motions shown in FIGS. 36A to 36C are scaled up, and are illustrated in FIG. 37A to 37C. As will be understood from FIGS. 36B and 37B, when the pretreatment unit 52*r* reproduces the half stroke key motions on the assumption that the acceleration is zero at all times, the reproduced key motions are analogous to the original key motions rather than the reproduced key motions without the assumption.

Although the above described embodiments carry out a position servo control, the second embodiment may carry out a velocity servo control, and the servo controller 42*t* maintains the initial velocity given by the motion controller 42*s*. Moreover, the third embodiment may carry out an acceleration servo control, and the motion controller 42*s* supplies the initial velocity and an increment of the velocity. The servo controller accumulates the initial velocity and the increments with time, and controls the acceleration of the plunger 42*e*1.

The method of estimating the acceleration may be applied to an electronic keyboard musical instrument. Namely, if a key velocity and a hammer velocity are known, the acceleration is estimated for a depressed key, and the estimated acceleration is available for controlling the tone generation in the electronic keyboard musical instrument. An electronic keyboard musical instrument memorizes a plurality of tone waveforms, and the tone waveforms are selected by using the tone intensity and/or a pitch. If the electronic keyboard musical instrument estimates the acceleration, the tone waveforms are selected by using the estimated tone waveform.

Although the fourth and fifth embodiments assume the second trajectory to be a uniform motion tracing a linear trajectory, another modification may assumes the second trajectory to be a uniformly accelerated motion. In order to determines a parabolic second trajectory, each of the key sensors 21*b* requires more than two photo-couplers.

Japanese Patent Publication of Unexamined Application No. 1-239594 discloses a keyboard musical instrument which estimates a hammer velocity on the basis of a key velocity of a depressed key. If such a velocity data is stored, the above described embodiments may use the velocity data. A piece of key-on or key velocity information of a MIDI (Musical Instruments Digital Interface) code is therefore available, and a time data for generating a sound or an intensity data for the sound are also available for the embodiments.

Although all of the embodiments described hereinbefore controls the physical quantity at the reference point, the half stroke key can be reproduced without the reference point. In detail, if an automatic player piano energizes a solenoid-operated actuator unit slightly before the impact time and cuts off the driving current at a release timing, a half stroke is detectable by analyzing a relation between a completing timing of power supply and the cut-off timing, and the key behaves as the half stroke key when the driving current is cut off before the completion of the power supply. In this instance, the driving current may be gradually decreased such that the release is finished in a predetermined time.

In summary, if a starting time and a finish time for a depressed key and a starting time and a finish time for the released key are determined on the basis of the second and third pieces of data information and the fourth and fifth pieces of data information, the pretreatment unit can discriminate the half stroke key, and changes the first trajectory to the second trajectory or vice versa at the turning point.

Even if the reference point and the reference velocity are not taken into account, linear trajectories for a depressed/released key can be determined. For example, a linear trajectory is determined by using a key velocity only, and a turning point is calculated as similar to the fourth embodiment. Then, a servo controller controls the key for the half stroke.

As will be appreciated from the foregoing description, the automatic player piano according to the present invention controls the key to pass the reference point with the reference physical quantity, and faithfully reproduces a music, because the hammer velocity is related to the physical quantity at the reference point.

Although particular embodiments of the present invention have been shown and described, it will be obvious to those skilled in the art that various changes and modifications may be made without departing from the spirit and scope of the present invention. For example, a grand piano is available for the acoustic piano, and an automatic player piano may be fabricated on the basis of a keyboard musical instrument equipped with a stopper for preventing strings from hammers.

What is claimed is:

1. A musical keyboard instrument comprising:

an acoustic piano including:

a keyboard having a plurality of keys each of which rotates from a rest position to an end position when depressed by a player, a plurality of key action mechanisms functionally connected to said plurality of keys, respectively, a plurality of sets of strings respectively associated with said plurality of keys, and a plurality of hammer assemblies respectively associated with said plurality of sets of strings, and respectively driven by said plurality of key action mechanisms for striking the associated sets of strings; and an automatic playing system including:

a plurality of key actuators respectively associated with said plurality of keys and operative to automatically rotate the associated keys, and a playback sub-system responsive to a music data code representative of a motion of one of said plurality of hammer assemblies for controlling one of said plurality of key actuators in such a manner that the associated key passes a reference point on a trajectory thereof with a physical quantity for determining a motion of said associated key, said physical quantity at said reference point causing said one of said plurality of hammer assemblies associated with said associated key to strike the associated Set of strings at an expected intensity.

2. The keyboard musical instrument as set forth in claim 1, in which said physical quantity is a velocity of said associated key.

3. The keyboard musical instrument as set forth in claim 1, in which said physical quantity is an acceleration of said associated key.

4. A keyboard musical instrument comprising:

an acoustic piano including a keyboard having a plurality of keys each rotated from a rest position to an end position when depressed by a player, a plurality of key action mechanisms functionally connected to said plurality of keys, respectively, a plurality of sets of strings respectively associated with said plurality of keys, a plurality of hammer assemblies respectively associated with said plurality of sets of strings, and respectively driven by said plurality of key action mechanisms for striking the associated sets of strings; and an automatic playing system including a plurality of key actuators respectively associated with said plurality of keys and operative to automatically rotate the associated keys, and a playback sub-system responsive to a music data code containing at least a first piece of data information indicative of one of said plurality of keys to be rotated, a second piece of data information indicative of a hammer velocity of the hammer assembly associated with said one of said plurality of keys and a third piece of data information indicative of an impact time when said hammer assembly rebounds on the associated set of strings for controlling the actuator associated with said one of said plurality of keys, said playback sub-system determining a reference physical quantity at a reference point on a trajectory of said one of said plurality of keys on the basis of said hammer velocity, said playback sub-system determining a reference time for said one of said plurality of keys on the basis of said hammer velocity and said impact time, said playback sub-system controlling said actuator in such a manner as to cause said one of said plurality of keys to pass said reference point at said reference time at said reference physical quantity, thereby causing said hamer assembly to strike the associated set of strings at said hammer velocity.

5. The keyboard musical instrument as set forth in claim 4, in which said reference physical quantity is a velocity of said one of said plurality of keys moving toward said rest position.

6. The keyboard musical instrument as set forth in claim 4 or 5, in which said acoustic piano further comprises a plurality of damper assemblies respectively associated with said plurality of sets of strings, and leaving the associated sets of strings after the associated keys is rotated toward said rest positions, said plurality of damper assemblies coming into contact with the associated sets of strings after said associated keys are rotated from said end positions, said music data code further containing a fourth piece of data information indicative of a released key velocity and a fifth piece of data information indicative of a return time when the damper assembly associated with said one of said plurality of keys comes into contact with the associated set of strings, said playback sub-system further controlling said actuator in such a manner that said one of said plurality of keys passing a reference point at said released key velocity at said return time for allowing said damper assembly to come into contact with said set of strings at an expected velocity.

7. The keyboard musical instrument as set forth in claim 4, in which said automatic playing system further includes a plurality of hammer sensors respectively associated with said plurality of hammer assemblies and monitoring the associated hammer assemblies for determining trajectories of said hammer assemblies driven when said player depresses the associated keys, and a recording sub-system operative to determine said hammer velocity and said impact time on the basis of the trajectory of said associated hammer assembly for generating said music data code.

8. The keyboard musical instrument as set forth in claim 7, in which said acoustic piano further comprises a plurality of damper assemblies respectively associated with said plurality of sets of strings, and leaving the associated sets of strings after the associated keys are rotated toward said rest positions, said plurality of damper assemblies coming into contact with the associated sets of strings after said associated keys are rotated from said end positions, said automatic playing system further includes a plurality of key sensors respectively associated with said plurality of keys and respectively monitoring the associated keys for determining trajectories of said plurality of keys released by said player, said recording sub-system operative to determine a released key velocity and a return time on the basis of the trajectory of said one of said plurality of keys, said return time is indicative of a time when the associated hammer assembly comes into contact with the associated set of strings again, said music data code further containing a fourth piece of data information indicative of said released key velocity and a fifth piece of data information indicative of said return time, said playback sub-system further controlling said actuator in such a manner that said one of said plurality of keys passing a reference point at said released key velocity at said return time for allowing said damper assembly to come into contact with said set of strings at an expected velocity.

9. The keyboard musical instrument as set forth in claim 4, in which said reference physical quantity is an acceleration of said one of said plurality of keys moving toward said rest position.

10. The keyboard musical instrument as set forth in claim 9, in which said music data code further contains a fourth piece of data information indicative of a key-on velocity of said one of said plurality of keys moving between a first point and a second point on a trajectory toward said end position and a fifth piece of data information indicative of a time when said one of said plurality of keys passes one of said first and second points, said playback sub-system approximating said trajectory to a parabola on the basis of said second to fifth pieces of data information for controlling said one of said plurality of keys.

11. The keyboard musical instrument as set forth in claim 9, in which said acoustic piano further comprises a plurality of damper assemblies respectively associated with said plurality of sets of strings, and leaving the associated sets of strings after the associated keys is rotated toward said rest positions, said plurality of damper assemblies coming into contact with the associated sets of strings after said associated keys are rotated from said end positions, said music data code further containing a fourth piece of data information indicative of a released key velocity, a fifth piece of data information indicative of a return time when the damper assembly associated with said one of said plurality of keys comes into contact with the associated set of strings, a sixth piece of data information indicative of a key-on velocity of said one of said plurality of keys moving between a first point and a second point on a first trajectory toward said rest position and a seventh piece of data information indicative of a time when said one of said plurality of keys passes one of said first and second points, said playback sub-system approximating said trajectory to a parabola on the basis of said second to fifth pieces of data information for controlling said actuator, said playback sub-system further approximating a trajectory of said one of said plurality of keys toward said rest position to a straight line for controlling said actuator in such a manner that said one of said plurality of keys passing a reference point at said released key velocity at said return time for allowing said damper assembly to come into contact with said set of strings at an expected velocity.

12. The keyboard musical instrument as set forth in claim 9, in which said acoustic piano further comprises a plurality of damper assemblies respectively associated with said plurality of sets of strings, and leaving the associated sets of strings after the associated keys is rotated toward said rest positions, said plurality of damper assemblies coming into contact with the associated sets of strings after said associated keys are rotated from said end positions, said automatic playing system further includes a plurality of hammer sensors respectively associated with said plurality of hammer assemblies and each monitoring the associated hammer assembly for reporting an actual hammer position of said hammer assembly to said recording sub-system, a plurality of key sensors respectively associated with said plurality of keys and each monitoring the associated key for reporting an actual key position to said recording sub-system, said recording sub-system operative to determine a hammer velocity and an impact time when the hammer assembly associated with said one of said plurality of keys rebounds on the associated set of strings on the basis of said actual hammer position, said recording sub-system further operative to determine a key-on velocity between first and second points on a first trajectory toward said end position, a key-on time when said one of said plurality of keys passes one of said first and second points, a released key velocity on a second trajectory toward said rest position and a return time when the damper assembly associated with said one of said plurality of keys comes into contact with the associated set of strings on the basis of said actual key position, said hammer velocity, said impact time, said key-on velocity, said key-on time, said released key velocity and said return time being contained in said music data code, said playback sub-system controlling said actuator in such a manner that said one of said plurality of keys passes said reference point at said acceleration at a reference time while said one of said plurality of keys is being moved toward said end position, said playback sub-system further controlling said actuator in such a manner that said one of said plurality of keys passing said reference point at said released key velocity at said return time.

13. The keyboard musical instrument as set forth in claim 12, in which said playback sub-system further determines a separating time for separating said damper assembly from said set of strings on the basis of said key-on time, said key-on velocity and an expected key position where said damper assembly is separated from said set of strings, said playback sub-system controlling said actuator in such a manner that said one of said plurality of keys passes said expected key position at said separating time and said reference point at said acceleration at said reference time.

14. The keyboard musical instrument as set forth in claim 12, in which said playback system controls said actuator on the assumption that said acceleration is constant.

15. The keyboard musical instrument as set forth in claim 12, in which said playback system controls said actuator on the assumption that an initial velocity of said one of said plurality of keys toward said end position is constant.

16. The keyboard musical instrument as set forth in claim 4, in which said playback sub-system and said actuators have a servo controller and respective position sensors for forming a plurality of feedback loops for said plurality of keys.

17. The keyboard musical instrument as set forth in claim 16, said feedback loops carry out a position servo control.

18. A keyboard musical instrument comprising:

an acoustic piano including a keyboard having a plurality of keys each rotated from a rest position to an end position when depressed by a player, a plurality of key action mechanisms functionally connected to said plurality of keys, respectively, a plurality of sets of strings respectively associated with said plurality of keys, a plurality of hammer assemblies respectively associated with said plurality of sets of strings, and respectively driven by said plurality of key action mechanisms for striking the associated sets of strings; and an automatic playing system including a plurality of key actuators respectively associated with said plurality of keys and operative to automatically rotate the associated keys, and a playback sub-system responsive to a music data code containing pieces of data information for determining a first trajectory of one of said plurality of keys to be rotated toward said end position, a second trajectory of said one of said plurality of keys to be rotated toward said rest position, a first starting time of said first trajectory, a finish time of said first trajectory and a second starting time of said second trajectory, said playback sub-system deciding that said music data code represents a half stroke key when said second starting time is earlier than said finish time, said playback sub-system determining a crossing time for merging said first trajectory with said second trajectory for producing a composite trajectory when said music data code represents said half stroke key, said playback sub-system controlling said actuator in such a manner as to cause said one of said plurality of keys to trace said composite trajectory.

19. The keyboard musical instrument as set forth in claim 18, in which said first trajectory and said second trajectory are represented by linear lines.

20. The keyboard musical instrument as set forth in claim 18, in which said first trajectory and said second trajectory are represented by a parabola and a leaner line.

21. A keyboard musical instrument comprising:

an acoustic piano including a keyboard having a plurality of keys each rotated from a rest position to an end position when depressed by a player, a plurality of key action mechanisms functionally connected to said plurality of keys, respectively, a plurality of sets of strings respectively associated with said plurality of keys, a plurality of hammer assemblies respectively associated with said plurality of sets of strings, and respectively driven by said plurality of key action mechanisms for striking the associated sets of strings; and an automatic playing system including a plurality of key actuators respectively associated with said plurality of keys and operative to automatically rotate the associated keys, and a playback sub-system responsive to a music data code containing pieces of data information for determining a first trajectory of one of said plurality of keys to be rotated toward said end position, a second trajectory of said one of said plurality of keys to be rotated toward said rest position, a reference physical quantity at a reference point on said first trajectory, a first starting time of said first trajectory, a reference time at said reference point, a finish time of said first trajectory and a second starting time of said second trajectory, said reference physical quantity determining a motion of said one of said plurality of keys at said reference point, said playback sub-system deciding that said music data code represents a half stroke key when said second starting time is earlier than said finish time, said playback sub-system determining a crossing time for merging said first trajectory with said second trajectory for producing a composite trajectory when said music data code represents said half stroke key, said playback sub-system controlling said actuator in such a manner as to cause said one of said plurality of keys to pass said reference point at said reference time with said reference physical quantity on said first trajectory or on said composite trajectory, thereby causing said hammer assembly to strike the associated set of strings at said hammer velocity.

22. The keyboard musical instrument as set forth in claim 21, in which said acoustic piano further includes a plurality of damper assemblies respectively associated with said plurality of sets of strings and each leaving the associated set of strings when the associated key is rotated toward said end position, each of said damper assembly coming into contact with said associated set of strings when said associated key passes a released reference point at a return time, said musical data code containing a first pieces of data information indicative of one of said plurality of keys, a second piece of data information indicative of a hammer velocity expected for the hammer assembly associated with said one of said plurality of keys, a third piece of data information indicative of an impact time when said hammer assembly strikes the associated set of strings, a fourth piece of data information indicative of a released key velocity of said one of said plurality of keys on said second trajectory, a fifth piece of data information indicative of said return time, said playback sub-system determining said first trajectory on the basis of said second and third pieces of data information and said second trajectory on the basis of said fourth and fifth pieces of data information.

23. The keyboard musical instrument as set forth in claim 21, in which said playback sub-system determines said first trajectory and said second trajectory on the assumption that said one of said plurality of keys is a full stroke key traveling between said rest position and said end position, said finish time on the basis of said first starting time, a distance between said rest position and said end position, a first initial velocity for said first trajectory and said crossing time on the basis of said second starting time, said finish time, said first initial velocity and a second initial velocity for said second trajectory.

24. The keyboard musical instrument as set forth in claim 21, in which said playback sub-system determines said first trajectory and said second trajectory on the assumption that said one of said plurality of keys is a full stroke key traveling between said rest position and said end position, said finish time on the basis of said first starting time, a distance between said rest position and said end position and said crossing time on the basis of said second starting time, said finish time and a stored ratio for dividing a time interval between said second stating time and said finish time.

* * * * *